US005800954A

United States Patent [19]

Kato et al.

[11] Patent Number: 5,800,954

[45] Date of Patent: Sep. 1, 1998

[54] METHOD OF FORMING COLOR IMAGES AND APPARATUS USED THEREFOR

[75] Inventors: Eiichi Kato; Sadao Osawa; Yusuke Nakazawa, all of Shizuoka, Japan

[73] Assignee: Fuji Photo Film Co., Ltd., Kanagawa, Japan

[21] Appl. No.: 853,411

[22] Filed: May 9, 1997

Related U.S. Application Data

[63] Continuation of Ser. No. 505,345, filed as PCT/JP94/00507, Mar. 29, 1994, abandoned.

[30] Foreign Application Priority Data

| | | | |
|---|---|---|---|
| Mar. 29, 1993 | [JP] | Japan | 5-091913 |
| May 27, 1993 | [JP] | Japan | 5-146770 |
| Sep. 2, 1993 | [JP] | Japan | 5-240279 |
| Sep. 8, 1993 | [JP] | Japan | 5-246040 |
| Dec. 28, 1993 | [JP] | Japan | 5-354624 |

[51] Int. Cl.[6] ..... G03G 13/16; G03G 15/01; G03G 15/16

[52] U.S. Cl. ..... 430/47; 430/126; 399/302; 399/308

[58] Field of Search ..... 430/47, 126; 399/302, 399/308

[56] References Cited

U.S. PATENT DOCUMENTS

| | | | |
|---|---|---|---|
| 4,134,676 | 1/1979 | Mehl | 430/126 |
| 4,686,163 | 8/1987 | Ng et al. | 430/47 |
| 5,070,372 | 12/1991 | Randall | 430/126 |
| 5,093,689 | 3/1992 | Imaeda | 430/126 |
| 5,347,296 | 9/1994 | Lewicki, Jr. et al. | 430/126 |
| 5,526,102 | 6/1996 | Kato . | |

FOREIGN PATENT DOCUMENTS

| | | |
|---|---|---|
| 3-142472 | 6/1981 | Japan . |
| 60-179751 | 9/1985 | Japan . |
| 1263555 | 2/1972 | United Kingdom . |

*Primary Examiner*—Christopher D. Rodee
*Attorney, Agent, or Firm*—Sughrue, Mion, Zinn, Macpeak & Seas, PLLC

[57] ABSTRACT

A color image is obtained by (i) providing a peelable transfer layer 12 on an electrophotographic light-sensitive element 11 comprising a support 1 and a light-sensitive layer 2, (ii) forming one or more color toner images 3 on the transfer layer by a conventional electrophotographic process, (iii) transferring the toner image 3 together with the transfer layer 12 onto a primary receptor 20, and then (iv) transferring the toner images 3 together with the transfer layer 12 onto a final receiving material 30. According to the method, a color duplicate of high accuracy and high quality without color shear is obtained, and a color image is easily transferred irrespective of the kind of a final receiving material. Further, since there is no residual toner image at the transfer, the light-sensitive element and intermediate medium are repeatedly usable.

9 Claims, 8 Drawing Sheets

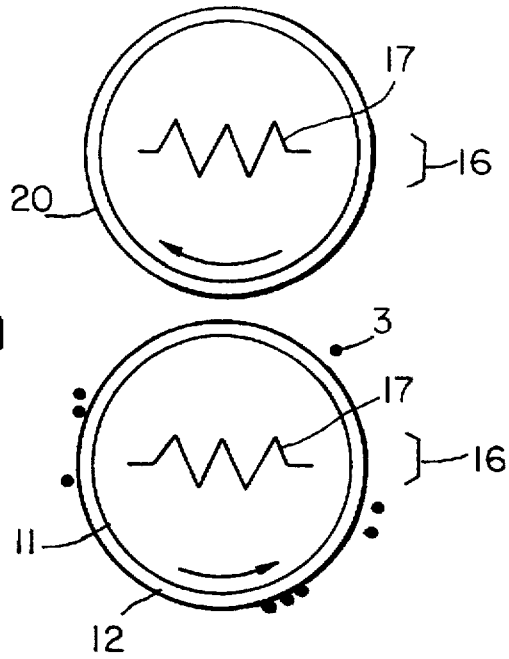
FIG. 7a
FIG. 7b
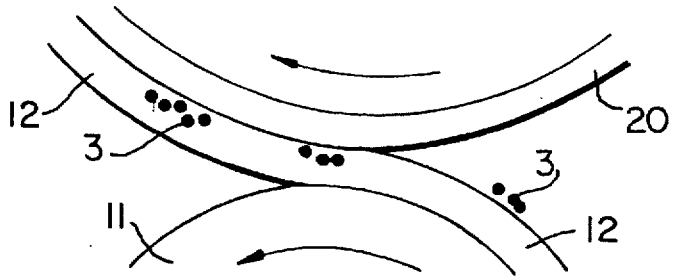

METHOD OF FORMING COLOR IMAGES AND APPARATUS USED THEREFOR

This is a Continuation of application Ser. No. 08/505,345, filed as PCT/JP94/00507, Mar. 29, 1994 now abandoned.

TECHNICAL FIELD

The present invention relates to a method of forming a color image and an apparatus used therefor suitable for an electrophotographic color duplicator, a color printer, a color proofer or a color checker.

TECHNICAL BACKGROUND

Methods of forming color printings, color duplicates or color proofs (proofs for printing) which comprises conducting development with electrophotographic developing agents to form a plurality of overlapping color toner images directly on the surface of electrophotographic light-sensitive element and transferring at once the resulting color images onto a receiving material such as printing paper have hitherto been known.

The developing methods include a so-called dry type developing method and wet type developing method. Color images obtained by the wet type developing method are preferred because of little color shear and good resolution as compared with those formed with dry toners. However, it is very difficult to directly transfer wet type toner images entirely from the surface of the light-sensitive element to printing paper.

In order to solve this problem, a method in which a transparent film is first laminated on the surface of a light-sensitive element, wet type toner images are formed by an electrophotographic process on the film, and then the film bearing the toner images is separated from the light-sensitive element and stuck on plain paper, thereby forming transferred images is described in JP-A-2-115865 and JP-A-2-115866 (the term "JP-A" as used herein means an "unexamined published Japanese patent application"). According to the method, the film to be laminated has suitably a thickness of 9 μm. However, the production and handling of a film having such thickness is very troublesome and it is necessary to arrange a special system for them.

Further, in JP-B-2-43185 (the term "JP-B" as used herein means an "examined Japanese patent publication"), a method in which imagewise exposure through a transparent electrophotographic light-sensitive element and development are conducted repeatedly to form overlapping color separation images on a dielectric support releasably provided on the light-sensitive element and the dielectric support bearing the images is transferred to a receiving material is described. Since the imagewise exposure is performed from the side of substrate for the light-sensitive element according to this method, the substrate is required to be transparent. This is disadvantageous in view of a cost.

On the other hand, an electrophotographic transfer method using a so-called dry type developing method in which a releasable transfer layer is provided on the surface of a light-sensitive element, toner images are formed on the transfer layer and the toner images are transferred together with the transfer layer to printing paper is described in JP-A-1-112264, JP-A-1-281464 and JP-A-3-11347.

Moreover, in JP-A-2-264280 a method in which toner images on a light-sensitive layer are transferred onto a primary intermediate transfer medium having high smoothness and then transferred onto a final receiving material is described. Also, a method in which a special transfer medium is used in order to obtain final color images of good quality even when wet type toner is employed is proposed in JP-A-3-243973 and JP-A-4-9087.

It appears that tone images are transferred without being affected by irregularities on the surface of receiving material according to these methods. However, since toner images are first transferred onto the primary intermediate transfer medium and then further transferred onto the final receiving material, a lack of toner image, particularly a lack of fine images such as fine lines and fine letters and unevenness in image density are observed in the resulting color images.

Further, toner images remain on the surfaces of light-sensitive element and primary intermediate transfer medium after the transfer process. Therefore, it is necessary to clean the surfaces of light-sensitive element and primary intermediate transfer medium when they are repeatedly employed. This is disadvantageous in that a device for cleaning must be provided and in that the surfaces of light-sensitive element and primary intermediate transfer medium is damaged by cleaning.

As described above, conventional color image forming methods using an intermediate transfer medium have problems in that fully satisfactory color images can not be obtained, in that since the property of intermediate medium is changed, it is difficult to maintain stably its performance over a long period of time, when the intermediate medium is repeatedly used, in that disposable materials must be employed to maintain its performance, and in that a special transfer medium is required.

The present invention is intended to solve the above-described various problems associated with conventionally known methods for forming an electrophotographic color transfer image.

An object of the present invention is to provide a method of forming a color image via an electrophotographic process using an intermediate receptor which is excellent in transferability of toner image and which provides simply and stably a color image of high accuracy and high quality without color shear irrespective of the kind of final receiving material to be employed, and an apparatus used therefor.

Another object of the present invention is to provide a method of forming a color image via an electrophotographic process in which a transfer layer has good releasability from an electrophotographic light-sensitive element and good adhesion to a receiving material, and which provides a color duplicate having good retouching property, sealing property and storage stability.

A further object of the present invention is to provide a method of forming a color image in which a transfer layer is easily prepared and transferred using a device of a simple structure in an electrophotographic apparatus and an electrophotographic light-sensitive element is repeatedly usable, thereby reducing a running cost.

DISCLOSURE OF THE INVENTION

It has been found that the above described objects of the present invention are accomplished by a method of forming a color image comprising forming at least one color toner image on a first peelable transfer layer provided on the surface of an electrophotographic light-sensitive element whose surface has releasability by an electrophotographic process, transferring the toner image together with the transfer layer onto a primary receptor, and transferring the toner image together with the transfer layer from the primary receptor onto a final receiving material.

Specifically, the method of forming a color image according to the present invention comprises, as shown in FIG. 1 which is a schematic view of the process of the present invention, providing a peelable transfer layer 12 on an electrophotographic light-sensitive element 11 having at least a support 1 and a light-sensitive layer 2 as shown in (i), forming at least one color toner image 3 on the transfer layer by a conventional electrophotographic process as shown in (ii), transferring the toner image 3 together with the transfer layer 12 onto a primary receptor 20 as shown in (iii), and further transferring the toner image 3 together with the transfer layer 12 onto a final receiving material 30 to obtain a color duplicate as shown in (iv).

Since the toner image 3 formed on the transfer layer 12 is transferred together with the transfer layer 12 onto the primary receptor 20 and then onto the final receiving material 30 according to the method of the present invention, a color duplicate of high accuracy and high quality free from color shear can be obtained in a simple manner irrespective of the kind of final receiving material in comparison with conventional transfer methods using an intermediate transfer medium in which a toner image is directly transferred from the intermediate transfer medium to a final receiving material in the absence of a transfer layer. Also, the excellent color image is stably maintained during the transfer steps, whereby an excellent color duplicate is obtained. Further, the light-sensitive element and primary receptor can be repeatedly employed because of no residual toner image remained thereon.

As shown schematically in FIG. 2, the present invention also includes a method comprising, as shown in route (a), providing further a second peelable transfer layer 12' on the toner image 3 formed on the transfer layer 12 as shown in (ii) to sandwich the toner image 3 in the first transfer layer 12 and the second transfer layer 12', and transferring the toner image 3 together with the transfer layers 12 and 12' onto a primary receptor 20 as shown in (iii) and then onto a final receiving material 30 as shown in (iv) in the same manner as above.

Further, the present invention includes a method comprising as shown in route (b), forming a peelable transfer layer 12" on a primary receptor 20, transferring the toner image 3 formed on the light-sensitive element together with the transfer layer 12 onto the transfer layer 12" on the primary receptor 20 to sandwich the toner image 3 in the transfer layer 12 and the transfer layer 12" on the primary receptor as shown in (iii), and then transferring the toner image 3 together with the transfer layers 12 and 12" onto a final receiving material 30 as shown in (iv) in the same manner as above.

In the method wherein a toner image 3 is formed on a transfer layer 12 provided on a light-sensitive element 11 and the toner image 3 is transferred together with the transfer layer 12 onto a primary receptor 20 and then onto a final receiving material 30, in order to obtain a duplicate of excellent color image, the transfer layer 12 is required to satisfy various kinds of conditions on its own in that the transfer layer does not adversely affect electrophotographic characteristics in the electrophotographic process, in that it has good transferability (i.e., good releasability from a light-sensitive element and good adhesion to a receiving material) in the transfer step and in that it has good retouching and sealing properties and filing aptitude as the resulting color duplicate.

On the contrary, the above-described various requirements for the transfer layer can be fulfilled by dividing a transfer layer into two layers as described above, more specifically by providing the second transfer layer 12' on the toner images 3 formed on the transfer layer 12 (as route (a)) or providing the second transfer layer 12" on the primary receptor 30 (as route (b)) in addition to the transfer layer 12 on the light-sensitive element 11, to share these requirements with each other depending on its function.

Since the toner image 3 is sandwiched in the first transfer layer 12 and the second transfer layer 12' or 12", fixing strength of toner image portion is reinforced by the transfer layer, and thus the toner can be employed without taking carefully its fixing property into consideration.

It is preferred in the present invention that the transfer layers 12, 12' and 12" are mainly composed of a thermoplastic resin (A) having a glass transition point of not more than 140° C. or a softening point of not more than 180° C. in order to further improve transferability of the transfer layer.

On the other hand, an adhesive strength of the surface of an electrophotographic light-sensitive element employed in the present invention measured according to JIS Z 0237-1980 "Testing methods of pressure sensitive adhesive tapes and sheets" is preferably not more than 100 gram·force (g·f), more preferably not more than 50 g·f, and particularly preferably not more than 10 g·f. The adhesive strength of the surface of primary receptor 20 is larger, preferably at least 10 g·f lager, and more preferably at least 30 g·f lager, than the adhesive strength of the surface of light-sensitive element 11. The adhesive strength of the surface of primary receptor 20 is preferably at most 200 g·f, more preferably at most 180 g·f.

By adjusting the adhesive strength in such a manner, releasability between the light-sensitive element 11 and the transfer layer 12 (and also 12' or 12") is effectively revealed, and the transfer of toner image 3 together with the transfer layer 12 from the light-sensitive element 11 to the primary receptor 20 and the transfer of toner image 3 together with the transfer layer 12 (and also 12' or 12") from the primary receptor 20 to the final receiving material 30 are easily performed. In addition, with respect to a relation between the adhesive strength of the surface of primary receptor 20 and that of the surface of the final receiving material 30, the former preferably has the adhesive strength smaller than the latter.

The measurement of adhesive strength described above is conducted according to JIS Z 0237-1980 "Testing methods of pressure sensitive adhesive tapes and sheets" 8.3.1. 180 *Degrees Peeling Method* with the following modifications:

(i) As a test plate, an electrophotographic light-sensitive element on the surface of which a transfer layer is to be provided is used.

(ii) As a test piece, a pressure resistive adhesive tape of 6 mm in width prepared according to JIS C2338-1984 is used.

(iii) A peeling rate is 120 mm/min using a constant rate of traverse type tensile testing machine.

Specifically, the test piece is laid its adhesive face downward on the cleaned test plate and a roller is reciprocate one stroke at a rate of approximately 300 mm/min upon the test piece for pressure sticking. Within 20 to 40 minutes after the sticking with pressure, a part of the stuck portion is peeled approximately 25 mm in length and then peeled continuously at the rate of 120 mm/min using the constant rate of traverse type tensile testing machine. The strength is read at an interval of 20 mm in length of peeling, and eventually read 4 times. The test is conducted on three test pieces. The mean value is determined from 12 measured values for three test pieces and the resulting mean value is converted in terms of 10 mm in width.

The measurement of adhesive strength of a primary receptor 20 or a final receiving material 30 can also be conducted in the same manner as described above using the primary receptor or final receiving material to be measured as the test plate.

Examples of the electrophotographic light-sensitive element, the surface of which has the releasability include specifically an electrophotographic light-sensitive element using amorphous silicon and an electrophotographic light-sensitive element containing a resin to increase releasability which contains a silicon atom and/or a fluorine atom (hereinafter referred to as a resin (P) sometimes) in a layer adjacent to the transfer layer 12 or the uppermost layer of the electrophotographic light-sensitive element which is to be come into contact with the transfer layer 12. By using such a light-sensitive element, the transfer layer 12 is easily and completely transferred.

The layer containing the resin containing a silicon atom and/or a fluorine atom is a layer which is adjacent to the transfer layer 12 or which is to be come into contact with the transfer layer 12 and may or may not be a light-sensitive layer. A light-insensitive layer (an overcoat layer) having the releasability described above may be provided on a light-sensitive layer in order to impart the releasability from the transfer layer 12.

Further, the resin (P) is preferably a copolymer comprising at least one polymer segment (α) containing not less than 50% by weight of a silicon atom and/or fluorine atom-containing polymer component and at least one polymer segment (β) containing from 0 to 20% by weight of a silicon atom and/or fluorine atom-containing polymer component, the polymer segment (α) and (β) being bonded in the form of blocks in view of further improvement in the releasability from the transfer layer 12.

Moreover, a light-sensitive element whose surface has the releasability can also be obtained by causing a compound (S) containing at least a fluorine atom and/or a silicon atom to adsorb or adhere onto the surface of electrophotographic light-sensitive element in the present invention. By employing the means for imparting the releasability to a light-sensitive element as described above, an electrophotographic light-sensitive element conventionally used can be utilized without taking releasability of the surface of the electrophotographic light-sensitive element into consideration.

The transfer layer 12 and second transfer layer 12" may have been previously provided on a light-sensitive element 11 and a primary receptor 20 respectively, or may be formed each time on the light-sensitive element or the primary receptor according to the present invention. The formation of transfer layer 12 or second transfer layer 12" may be performed in an apparatus different from an apparatus for an electrophotographic process and a transfer process or in the apparatus for these processes on the light-sensitive element 11 or the primary receptor 20 each time.

It is preferred that the transfer layers 12, 12' and 12" are formed on a light-sensitive element 11, the transfer layer 12 and a primary receptor 20, respectively, by any one of a hot-melt coating method, a transfer method from release paper and an electrodeposition coating method.

According to the present invention, the steps for forming the transfer layer 12 and transfer layer 12' or 12" are preferably conducted in an apparatus in which the electrophotographic process and the transfer process are carried out and the transfer layers are formed each time, since the light-sensitive element 11 and primary receptor 20 can be repeatedly employed after the transfer layers are released therefrom without throwing them away and the electrophotographic process can be advantageously performed in sequence with these steps in the same apparatus, thus resulting in an operation of a low running cost.

Therefore, one preferred embodiment of the present invention is a method of forming a color image comprising performing the following steps (i) to (iv) in the same apparatus:

(i) a step of forming a peelable transfer layer 12 on an electrophotographic light-sensitive element 11, (ii) a step of forming at least one color toner image 3 on the transfer layer 12 by an electrophotographic process, (iii) a step of transferring the toner image 3 together with the transfer layer 12 from the light-sensitive element 11 onto a primary receptor 20, and (iv) a step of transferring the toner image 3 together with the transfer layer 12 onto a receiving material 30.

Another preferred embodiment of the present invention is a method further comprising performing the following step (a) between the steps (ii) and (iii) in the same apparatus:

(a) a step of forming a second peelable transfer layer 12' on the toner image 3.

A further preferred embodiment of the present invention is a method further comprising performing the following step (b) before the step (iii) in the same apparatus:

(b) a step of forming a second peelable transfer layer 12" on a primary receptor 20.

The present invention also provides a method of forming a color image further comprising a step of causing the above-described compound (S) to adsorb or adhere onto the surface of electrophotographic light-sensitive element 11 before the step (i) of forming the transfer layer 12 in order to impart the releasability to the electrophotographic light-sensitive element 11 in the apparatus.

In the present invention, the step (i) of forming the first transfer layer 12 on an electrophotographic light-sensitive element 11 is performed by means of electrodeposition or adhesion of resin grains (AR) by electrophoresis on the surface of electrophotographic light-sensitive element 11 to form a film using a dispersion for electrodeposition comprising resin grains (AR) having a glass transition point of not more than 140° C. or a softening point of not more than 180° C. dispersed in an electrically insulating organic solvent having a dielectric constant of not more than 3.5 and at least one compound (S) which has a fluorine atom and/or a silicon atom and is soluble at least 0.01 g per 1.0 liter of the organic solvent.

Since the compound (S) having a fluorine atom and/or silicon atom contained in the dispersion for electrodeposition forming the transfer layer tends to adsorb or adhere onto the surface of light-sensitive element 11 before the electrodeposition or adhesion of dispersed resin grains (AR) by electrophoresis on the surface of light-sensitive element 11, releasability has been imparted onto the surface of light-sensitive element 11 at the formation of transfer layer 12, thereby effectively providing transferability of the transfer layer 12. According to such a procedure, the impartation of releasability and formation of transfer layer 12 onto the electrophotographic light-sensitive element 11 can be performed at the same time and a specific technique for imparting releasability on the surface of light-sensitive element 11 is not necessary.

The preparation of a uniform and thin layer can be easily performed by supplying resin grains (AR) between the electrophotographic light-sensitive element 11 and an electrode placed in face of the light-sensitive element and migrating the resin grains (AR) by electrophoresis according to a potential gradient applied from an external power source to cause the grains (AR) to electrodeposite on or adhere to the electrophotographic light-sensitive element 11 and form a film.

In addition, the present invention provides an apparatus for forming a color image comprising a means for forming a peelable transfer layer on the surface of an electrophotographic light-sensitive element, a means for forming at least one color toner image on the transfer layer by an electrophotographic process, a means for transferring the toner image together with the transfer layer on to a primary receptor and a means for transferring the toner image together with the transfer layer from the primary receptor onto a final receiving material.

The present invention also provides an apparatus for forming a color image further comprising a means for forming a second peelable transfer layer on the toner image formed on the transfer layer, or an apparatus for forming a color image further comprising a means for forming a second peelable transfer layer on a primary receptor.

The present invention further provides an apparatus for forming a color image further comprising a means for causing the compound (S) described above to adsorb or adhere onto the surface of light-sensitive element.

Now, the transfer layer 12 (including 12' and 12") which can be used in the present invention will be described in greater detail below.

The transfer layer 12 used in the present invention is mainly composed of a resin (A), and is not particularly limited as far as it is light-transmittive and capable of transmitting a radiation having a wavelength which constitutes at least one part of the spectrally sensitive region of electrophotographic light-sensitive element. The layer may be colored. In a case wherein duplicated images transferred on a final receiving material are color images, particularly full-color images, a colorless and transparent transfer layer is usually employed.

It is preferred for the transfer layer 12 mainly composed of the resin (A) according to the present invention to be peelable under transfer condition of a temperature of not more than 180° C. and/or a pressure of not more than 30 $Kgf/cm^2$, particularly a temperature of not more than 160° C. and/or a pressure of not more than 20 $Kgf/cm^2$. A transfer layer only peelable under condition exceeding the above described value is not preferred since a large-sized apparatus is necessary in order to maintain the desired heat capacity and pressure for releasing and transferring the transfer layer from the surface of light-sensitive element and a transfer speed must be makedly lowered.

The lower limit of the condition described above is preferably a temperature of not less than room temperature and/or a pressure of not less than 0.1 $Kgf/cm^2$.

The resin (A) preferably used may be any resin which is peelable under the transfer condition described above. With respect to the thermal property, the resin (A) has preferably a glass transition point of not more than 140° C. or a softening point of not more than 180° C., and more preferably a glass transition point of not more than 100° C. or a softening point of not more than 150° C.

Moreover, at least two resins (A) having a glass transition point or a softening point different from each other are preferably used in combination. Specifically, a resin having a glass transition point of from 30° C. to 140° C. or a softening point of from 35° C. to 180° C. (hereinafter referred to as a resin (AH) sometimes) and a resin having a glass transition point of not more than 40° C. or a softening point of not more than 45° C. (hereinafter referred to as a resin (AL) sometimes) and the glass transition point or the softening point at least 2° C. lower than the glass transition point or the softening point, respectively, of the resin (AH) are used in combination. The resin (AH) has preferably a glass transition point of from 30° C. to 120° C. or a softening point of from 38° C. to 160° C., and more preferably a glass transition point of from 35° C. to 90° C. or a softening point of from 40° C. to 120° C. The resin (AL) has preferably a glass transition point of from −50° C. to +38° C. or a softening point of from 0° C. to 40° C., and more preferably a glass transition point of from −40° C. to +33° C. or a softening point of from 5° C. to 35° C.

More preferably, a glass transition point or a softening point of resin (AL) is at least 5° C. lower than one of resin (AH).

The difference in the glass transition point or softening point between the resin (AH) and the resin (AL) means a difference between the lowest glass transition point or softening point of those of the resins (AH) and the highest glass transition point or softening point of those of the resins (AL) when two or more of the resins (AH) and/or resins (AL) are employed.

A weight ratio of resin (AH)/resin (AL) used in the transfer layer is preferably from 5/95 to 90/10, more preferably from 10/90 to 70/30.

When the weight ratio of resin (AH)/resin (AL) is out of the range described above, the effect for further improving transferability of the transfer layer 12 from a primary receptor 20 to a receiving material 30 according to the present invention may disappear.

In a case wherein the transfer layer is divided into two parts containing toner image therebetween, i.e., a transfer layer 12' or transfer layer 12" is provided in addition to a transfer layer 12, the transfer layer 12 formed on an electrophotographic light-sensitive element is not particularly limited as far as it is light-transmittive and capable of transmitting a radiation having a wavelength which. constitutes at least one part of the spectrally sensitive region of electrophotographic light-sensitive element. The layer may be colored. In a case wherein duplicated images transferred on a final receiving material are color images, particularly full-color images, a colorless and transparent transfer layer is usually employed.

It is important for the transfer layer 12 used in the present invention to have features in that it does not degrade electrophotographic characteristics (such as chargeability, dark charge retention rate and photosensitivity) until toner images are formed by an electrophotographic process, in that it has thermo-plasticity sufficient for easy release from the surface of light-sensitive element 11 in the heat transfer process and in that it is easily transferred onto a receiving material 30 in the final transfer process irrespective of the kind of receiving material. Particularly, good adhesion of the transfer layer 12 to a receiving material 30 is very important in view of improving releasability at an interface between the second transfer layer 12' or 12" and the primary receptor 20.

On the other hand, the second transfer layer 12' or 12" is not imposed such a restriction relating to the electrophotographic process as on the transfer layer 12 since the transfer layer 12' or 12" is provided independently of the formation of toner image. The transfer layer 12' or 12" used is usually colorless and transparent, since it constitutes the uppermost layer in the color duplicate transferred on the receiving material 30.

It is important for the second transfer layer 12' or 12" to have good adhesion to toner image 3 and transfer layer 12 in the non-image areas to accepts retouching and sealing without causing any trouble as the resulting color duplicate which has good storage stability wherein the transfer layer is not peeled from the receiving material when the duplicate has been filed between various sheets and piled up during storage.

The first transfer layer 12 and second transfer layer 12' or 12" are preferably so constructed as to fulfill the above-described requirements for the transfer layers in the present invention.

In particular, in the method according to the present invention wherein a second transfer layer 12' or 12" is provided independently of the first transfer layer 12 on the light-sensitive element 11, excellent transferability of transfer layer can be achieved, for example, by employing transfer layer 12' or 12" which has good adhesion on the surface to be brought into contact with toner image 3 and transfer layer 12 in the non-image areas in comparison with a case of conducting transfer onto a primary receptor 20 without the formation of second transfer layer 12' or 12".

Moreover, a stratiform structure comprising (i) a first transfer layer 12 composed of (a) a layer containing a thermoplastic resin (AH) having a relatively high glass transition point or softening point provided on the surface of light-sensitive element 11 and (b) a layer provided thereon containing a thermoplastic resin (AL) having a relatively low glass transition point or softening point and (ii) a second transfer layer 12' or 12" composed of (c) a layer containing a thermoplastic resin (AL) having a relatively low glass transition point or softening point contact with toner image 3 and transfer layer 12 in the non-image areas and (d) a layer containing a thermoplastic resin (AH) having a relatively high glass transition point or softening point contact with primary receptor 20 is preferred. By adopting such a configuration, adhesion between the transfer layer 12 bearing toner image 3 thereon and the second transfer layer 12' or 12" greatly increases, transferability of the transfer layer to a primary receptor 20 or a receiving material 30 is remarkably improved, a further enlarged latitude of transfer condition (e.g., heating temperature, pressure, and transportation speed) can be achieved, and the transfer can be easily performed irrespective of the kind of receiving material to form a color duplicate. By applying such a double-layered structure only to second transfer layer 12' or 12", an improved effect on transferability is at least observed.

Moreover, the above-described filing aptitude is more improved since the surface of the transfer layer transferred onto a receiving material 30 is mainly composed of the thermoplastic resin (AH) having a relatively high glass transition point or softening point, and the retouching property and sealing property similar to those of normal paper may be imparted to the resulting color duplicate by appropriately selecting the thermoplastic resin (AH).

The resin (A) which can be used in the transfer layer may be any resins which satisfy the above described requirement on thermal property, and include thermoplastic resins and resins conventionally known as adhesive or stick. Suitable examples of such resins include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, olefin-styrene copolymers, olefin-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring (the heterocyclic ring including, for example, furan, tetrahydrofuran, thiophene, dioxane, dioxofuran, lactone, benzofuran, benzothiophene and 1,3-dioxetane rings), cellulose resins, fatty acid-modified cellulose resins and epoxy resins.

Specific examples of resins are described, e.g., in *Plastic Zairyo Koza Series*, Vols. 1 to 18, Nikkan Kogyo Shinbunsha (1981), Kinki Kagaku Kyokai Vinyl Bukai (ed.), *Polyenka Vinyl*, Nikkan Kogyo Shinbunsha (1988), Eizo Omori, *Kinosei Acryl Jushi*, Techno System (1985), Ei-ichiro Takiyama, *Polyester Jushi Handbook*, Nikkan Kogyo Shinbunsha (1988), Kazuo Yuki (ed.), *Howa Polyester Jushi Handbook*, Nikkan Kogyo Shinbunsha (1989), Kobunshi Gakkai (ed.), *Kobunshi Data Handbook* (*Oyo-hen*), Ch. 1, Baifukan (1986), Yuji Harasaki (ed.), *Saishin Binder Gijutsu Binran*, Ch. 2, Sogo Gijutsu Center (1985), Taira Okuda (ed.), *Kobunshi Kako*, Vol. 20, Supplement "Nenchaku", Kobunshi Kankokai (1976), Keizi Fukazawa, *Nenchaku Giiutsu*, Kobunshi Kankokai (1987), Mamoru Nishiguchi, *Secchaku Binran*, 14th Ed., Kobunshi Kankokai (1985), and Nippon Secchaku Kokai (ed.), *Secchaku Handbook*, 2nd Ed., Nikkan Kogyo Shinbunsha (1980).

The resin (A) used in the transfer layer of the present invention may contain a polymer component (F) containing a moiety having a fluorine atom and/or a silicon atom which has an effect to increase the releasability of resin (A) itself as a polymer component in the resin described above. By using such a resin, releasability of the transfer layer from the electrophotographic light-sensitive element is increased and as a result, the transferability is further improved.

The moiety having a fluorine atom and/or a silicon atom may be incorporated into the main chain of the polymer or contained as a substituent in the side chain of the polymer.

The content of polymer component (F) is preferably from 3 to 40% by weight, more preferably from 5 to 25% by weight of the total polymer components of the resin (A).

The polymer components (F) are preferably present as a block in the resin (A).

When the resin constituting the transfer layer comprises two or more resins having a glass transition point or a softening point different from each other as described above, the polymer component (F) containing a fluorine atom and/or a silicon atom may be incorporated into any of the resin (AH) and resin (AL). It is desirable to incorporate the polymer component (F) into the resin (AH) in order to effectively increase the releasability of the transfer layer from the electrophotographic light-sensitive element 11 or primary receptor 20, resulting in improvement of the transferability.

The polymer component (F) having an effect for increasing the releasability of the resin (A) itself and capable of being incorporated therein will be described below.

The fluorine atom-containing moieties include monovalent or divalent organic residues, for example, $—C_hF_{2h+1}$ (wherein h represents an integer of from 1 to 18), $—(CF_2)_jCF_2H$ (wherein j represents an integer of from 1 to 17), $—CFH_2$,

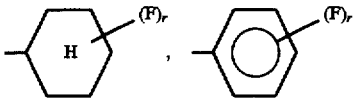

(wherein r represents an integer of from 1 to 5), $—CF_2—$, —CFH—,

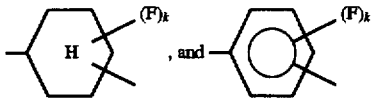

(wherein k represents an integer of from 1 to 4).

The silicon atom-containing moieties include monovalent or divalent organic residues, for example,

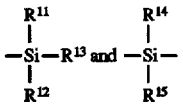

wherein $R^{11}$, $R^{12}$, $R^{13}$, $R^{14}$, and $R^{15}$, which may be the same or different, each represents a hydrocarbon group which may be substituted or $—OR^{16}$ wherein $R^{16}$ represents a hydrocarbon group which may be substituted.

The hydrocarbon group represented by $R^{11}$, $R^{12}$, $R^{13}$, $R^{14}$ or $R^{15}$ include specifically an alkyl group having from 1 to 18 carbon atoms which may be substituted (e.g., methyl, ethyl, propyl, butyl, hexyl, octyl, decyl, dodecyl, hexadecyl, 2-chloroethyl, 2-bromoethyl, 2,2,2-trifluoroethyl, 2-cyanoethyl, 3,3,3-trifluoropropylethyl, 2-methoxyethyl, 3-bromopropyl, 2-methoxycarbonylethyl, or 2,2,2,2',2',2'-hexafluoroisopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, or 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, or dimethoxybenzyl), an alicyclic group having from 5 to 8 carbon atoms which may be substituted (e.g., cyclohexyl, 2-cyclohexyl, or 2-cyclopentylethyl), or an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propionamidophenyl, or dodecyloylamidophenyl). $R^{16}$ in $—OR^{16}$ has the same meaning as the above-described hydrocarbon group for $R^{11}$.

The fluorine atom and/or silicon atom-containing organic residue may be composed of a combination thereof. In such a case, they may be combined either directly or via a linking group. The linking groups include divalent organic residues, for example, divalent aliphatic groups, divalent aromatic groups, and combinations thereof, which may or may not contain a bonding group, e.g., —O—, —S—,

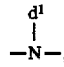

—CO—, —SO—, $—SO_2—$, —COO—, —OCO—, —CONHCO—, —NHCONH—,

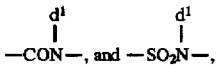

wherein $d^1$ as the same meaning as $R^{11}$ above.

Examples of the divalent aliphatic groups are shown below.

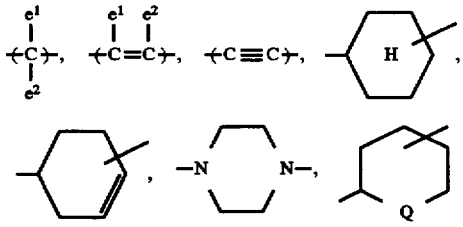

wherein $e^1$ and $e^2$, which may be the same or different, each represents a hydrogen atom, a halogen atom (e.g., chlorine or bromine) or an alkyl group having from 1 to 12 carbon atoms (e.g., methyl, ethyl, propyl, chloromethyl, bromomethyl, butyl, hexyl, octyl, nonyl or decyl); and Q represents —O—, —S—, or

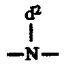

wherein $d^2$ represents an alkyl group having from 1 to 4 carbon atoms, $—CH_2Cl$, or $—CH_2Br$.

Examples of the divalent aromatic groups include a benzene ring, a naphthalene ring, and a 5- or 6-membered heterocyclic ring having at least one hetero atom selected from an oxygen atom, a sulfur atom and a nitrogen atom. The aromatic groups may have a substituent, for example, a halogen atom (e.g., fluorine, chlorine or bromine), an alkyl group having from 1 to 8 carbon atoms (e.g., methyl, ethyl, propyl, butyl, hexyl or octyl) or an alkoxy group having from 1 to 6 carbon atoms (e.g., methoxy, ethoxy, propoxy or butoxy). Examples of the heterocyclic ring include a furan ring, a thiophene ring, a pyridine ring, a piperazine ring, a tetrahydrofuran ring, a pyrrole ring, a tetrahydropyran ring, and a 1,3-oxazoline ring.

Specific examples of the repeating units having the fluorine atom and/or silicon atom-containing moiety as described above are set forth below, but the present invention should not be construed as being limited thereto. In formulae (F-1) to (F-32) below, $R_f$ represents any one of the following groups of from (1) to (11); and b represents a hydrogen atom or a methyl group.

$$-C_nF_{2n+1} \quad (1)$$

$$-CH_2C_nF_{2n+1} \quad (2)$$

$$-CH_2CH_2C_nF_{2n+1} \quad (3)$$

$$-CH_2(CH_2)_mCFHCF_3 \quad (4)$$

$$-CH_2CH_2(CH_2)_mCFHCF_3 \quad (5)$$

-continued
$-CH_2CH_2(CH_2)_mCFHCF_2H$ (6)
$-CH_2(CF_2)_mCFHCF_2H$ (7)
(8)
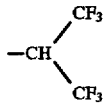
(9)
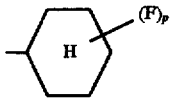
(10)
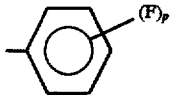
(11)
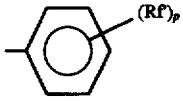
wherein $R_f$ represents any one of the above-described groups of from (1) to (8); n represents an integer of from 1 to 18; m represents an integer of from 1 to 18; and p represents an integer of from 1 to 5.
(F-1)
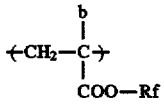
(F-2)
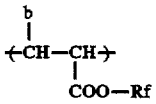
(F-3)
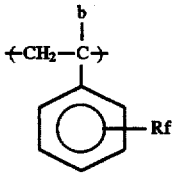
(F-4)
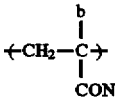
(F-5)
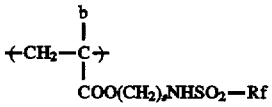
(s: an interger of from 1 to 12)
(F-6)
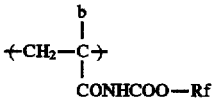
(F-7)
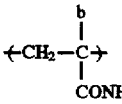
(F-8)
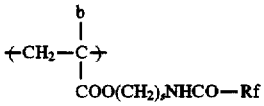
(F-9)
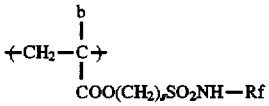
(F-10)
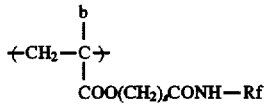
(F-11)
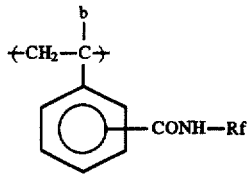
(F-12)
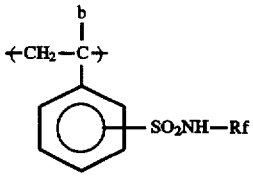
(F-13)
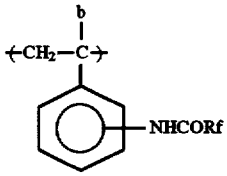
(F-14)
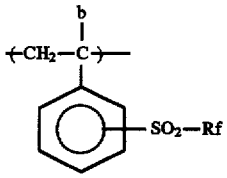
(F-15)
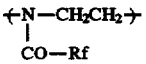
(F-16)
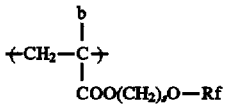
(F-17)
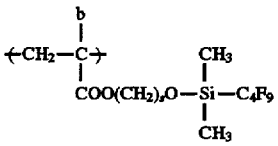
(F-18)
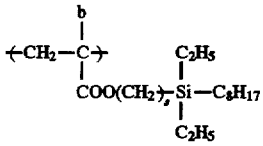

-continued (F-19)

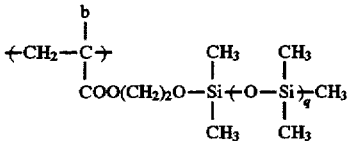

q: an integer of from 1 to 20

(F-20)

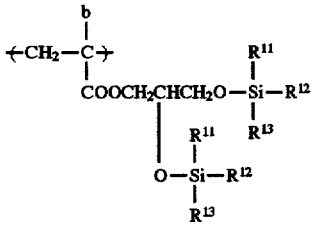

$R^{11}$, $R^{12}$, $R^{13}$: an alkyl group having from 1 to 12 carbon atoms (F-21)

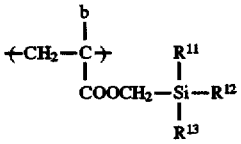

(F-22)

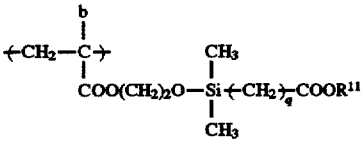

(F-23)

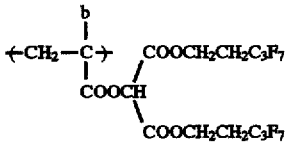

(F-24)

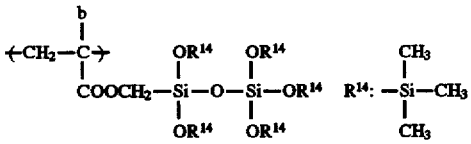

(F-25)

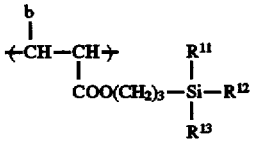

(F-26)

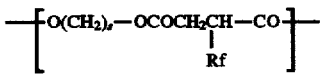

(F-27)

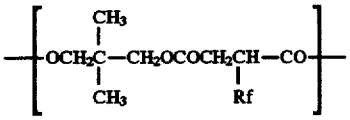

(F-28)

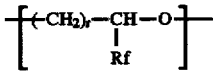

t: an integer of from 3 to 6

-continued (F-29)

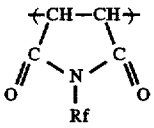

(F-30)

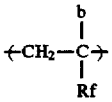

(F-31)

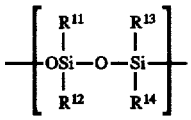

(F-32)

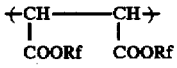

A preferred embodiment of the block copolymer in the resin (A) according to the present invention will be described below. Any type of copolymer can be used as far as the fluorine atom and/or silicon atom-containing polymer components are contained as a block in the resins (A). The term "to be contained as a block" means that the resin has a polymer segment comprising at least 70% by weight of the fluorine atom and/or silicon atom-containing polymer component based on the polymer segment. The forms of blocks include an A-B type block, an A-B-A type block, a B-A-B type block, a graft type block, and a starlike type block as schematically illustrated below.

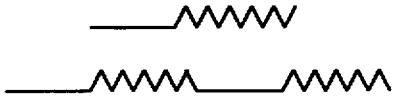

A-B Type

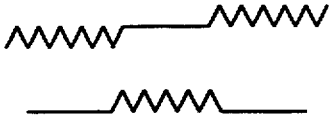

A-B-A (B-A-B) Type

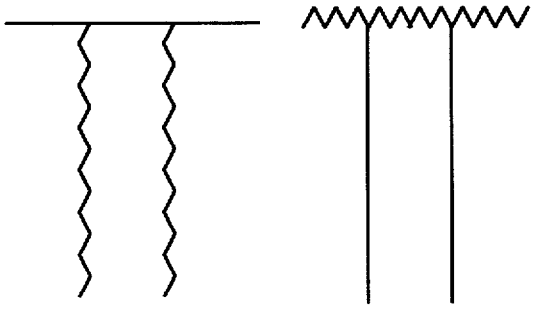

Graft Type (The number of the grafts is arbitrary)

-continued

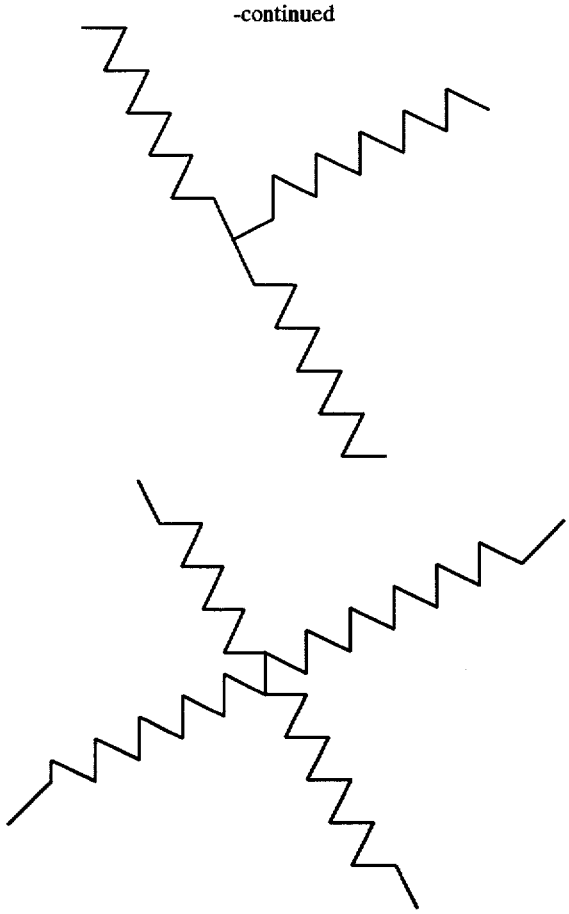

Starlike Type (The number of the branches is arbitrary)

: Segment (α) (containing fluorine atom and/or silicon atom)

: Segment (β) (containing no or little fluorine atom and/or silicon atom)

These various types of block copolymers can be synthesized in accordance with conventionally known polymerization methods. Useful methods are described, e.g., in W. J. Burlant and A. S. Hoffman, *Block and Graft Polymers*, Reuhold (1986), R. J. Cevesa, *Block and Graft Copolymers*, Butterworths (1962), D. C. Allport and W. H. James, *Block Copolymers*, Applied Sci. (1972), A. Noshay and J. E. McGrath, *Block Copolymers*, Academic Press (1977), G. Huvtreg, D. J. Wilson, and G. Riess, *NATO ASIser. SerE.*, Vol. 1985, p. 149, and V. Perces, *Applied Polymer Sci.*, Vol. 285, p. 95 (1985).

For example, ion polymerization reactions using an organometallic compound (e.g., an alkyl lithium, lithium diisopropylamide, an alkali metal alcoholate, an alkylmagnesium halide, or an alkylaluminum halide) as a polymerization initiator are described, for example, in T. E. Hogeu-Esch and J. Smid, *Recent Advances in Anion Polymerization*, Elsevier (New York) (1987), Yoshio Okamoto, *Kobunshi*, Vol. 38, P. 912 (1989), Mitsuo Sawamoto, *Kobunshi*, Vol. 38, p. 1018 (1989), Tadashi Narita, *Kobunshi*, Vol. 37, p. 252 (1988), B. C. Anderson, et al., *Macromolecules*, Vol. 14, p. 1601 (1981), and S. Aoshima and T. Higasimura, *Macromolecules*, Vol. 22, p. 1009 (1989).

Ion polymerization reactions using a hydrogen iodide/iodine system are described, for example, in T. Higashimura, et al., *Macromol. Chem., Macromol. Symp.*, Vol. 13/14, p. 457 (1988), and Toshinobu Higashimura and Mitsuo Sawamoto, *Kobunshi Ronbunshu*, Vol. 46, p. 189 (1989).

Group transfer polymerization reactions are described, for example, in D. Y. Sogah, et al., *Macromolecules*, Vol. 22, p. 1473 (1987), O. W. Webster and D. Y. Sogah, *Kobunshi*, Vol. 36, p. 808 (1987), M. T. Reetg, et al., *Angew. Chem. Int. Ed. Engl.*, Vol. 25, p. 9108 (1986), and JP-A-63-97609.

Living polymerization reactions using a metalloporphyrin complex are described, for example, in T. Yasuda, T. Aida, and S. Inoue, *Macromolecules*, Vol. 17, p. 2217 (1984), M. Kuroki, T. Aida, and S. Inoue, *J. Am. Chem. Soc.*, Vol. 109, p. 4737 (1987), M. Kuroki, et al., *Macromolecules*, Vol. 21, p. 3115 (1988), and M. Kuroki and I. Inoue, *Yuki Gosei Kagaku*, Vol. 47, p. 1017 (1989).

Ring-opening polymerization reactions of cyclic compounds are described, for example, in S. Kobayashi and T. Saegusa, *Ring Opening Polymerization*, Applied Science Publishers Ltd. (1984), W. Seeliger, et al., *Angew. Chem. Int. Ed. Engl.*, Vol. 5, p. 875 (1966), S. Kobayashi, et al., *Poly. Bull.*, Vol. 13, p. 447 (1985), and Y. Chujo, et al., *Macromolecules*, Vol. 22, p. 1074 (1989).

Photo living polymerization reactions using a dithiocarbamate compound or a xanthate compound, as an initiator are described, for example, in Takayuki Otsu, *Kobunshi*, Vol. 37, p. 248 (1988), Shun-ichi Himori and Koichi Otsu, *Polymer Rep. Jap.*, Vol. 37, p. 3508 (1988), JP-A-64-111, JP-A-64-26619, and M. Niwa, *Macromolecules*, Vol. 189, p. 2187 (1988).

Radical polymerization reactions using a polymer containing an azo group or a peroxide group as an initiator to synthesize block copolymers are described, for example, in Akira Ueda, et al., *Kobunshi Ronbunshu*, Vol. 33, p. 931 (1976), Akira Ueda, *Osaka Shiritsu Kogyo Kenkyusho Hokoku*, Vol. 84 (1989), O. Nuyken, et al., *Macromol. Chem., Rapid. Commun.*, Vol. 9, p. 671 (1988), Yasuo Moriya et al., *Kyoka Plastic*, Vol. 29, p. 907, and Ryohei Oda, *Kagaku to Kogyo*, Vol. 61, p. 43 (1987).

Syntheses of graft type block copolymers are described in the above-cited literature references and, in addition, Fumio Ide, *Graft Jugo to Sono Oyo*, Kobunshi Kankokai (1977), and Kobunshi Gakkai (ed.), *Polymer Alloy*, Tokyo Kagaku Dojin (1981). For example, known grafting techniques including a method of grafting of a polymer chain by a polymerization initiator, an actinic ray (e.g., radiant ray, electron beam), or a mechano-chemical reaction; a method of grafting with chemical bonding between functional groups of polymer chains (reaction between polymers); and a method of grafting comprising a polymerization reaction of a macromonomer may be employed.

The methods of grafting using a polymer are described, for example, in T. Shiota, et al., *J. Appl. Polym. Sci.*, Vol. 13, p. 2447 (1969), W. H. Buck, *Rubber Chemistry and Technology*, Vol. 50, p. 109 (1976), Tsuyoshi Endo and Tsutomu Uezawa, *Nippon Secchaku Kyokaishi*, Vol. 24, p. 323 (1988), and Tsuyoshi Endo, ibid., Vol. 25, p. 409 (1989).

The methods of grafting using a macromonomer are described, for example, in P. Dreyfuss and R. P. Quirk, *Encycl. Polym. Sci. Eng.*, Vol. 7, p. 551 (1987), P. F. Rempp and E. Franta, *Adv. Polym. Sci.*, Vol. 58, p. 1 (1984), V. Percec, *Appl. Poly. Sci.*, Vol. 285, p. 95 (1984), R. Asami and M. Takari, *Macromol. Chem. Suppl.*, Vol. 12, p. 163 (1985), P. Rempp, et al., *Macromol. Chem. Suppl.*, Vol. 8, p. 3 (1985), Katsusuke Kawakami, *Kagaku Kogyo*, Vol. 38, p. 56 (1987), Yuya Yamashita, *Kobunshi*, Vol. 31, p. 988 (1982), Shiro Kobayashi, *Kobunshi*, Vol. 30, p. 625 (1981), Toshinobu Higashimura, *Nippon Secchaku Kyokaishi*, Vol. 18, p. 536 (1982), Koichi Itoh, *Kobunshi Kako*, Vol. 35, p. 262 (1986), Takashiro Azuma and Takashi Tsuda, *Kino Zairyo*, Vol. 1987, No. 10, p. 5, Yuya Yamashita (ed.), *Macromonomer no Kagaku to Kogyo*, I.P.C. (1989), Tsuyoshi Endo (ed.), *Atarashii Kinosei Kobunshi no Bunshi Sekkei*, Ch. 4, C.M.C. (1991), and Y. Yamashita, et al., *Polym. Bull.*, Vol. 5, p. 361 (1981).

Syntheses of starlike block copolymers are described, for example, in M. T. Reetz, *Angew. Chem. Int. Ed. Engl.*, Vol. 27, p. 1373 (1988), M. Sgwarc, *Carbanions, Living Polymers and Electron Transfer Processes*, Wiley (New York) (1968), B. Gordon, et al., *Polym. Bull.*, Vol. 11, p. 349 (1984), R. B. Bates, et al., *J. Org. Chem.*, Vol. 44, p. 3800 (1979), Y. Sogah, *A.C.S. Polym. Rapr.*, Vol. 1988, No. 2, p. 3, J. W. Mays, *Polym. Bull.*, Vol. 23, p. 247 (1990), I. M. Khan et al., *Macromolecules*, Vol. 21, p. 2684 (1988), A. Morikawa, *Macromolecules*, Vol. 24, p. 3469 (1991), Akira Ueda and Toru Nagai, *Kobunshi*, Vol. 39, p. 202 (1990), and T. Otsu, *Polymer Bull.*, Vol. 11, p. 135 (1984).

While reference can be made to known techniques described in the literatures cited above, the method for synthesizing the block copolymers according to the present invention is not limited to these methods.

The resin (A) is preferably used at least 70% by weight, more preferably at least 90% by weight based on the total amount of the composition for the transfer layer. The resin (A) may be used individually or as a mixture of two or more thereof.

If desired, the transfer layer 12, 12' or 12" may contain various additives for improving physical characteristics, such as adhesion, film-forming property, and film strength. For example, rosin, petroleum resin, or silicone oil may be added for controlling adhesion; polybutene, DOP, DBP, low-molecular weight styrene resins, low molecular weight polyethylene wax, microcrystalline wax, or paraffin wax, as a plasticizer or a softening agent for improving wetting property to the light-sensitive element or decreasing melting viscosity; and a polymeric hindered polyvalent phenol, or a triazine derivative, as an antioxidant. For the details, reference can be made to Hiroshi Fukada, *Hot-melt Secchaku no Jissai*, pp. 29 to 107, Kobunshi Kankokai (1983).

A thickness of the transfer layer is suitably from 0.1 to 20 μm, preferably from 0.5 to 10 μm. When the thickness is 0.1 μm or more, the transfer can be satisfactorily conducted. If the transfer layer is too thin, it is liable to result in insufficient transfer, and if the transfer layer is too thick, troubles on the electrophotographic process tend to occur, failing to obtain a sufficient image density or resulting in degradation of image quality.

When the second transfer layer 12' or 12" is provided in addition to the transfer layer 12, each thickness of the transfer layer 12, and transfer layer 12' or 12" is preferably in a range of from 0.1 to 10 $g/m^2$, more preferably in a range of from 0.5 to 7 $g/m^2$. If each of the transfer layer is too thin, it is liable to result in insufficient transfer. If the transfer layer 12 provided on the light-sensitive element 11 is too thick, troubles on the electrophotographic process tends to occur, failing to obtain a sufficient image density or resulting in degradation of image quality. When the transfer layer 12' or 12" is too thick, while there is no problem in practical use, it is not preferred in view of saving an amount of the resin used.

Now, an electrophotographic light-sensitive element 11 having the releasability on which the transfer layer 12 is provided will be described in detail below.

Any conventionally known electrophotographic light-sensitive element can be employed. What is important is that the surface of the light-sensitive element 11 has the releasability at the time for the formation of transfer layer 12 so as to easily release the transfer layer 12 provided thereon together with toner image 3. Specifically, in the present invention, an adhesive strength of the surface of light-sensitive element 11 measured according to JIS Z 0237-1980 "Testing Methods of pressure sensitive adhesive tapes and sheets" is preferably not more than 100 g·f, more preferably not more than 50 g·f, and particularly preferably not more than 10 g·f, at the time for the formation of transfer layer 12.

While an electrophotographic light-sensitive element 11 which has already the surface exhibiting the desired releasability can be employed in the present invention, it is also possible to cause a compound (S) containing at least a fluorine atom and/or a silicon atom to adsorb or adhere onto the surface of electrophotographic light-sensitive element 11 for imparting the releasability thereto before the formation of toner image 3. Thus, conventional electrophotographic light-sensitive elements can be utilized without taking releasability of the surface thereof into consideration.

Further, when releasability of the surface of electrophotographic light-sensitive element tends to decrease during repeated use of the light-sensitive element having the surface releasability according to the present invention, the method for adsorbing or adhering a compound (S) can be applied. By the method, the releasability of light-sensitive element is easily maintained.

The impartation of releasability onto the surface of electrophotographic light-sensitive element is preferably carried out in an electrophotographic apparatus for forming a color image, and specifically a means for causing the compound (S) to adsorb or adhere onto the surface of electrophotographic light-sensitive element 11 is further provided in the electrophotographic apparatus for forming a color image.

In order to obtain a light-sensitive element 11 having a surface of the releasability, there are a method of selecting a light-sensitive element 11 previously having such a surface of the releasability, a method of imparting the releasability to a surface of electrophotographic light-sensitive element 11 conventionally employed by causing the compound (S) for imparting releasability to adsorb or adhere onto the surface of light-sensitive element 11, and a method of forming a transfer layer 12 on a light-sensitive element by an electrodeposition coating method using a dispersion for electrodeposition containing the compound (S) for imparting releasability to simultaneously conduct the impartation of releasability and formation of transfer layer 12 on the light-sensitive element 11.

Suitable examples of the light-sensitive elements previously having the surface of releasability used in the first method include those employing a photoconductive substance which is obtained by modifying a surface of amorphous silicon to exhibit the releasability.

For the purpose of modifying the surface of electrophotographic light-sensitive element mainly containing amorphous silicon to have the releasability, there is a method of treating a surface of amorphous silicon with a coupling agent containing a fluorine atom and/or a silicon atom (for example, a silane coupling agent or a titanium coupling agent) as described, for example, in JP-A-55-89844, JP-A-4-231318, JP-A-60-170860, JP-A-59-102244 and JP-A-60-17750. Also, a method of adsorbing and fixing the compound (S) according to the present invention, particularly a releasing agent containing a component having a fluorine atom and/or a silicon atom as a substituent in the form of a block (for example, a polyether-modified polydialkylsilicone or a carboxylic acid-, amino group- or carbinol-modified polydialkylsilicone) as described in detail below can be employed.

Further, another example of the light-sensitive elements previously having the surface of releasability is an electrophotographic light-sensitive element containing a polymer having a polymer component containing a fluorine atom and/or a silicon atom in a region near to the surface thereof.

The term "region near to the surface of electrophotographic light-sensitive element" used herein means the uppermost layer of the light-sensitive element and includes an overcoat layer provided on a photoconductive layer and the uppermost photoconductive layer. Specifically, an overcoat layer is provided on the light-sensitive element having a photosensitive layer as the uppermost layer which contains the above-described polymer to impart the releasability, or the above-described polymer is incorporated into the uppermost layer of a photoconductive layer (including a single photoconductive layer and a laminated photoconductive layer) to modify the surface thereof so as to exhibit the releasability. By using such a light-sensitive element, the transfer layer can be easily and completely transferred since the surface of the light-sensitive element has the good releasability.

In order to impart the releasability to the overcoat layer or the uppermost photoconductive layer, a polymer containing a silicon atom and/or a fluorine atom is used as a binder resin of the layer. It is preferred to use a small amount of a block copolymer containing a polymer segment comprising a silicon atom and/or fluorine atom-containing polymer component described in detail below (hereinafter referred to as a surface-localized type copolymer sometimes) in combination with other binder resins. Further, such polymers containing a silicon atom and/or a fluorine atom are employed in the form of grains.

In the case of providing an overcoat layer, it is preferred to use the above-described surface-localized type block copolymer together with other binder resins of the layer for maintaining sufficient adhesion between the overcoat layer and the photoconductive layer. The surface-localized type copolymer is ordinarily used together with other binder resins in a proportion of from 0.1 to 20 parts by weight per 100 parts by weight of the total composition of the overcoat layer.

Specific examples of the overcoat layer include a protective layer which is a surface layer provided on the light-sensitive element for protection known as one means for ensuring durability of the surface of a light-sensitive element for a plain paper copier (PPC) using a dry toner against repeated use.

For instance, techniques relating to a protective layer using a silicon type block copolymer are described, for example, in JP-A-61-95358, JP-A-55-83049, JP-A-62-87971, JP-A-61-189559, JP-A-62-75461, JPA-61-139556, JP-A-62-139557, and JP-A-62-208055. Techniques relating to a protective layer using a fluorine type block copolymer are described, for example, in JP-A-61-116362, JP-A-61-117563, JP-A-61-270768, and JP-A-62-14657. Techniques relating to a protecting layer using grains of a resin containing a fluorine-containing polymer component in combination with a binder resin are described in JP-A-63-249152 and JP-A-63-221355.

On the other hand, the method of modifying the surface of the uppermost photoconductive layer so as to exhibit the releasability is effectively applied to a so-called disperse type light-sensitive element which contains at least a photoconductive substance and a binder resin.

Specifically, a layer constituting the uppermost layer of a photoconductive layer is made to contain either one or both of a block copolymer resin comprising a polymer segment containing a fluorine atom and/or silicon atom-containing polymer component as a block and resin grains containing a fluorine atom and/or silicon atom-containing polymer component, whereby the resin material migrates to the surface of the layer and is concentrated and localized there to have the surface imparted with the releasability. The copolymers and resin grains which can be used include those described in JP-A-5-197169.

In order to further ensure surface localization, a block copolymer comprising at least one fluorine atom and/or fluorine atom-containing polymer segment and at least one polymer segment containing a photo- and/or heat-curable group-containing component as blocks can be used as a binder resin for the overcoat layer or the photoconductive layer. Examples of such polymer segments containing a photo- and/or heat-curable group-containing component are described in JP-A-5-197169. Alternatively, a photo- and/or heat-curable resin may be used in combination with the fluorine atom and/or silicon atom-containing resin in the present invention.

The polymer comprising a polymer component containing a fluorine atom and/or a silicon atom effectively used for modifying the surface of the electrophotographic light-sensitive element in the manner as described above to obtain the electrophotographic light-sensitive element having the surface of releasability as well as the electrophotographic light-sensitive element mainly containing amorphous silicon may be in the form of a resin (hereinafter referred to as a resin (P) sometimes) or a resin grain (hereinafter referred to as a resin grain (L) sometimes).

Where the polymer containing a fluorine atom and/or silicon atom-containing polymer component used in the present invention is a random copolymer, the content of the fluorine atom and/or silicon atom-containing polymer component is preferably at least 60% by weight, and more preferably at least 80% by weight based on the total polymer component.

In a preferred embodiment, the above-described polymer is a block copolymer comprising at least one polymer segment ($\alpha$) containing at least 50% by weight of a fluorine atom and/or silicon atom-containing polymer component and at least one polymer segment ($\beta$) containing 0 to 20% by weight of a fluorine atom and/or silicon atom-containing polymer component, the polymer segments ($\alpha$) and ($\beta$) being bonded in the form of blocks. More preferably, the polymer segment ($\beta$) of the block copolymer contains at least one polymer component containing at least one photo- and/or heat-curable functional group.

It is preferred that the polymer segment ($\beta$) of the block copolymer does not contain any fluorine atom and/or silicon atom-containing polymer component.

As compared with the random copolymer, the block copolymer comprising the polymer segments ($\alpha$) and ($\beta$) (surface-localized type copolymer) is more effective not only for improving the surface releasability but also for maintaining such a releasability.

More specifically, where a film is formed in the presence of a small amount of resin (P) and/or resin grains (L) containing a fluorine atom and/or a silicon atom, the resins (P) or resin grains (L) easily migrate to the surface portion of the film and are concentrated there by the end of a drying step of the film to thereby modify the film surface so as to exhibit the releasability.

Where the resin (P) is the block copolymer in which the fluorine atom and/or silicon atom-containing polymer segment exists as a block, the other polymer segment containing no, or if any a small proportion of, fluorine atom and/or silicon atom-containing polymer component undertakes sufficient interaction with the film-forming binder resin since it has good compatibility therewith. Thus, during the formation of the transfer layer on the light-sensitive element, further migration of the resin into the transfer layer is inhibited or prevented by an anchor effect to form and maintain the definite interface between the transfer layer and the light-sensitive element.

Further, where the segment (β) of the block copolymer contains a photo- and/or heat-curable group, crosslinking between the polymer molecules takes place during the film formation to thereby ensure retention of the releasability at the interface between the light-sensitive element and the transfer layer.

The above-described polymer may be used in the form of resin grains as described above. Preferred resin grains (L) are resin grains dispersible in a non-aqueous solvent. Such resin grains are composed of a block copolymer comprising a non-aqueous solvent-insoluble polymer segment which contains a fluorine atom and/or silicon atom-containing polymer component and a non-aqueous solvent-soluble polymer segment which contains no, or if any not more than 20% of, fluorine atom and/or silicon atom-containing polymer component.

Where the resin grains (L) are used in combination with a binder resin, the insolubilized polymer segment undertakes migration and concentration of the grains to the surface portion while the soluble polymer segment exerts an interaction with the binder resin (an anchor effect) similarly to the above-described resin. When the resin grains contain a photo- and/or heat-curable group, further migration of the grains to the transfer layer can be avoided.

The polymer component containing a moiety having a fluorine atom and/or a silicon atom used in the resin (P) and resin grain (L) is the same as the polymer component (F) which may be incorporated into the resin (A) employed in the transfer layer described hereinbefore. The moiety having a fluorine atom and/or a silicon atom includes that incorporated into the main chain of the polymer and that contained as a substituent in the side chain of the polymer.

In the so-called surface-localized type copolymers of the resins (P) and resin grains (L), the content of the silicon atom and/or fluorine atom-containing polymer component present in the segment (α) is at least 50% by weight, preferably at least 70% by weight, and more preferably at least 80% by weight.

Also, the content of the fluorine atom and/or silicon atom-containing polymer component in the segment (β) bonded to the segment (α) is not more than 20% by weight, and preferably 0% by weight.

A weight ratio of segment (α)/segment (β) ranges usually from 1/99 to 95/5, and preferably from 5/95 to 90/10. If the weight ratio is out of this range, the good migration effect and anchor effect of the resin (P) or resin grain (L) at the surface region of light-sensitive element decrease and as a result, the good releasability of transfer layer decreases.

The resin (P) preferably has a weight average molecular weight of from $5\times10^3$ to $1\times10^6$, and more preferably from $1\times10^4$ to $5\times10^5$. The segment (α) in the resin (P) preferably has a weight average molecular weight of at least $1\times10^3$.

The resin grain (L) preferably has an average grain diameter of from 0.001 to 1 μm, and more preferably from 0.05 to 0.5 μm.

A preferred embodiment of the so-called surface-localized type copolymer in the resin (P) will be described below.

Any type of the block copolymer can be used as far as the fluorine atom and/or silicon atom-containing polymer components are contained therein as a block. The term "to be contained as a block" means that the polymer has the polymer segment containing at least 50% by weight of the fluorine atom and/or silicon atom-containing polymer component based on the weight of the polymer segment. The forms of blocks include, for example, an A-B type block, an A-B-A type block, a B-A-B type block, a graft type block, and a starlike type block as described with respect to the resin (A) used in the transfer layer above.

These various types of block copolymers of the resins (P) can be synthesized in accordance with conventionally known polymerization methods. Specifically, methods described for the resin (A) containing the polymer components (F) as a block can be employed.

A preferred embodiment of the resin grains (L) according to the present invention will be described below.

As described above, the resin grains (L) preferably comprise the fluorine atom and/or silicon atom-containing polymer segment (α) insoluble in a non-aqueous solvent and the polymer segment (β) which is soluble in a non-aqueous solvent and contains substantially no fluorine atom and/or silicon atom, and have an average grain diameter of not more than 1 μm. The polymer segment (α) constituting the insoluble portion of the resin grain may have a crosslinked structure.

Preferred methods for synthesizing the resin grains (L) include a non-aqueous dispersion polymerization method described hereinafter with respect to a dispersion of thermoplastic resin grain for an electrodeposition coating method.

The non-aqueous solvents which can be used in the preparation of the non-aqueous solvent-dispersed resin grains include any organic solvents having a boiling point of not more than 200° C., either individually or in combination of two or more thereof.

Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, chchloroethane, tetrachloroethane, chloroform, methylchloroform, dichloropropane and trichloroethane. However, the present invention should not be construed as being limited thereto.

Dispersion polymerization in such a non-aqueous solvent system easily results in the production of mono-dispersed resin grains having an average grain diameter of not greater than 1 μm with a very narrow size distribution.

More specifically, a monomer corresponding to the polymer component constituting the segment (α) (hereinafter referred to as a monomer (a)) and a monomer corresponding to the polymer component constituting the segment (β) (hereinafter referred to as a monomer (b)) are polymerized by heating in a non-aqueous solvent capable of dissolving a monomer (a) but incapable of dissolving the resulting polymer in the presence of a polymerization initiator, for example, a peroxide (e.g., benzoyl peroxide or lauroyl peroxide), an azobis compound (e.g., azobisisobutyronitrile or azobisisovaleronitrile), or an organometallic compound (e.g., butyl lithium). Alternatively, a monomer (a) and a polymer comprising the segment (β) (hereinafter referred to as a polymer (Pβ)) are polymerized in the same manner as described above.

Further, the inside of the resin grain (L) of the present invention may have a crosslinked structure. The formation of crosslinked structure can be conducted by any of conventionally known techniques.

For example, (1) a method wherein a polymer containing the polymer segment (α) is crosslinked in the presence of a crosslinking agent or a curing agent; (2) a method wherein at least the monomer (a) corresponding to the polymer segment (α) is polymerized in the presence of a polyfunctional monomer or oligomer containing at least two polymerizable functional groups to form a network structure over molecules; or (3) a method wherein the polymer segment (α) and a polymer containing a reactive group-containing polymer component are subjected to a polymerization reaction or a polymer reaction to cause crosslinking may be employed.

The crosslinking agents to be used in the method (1) include compounds commonly employed as crosslinking agents as described, e.g., in Shinzo Yamashita and Tosuke Kaneko (ed.), *Kakyozai Handbook*, Taiseisha (1981) and Kobunshi Gakkai (ed.), *Kobunshi Data Handbook (Kisohen)*, Baifukan (1986).

Specific examples of suitable crosslinking agents include organosilane compounds (such as silane coupling agents, e.g., vinyltrimethoxysilane, vinyltributoxysilane, γ-glycidoxypropyltrimethoxysilane, γ-mercaptopropyltriethoxysilane, and γ-aminopropyltriethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, polyoxyalkylene glycols, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), polyepoxy-containing compounds and epoxy resins (e.g., the compounds as described in Hiroshi Kakiuchi (ed.), *Shin-Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)).

Specific examples of the polymerizable functional groups which are contained in the polyfunctional monomer or oligomer (the monomer will sometimes be referred to as a polyfunctional monomer (d)) having two or more polymerizable functional groups used in the method (2) above include $CH_2{=}CH{-}CH_2{-}$, $CH_2{=}CH{-}CO{-}O{-}$, $CH_2{=}CH{-}$, $CH_2{=}C(CH_3){-}CO{-}O{-}$, $CH(CH_3){=}CCH{-}CO{-}O{-}$, $CH_2{=}CH{-}CONH{-}$, $CH_2{=}C(CH_3){-}CONH{-}$, $CH(CH_3){=}CH{-}CONH{-}$, $CH_2{=}CH{-}O{-}CO{-}$, $CH_2{=}C(CH_3){-}O{-}CO{-}$, $CH_2{=}CH{-}CH_2{-}O{-}CO{-}$, $CH_2{=}CH{-}NHCO{-}$, $CH_2{=}CH{-}CH_2{-}NHCO{-}$, $CH_2{=}CH{-}SO_2{-}$, $CH_2{=}CH{-}CO{-}$, $CH_2{=}CH{-}O{-}$, and $CH_2{=}CH{-}S{-}$. The two or more polymerizable functional groups present in the polyfunctional monomer or oligomer may be the same or different.

Specific examples of the monomer or oligomer having the same two or more polymerizable functional groups include styrene derivatives (e.g., divinylbenzene and trivinylbenzene); methacrylic, acrylic or crotonic acid esters, vinyl ethers or allyl ethers of polyhydric alcohols (e.g., ethylene glycol, diethylene glycol, triethylene glycol, polyethylene glycol 200, 400 or 600, 1,3-butylene glycol, neopentyl glycol, dipropylene glycol, polypropylene glycol, trimethylolpropane, trimethylolethane, and pentaerythritol) or polyhydric phenols (e.g., hydroquinone, resorcin, catechol, and derivatives thereof); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-butylenediamine) and vinyl group-containing carboxylic acids (e.g., methacrylic acid, acrylic acid, crotonic acid, and allylacetic acid).

Specific examples of the monomer or oligomer having two or more different polymerizable functional groups include reaction products between vinyl group-containing carboxylic acids (e.g., methacrylic acid, acrylic acid, methacryloylacetic acid, acryloylacetic acid, methacryloylpropionic acid, acryloylpropionic acid, itaconyloylacetic acid, itaconyloylpropionic acid, and a carboxylic acid anhydride) and alcohols or amines, vinyl group-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, vinyloxycarbonylmethyl methacrylate, vinyloxycarbonylmethyloxycarbonylethylene acrylate, N-allylacrylamide, N-allylmethacrylamide, N-allylitaconamide, and methacryloylpropionic acid allylamide) and condensation products between amino alcohols (e.g., aminoethanol, 1-aminopropanol, 1-aminobutanol, 1-aminohexanol, and 2-aminobutanol) and vinyl group-containing carboxylic acids.

The monomer or oligomer containing two or more polymerizable functional groups is used in an amount of not more than 10 mol %, and preferably not more than 5 mol %, based on the total amount of monomer (a) and other monomers copolymerizable with monomer (a) to form the resin.

Where crosslinking between polymer molecules is conducted by the formation of chemical bonds upon the reaction of reactive groups in the polymers according to the method (3), the reaction may be effected in the same manner as usual reactions of organic low-molecular weight compounds.

From the standpoint of obtaining mono-dispersed resin grains having a narrow size distribution and easily obtaining fine resin grains having a diameter of 0.5 μm or smaller, the method (2) using a polyfunctional monomer is preferred for the formation of network structure in the dispersion polymerization. Specifically, a monomer (a), a monomer (b) and/or a polymer (Pβ) and, in addition, a polyfunctional monomer (d) are subjected to polymerization granulation reaction to obtain resin grains. Where the above-described polymer (Pβ) comprising the segment (β) is used, it is preferable to use a polymer (Pβ') which has a polymerizable double bond group copolymerizable with the monomer (a) in the side chain or at one terminal of the main chain of the polymer (Pβ).

The polymerizable double bond group is not particularly limited as far as it is copolymerizable with the monomer (a). Specific examples thereof include $$CH_2{=}\overset{\overset{p}{|}}{C}{-}COO{-},\quad C(CH_3)H{=}CH{-}COO{-},$$

$$CH_2{=}C(CH_2COOH){-}COO{-},\quad CH_2{=}\overset{\overset{p}{|}}{C}{-}CONH{-},$$

$$CH_2{=}\overset{\overset{p}{|}}{C}{-}CONHCOO{-},\quad CH_2{=}\overset{\overset{p}{|}}{C}{-}CONHCONH{-},$$

$C(CH_3)H{=}CH{-}CONH{-}$, $CH_2{=}CHCO{-}$, $CH_2{=}CH(CH_2)_n{-}OCO{-}$, $CH_2{=}CHO{-}$, and $CH_2{=}CH{-}C_6H_4{-}$, wherein p represents —H or —$CH_3$, and n represents 0 or an integer of from 1 to 3.

The polymerizable double bond group may be bonded to the polymer chain either directly or via a divalent organic residue. Specific examples of these polymers include those described, for example, in JP-A-61-43757, JP-A-1-257969, JP-A-2-74956, JP-A-1-282566, JP-A-2-173667, JP-A-3-15862, and JP-A-4-70669.

In the preparation of resin grains, the total amount of the polymerizable compounds used is from about 5 to about 80 parts by weight, preferably from 10 to 50 parts by weight, per 100 parts by weight of the non-aqueous solvent. The polymerization initiator is usually used in an amount of from 0.1 to 5% by weight based on the total amount of the polymerizable compounds. The polymerization is carried out at a temperature of from about 30° to about 180° C., and preferably from 40° to 120° C. The reaction time is preferably from 1 to 15 hours.

Now, an embodiment in which the resin (P) contains a photo- and/or heat-curable group or the resin (P) is used in combination with a photo- and/or heat-curable resin will be described below.

The polymer components containing at least one photo- and/or heat-curable group, which may be incorporated into the resin (P), include those described in the above-cited literature references. More specifically, the polymer components containing the above-described polymerizable functional group(s) can be used.

The content of the polymer component containing at least one photo- and/or heat-curable group in the block copolymer (P) ranges from 0.1 to 40 parts by weight, and preferably from 1 to 30 parts by weight, based on 100 parts by weight of the polymer segment (β) therein.

If the content is less than the lower limit, curing of the photoconductive layer after film formation does not proceed sufficiently, and the improvement in releasability of transfer layer is not obtained since good retention of the interface between the transfer layer and the surface of light-sensitive element is not achieved. On the other hand, when the content exceeds the upper limit, the good electrophotographic characteristics of the photoconductive layer are deteriorated, sometimes resulting in reduction in reproducibility of original in duplicated images and occurrence of background fog in non-image areas.

The photo- and/or heat-curable group-containing block copolymer (P) is preferably used in an amount of more than 40% by weight based on the total binder resin. If the proportion of the block copolymer (P) is less than 40% by weight, the good electrophotographic characteristics of the light-sensitive element tend to be deteriorated.

The fluorine atom and/or silicon atom-containing resin may also be used in combination with the photo- and/or heat-curable resin (D) in the present invention. The photo- and/or heat-curable group included in the resin (D) is not particularly limited and includes those described above with respect to the block copolymer.

Any of conventionally known curable resins may be used as the photo- and/or heat-curable resin (D). For example, resins containing the curable group as described with respect to the block copolymer (P) according to the present invention may be used.

Further, conventionally known binder resins for an electrophotographic light-sensitive layer are employed. These resins are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kiroku Zairyoyo Binder no Jissai Gijutsu*, Ch. 10, C.M.C. (1985), Denshishashin Gakkai (ed.), *Denshishashinyo Yukikankotai no Genjo Symposium* (preprint) (1985), Hiroshi Kokado (ed.), *Saikin no Kododenzairyo to Kankotai no Kaihatsu.Jitsuvoka*, Nippon Kagaku Joho (1986), Denshishashin Gakkai (ed.), *Denshishashin Gijutsu no Kiso To Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshishashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-(dioxetane rings), and epoxy resins.

More specifically, reference can be made to Tsuyoshi Endo, *Netsukokasei Kobunshi no Seimitsuka*, C. M. C. (1986), Yuji Harasaki, *Saishin Binder Gijutsu Binran*, Ch. II-1, Sogo Gijutsu Center (1985), Takayuki Otsu, *Acryl Jushi no Gosei.Sekkei to Shinyoto Kaihatsu*, Chubu Kei-ei Kaihatsu Center Shuppanbu (1985), and Eizo Omori, *Kinosei Acryl-Kei Jushi*, Techno System (1985).

As described above, when the uppermost layer of light-sensitive element, for example, the overcoat layer or the photoconductive layer contains at least one binder resin (B) and at least one block copolymer (P) for modifying the surface thereof, it is preferred that the layer further contains a small amount of photo- and/or heat-curable resin (D) and/or a crosslinking agent for further improving film curability.

The amount of photo- and/or heat-curable resin (D) and/or crosslinking agent to be added is from 0.01 to 20% by weight, and preferably from 0.1 to 15% by weight, based on the total amount of the binder resin (B) and the block copolymer (P). If the amount is less than 0.01% by weight, the effect of improving film curability decreases. If, on the other hand, it exceeds 20% by weight, the electrophotographic characteristics may be adversely affected.

A combined use of a crosslinking agent is preferable. Any of ordinarily employed crosslinking agents may be utilized. Suitable crosslinking agents are described, e.g., in Shinzo Yamashita and Tosuke Kaneko (ed.), *Kakyozai Handbook*, Taiseisha (1981) and Kobunshi Gakkai (ed.), *Kobunshi Data Handbook* (*Kisohen*), Baifukan (1986).

Specific examples of suitable crosslinking agents include organosilane compounds (such as silane coupling agents, e.g., vinyltrimethoxysilane, vinyltributoxysilane, γ-glycidoxypropyltrimethoxysilane, γ-mercaptopropyltriethoxysilane, and γ-aminopropylethoxysilane), polyisocyanate compounds (e.g., toluylene diisocyanate, diphenylmethane diisocyanate, triphenylmethane triisocyanate, polymethylenepolyphenyl isocyanate, hexamethylene diisocyanate, isophorone diisocyanate, and polymeric polyisocyanates), polyol compounds (e.g., 1,4-butanediol, polyoxypropylene glycol, a polyoxyethylene glycol, and 1,1,1-trimethylolpropane), polyamine compounds (e.g., ethylenediamine, γ-hydroxypropylated ethylenediamine, phenylenediamine, hexamethylenediamine, N-aminoethylpiperazine, and modified aliphatic polyamines), titanate coupling compounds (e.g., titanium tetrabutoxide, titanium tetrapropoxide, and isopropyltristearoyl titanate), aluminum coupling compounds (e.g., aluminum butylate, aluminum acetylacetate, aluminum oxide octate, and aluminum trisacetylacetate), polyepoxy-containing compounds and epoxy resins (e.g., the compounds as described in Hiroshi Kakiuchi (ed.), *Epoxy Jushi*, Shokodo (1985) and Kuniyuki Hashimoto (ed.), *Epoxy Jushi*, Nikkan Kogyo Shinbunsha (1969)), melamine resins (e.g., the compounds as described in Ichiro Miwa and Hideo Matsunaga (ed.), *Urea.Melamine Jushi*, Nikkan Kogyo Shinbunsha (1969)), and poly(meth)acrylate compounds (e.g., the compounds as described in Shin Okawara, Takeo Saegusa, and Toshinobu Higashimura (ed.), *Oligomer*, Kodansha (1976), and Eizo Omori, *Kinosei Acryl-kei Jushi*, Techno System (1985)). In addition, monomers containing a polyfunctional polymerizable group (e.g., vinyl methacrylate, acryl methacrylate, ethylene glycol diacrylate, polyethylene glycol diacrylate, divinyl succinate, divinyl adipate, diacryl succinate, 2-methylyinyl methacrylate, trimethylolpropane trimethacrylate, divinylbenzene, and pentaerythritol polyacrylate) may also be used as the crosslinking agent.

As described above, the uppermost layer of the photoconductive layer (a layer which will be in contact with the transfer layer 12) is preferably cured after film formation. It is preferred that the binder resin (B), the block copolymer (P), the curable resin (D), and the crosslinking agent to be used in the photoconductive layer are so selected and combined that their functional groups easily undergo chemical bonding to each other.

Combinations of functional groups which easily undergo a polymer reaction are well known. Specific examples of such combinations are shown in Table 1 below, wherein a functional group selected from Group A can be combined with a functional group selected from Group B. However, the present invention should not be construed as being limited thereto.

TABLE 1

| Group A | Group B |
|---|---|
| —COOH, | 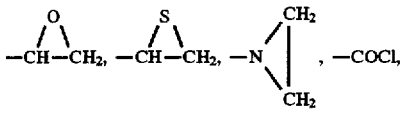 |
| $-PO_3H_2$, —OH, —SH, $-NH_2$, —NHR, $-SO_2H$ | $-SO_2Cl$, a cyclic acid anhydride group, —N=C=O, —N=C=S, |
| | 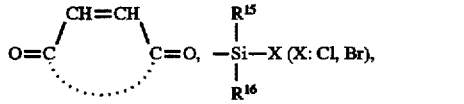 |
| | 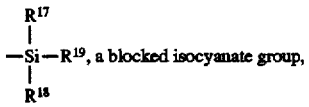 |
| | 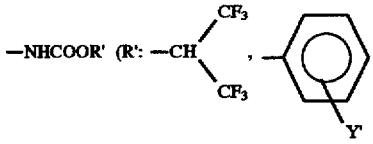 |
| | (Y': $-CH_3$, —Cl, $-OCH_3$)), |
| | 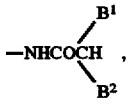 |
| | 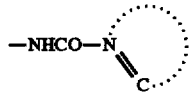 (e.g., an imidazole ring) |

In Table 1, $R^{15}$ and $R^{16}$ each represents an alkyl group; $R^{17}$, $R^{18}$, and $R^{19}$ each represents an alkyl group or an alkoxy group, provided that at least one of them is an alkoxy group; R represents a hydrocarbon group; $B^1$ and $B^2$ each represents an electron attracting group, e.g., —CN, $-CF_3$, $-COR^{20}$, $-COOR^{20}$, $-SO_2OR^{20}$ ($R^{20}$ represents a hydrocarbon group, e.g., $-C_nH_{2n+1}$ (n: an integer of from 1 to 4), $-CH_2C_6H_5$, or $-C_6H_5$).

If desired, a reaction accelerator may be added to the binder resin for accelerating the crosslinking reaction in the light-sensitive layer.

The reaction accelerators which may be used for the crosslinking reaction forming a chemical bond between functional groups include organic acids (e.g., acetic acid, propionic acid, butyric acid, benzenesulfonic acid, and p-toluenesulfonic acid), phenols (e.g., phenol, chlorophenol, nitrophenol, cyanophenol, bromophenol, naphthol, and dichlorophenol), organometallic compounds (e.g., zirconium acetylacetonate, zirconium acetylacetone, cobalt acetylacetonate, and dibutoxytin dilaurate), dithiocarbamic acid compounds (e.g., diethyldithiocarbamic acid salts), thiuram disulfide compounds (e.g., tetramethylthiuram disulfide), and carboxylic acid anhydrides (e.g., phthalic anhydride, maleic anhydride, succinic anhydride, butylsuccinic anhydride, benzophenone-3,3',4,4'-tetracarboxylic acid dianhydride, and trimellitic anhydride). The reaction accelerators which may be used for the crosslinking reaction involving polymerization include polymerization initiators, such as peroxides and azobis compounds.

After a coating composition for the light-sensitive layer is coated, the binder resin is cured by light and/or heat. Heat curing can be carried out by drying under severer conditions than those for the production of a conventional light-sensitive element. For example, elevating the drying temperature and/or increasing the drying time may be utilized. After drying the solvent of the coating composition, the film is preferably subjected to a further heat treatment, for example, at 60° to 150° C. for 5 to 120 minutes. The conditions of the heat treatment may be made milder by using the above-described reaction accelerator in combination.

Curing of the resin containing a photocurable functional group can be carried out by incorporating a step of irradiation of actinic ray into the production line in the present invention. The actinic rays to be used include visible light, ultraviolet light, far ultraviolet light, electron beam, X-ray, γ-ray, and α-ray, with ultraviolet light being preferred. Actinic having a wavelength range of from 310 to 500 nm are more preferred. In general, a low-, high- or ultrahigh-pressure mercury lamp or a halogen lamp is employed as a light source. Usually, the irradiation treatment can be sufficiently performed at a distance of from 5 to 50 cm for 10 seconds to 10 minutes.

Now, the second method for obtaining an electrophotographic light-sensitive element 11 having the surface of releasability by adsorbing or adhering the compound (S) for imparting the desired releasability onto the surface of a conventional electrophotographic light-sensitive element 11 before the formation of the transfer layer 12 will be described in detail below.

The compound (S) for imparting releasability is a compound containing at least a fluorine and/or silicon atom and is not particularly limited in its structure as far as it can improve releasability of the surface of electrophotographic light-sensitive element, and includes a low molecular weight compound, an oligomer, and a polymer.

When the compound (S) is an oligomer or a polymer, the moiety having a fluorine and/or silicon atom includes that incorporated into the main chain of the oligomer or polymer and that contained as a substituent in the side chain thereof. Of the oligomers and polymers, those containing repeating units containing the moiety having a fluorine and/or silicon atom as a block are preferred since they advantageously adsorb on the surface of electrophotographic light-sensitive element to impart good releasability.

The fluorine atom and/or silicon atom-containing moieties include those described with respect to the resin (A) used in the transfer layer above.

Specific examples of the compound (S) containing a fluorine atom and/or a silicon atom which can be used in the present invention include fluorine and/or silicon-containing organic compounds described, for example, in Tokiyuki Yoshida, et al. (ed.), *Shin-ban Kaimenkasseizai Handbook*, Kogaku Tosho (1987), Takao Karikome, *Saishin Kaimenkasseizai Oyo Gijutsu*, C. M. C. (1990), Kunio Ito (ed.), *Silicone Handbook*, Nikkan Kogyo Shinbunsha (1990), Takao Karikome, Tokushukino *Kaimenkasseizai*, C. M. C. (1986), and A. M. Schwartz, et al., *Surface Active Agents and Detergents*, Vol. II.

Further, the compound (S) according to the present invention can be synthesized by utilizing synthesis methods as described, for example, in Nobuo Ishikawa, *Fussokagobutsu no Gosei to Kino*, C. M. C. (1987), Jiro Hirano et al. (ed.), *Ganfussoyukikagobutsu— Sono Gosei to Oyo*, Gijutsu Joho Kokai (1991), and Mitsuo Ishikawa, *Yukikeiso Senryaku Shiryo*, Chapter 3, Science Forum (1991).

Specific examples of polymer components having the fluorine atom and/or silicon atom-containing moiety used in the oligomer or polymer include the polymer components (F) described with respect to the resin (A) above. However, the present invention should not be construed as being limited thereto.

When the compound (S) according to the present invention is a so-called block copolymer, the compound (S) may be any type of copolymer as far as it contains the fluorine atom and/or silicon atom-containing polymer components as a block. The term "to be contained as a block" means that the compound (S) has a polymer segment comprising at least 70% by weight of the fluorine atom and/or silicon atom-containing polymer component based on the weight of the polymer segment. The forms of blocks include an A-B type block, an A-B-A type block, a B-A-B type block, a graft type block, and a starlike type block as schematically illustrated with respect to the resin (A) above. These block copolymers can be synthesized according to the methods described with respect to the resin (A) above.

In order to cause the compound (S) to adsorb or adhere to the surface of electrophotographic light-sensitive element 11, conventionally known various methods can be employed. Methods which can be appropriately applied to the apparatus used in the present invention are preferred.

For example, methods using an air doctor coater, a blade coater, a knife coater, a squeeze coater, a dip coater, a reverse roll coater, a transfer roll coater, a gravure coater, a kiss roll coater, a spray coater, a curtain coater, or a calender coater as described, for example, in Yuji Harasaki, *Coating Kogaku*, Asakura Shoten (1971), Yuji Harasaki, *Coating Hoshiki*, Maki Shoten (1979), and Hiroshi Fukada, *Hot-melt Secchaku no Jissai* Kobunshi Kankokai (1979) can be used.

A method wherein cloth, paper or felt impregnated with the compound (S) is pressed on the light-sensitive element 11, a method of pressing a curable resin impregnated with the compound (S) on the light-sensitive element 11, a method wherein the light-sensitive element 11 is wetted with a non-aqueous solvent containing the compound (S) dissolved therein, and then dried to remove the solvent, and a method wherein the compound (S) dispersed in a non-aqueous solvent is migrated and adhered on the light-sensitive element 11 by electrophoresis according to a wet-type electrodeposition method as described hereinafter can also be employed.

Further, the compound (S) can be applied on the surface of light-sensitive element 11 by utilizing a non-aqueous solvent containing the compound (S) according to an ink jet method, followed by drying. The ink jet method can be performed with reference to the descriptions in Shin Ohno (ed.), *Non-impact Printing*, C. M. C. (1986).

More specifically, a Sweet process or Hartz process of a continuous jet type, a Winston process of an intermittent jet type, a pulse jet process of an ink on-demand type, a bubble jet process, and a mist process of an ink mist type are illustrated.

In any system, the compound (S) itself or diluted with a solvent is filled in an ink tank or ink head cartridge in place of an ink to use. The solution of compound (S) used ordinarily has a viscosity of from 1 to 10 cp and a surface tension of from 30 to 60 dyne/cm, and may contain a surface active agent, or may be heated if desired. Although a diameter of ink droplet is in a range of from 30 to 100 μm due to a diameter of an orifice of head in a conventional ink jet printer in order to reproduce fine letters, droplets of a larger diameter can also be used in the present invention. In such a case, an amount of jet of the compound (S) becomes large and thus a time necessary for the application can be shortened. Further, to use multiple nozzles is very effective to shorten the time for application.

When silicone rubber is used as the compound (S), it is preferred that silicone rubber is provided on a metal axis to cover and the resulting silicone rubber roller is directly pressed on the surface of electrophotographic light-sensitive element 11. In such a case, a nip pressure is ordinarily in a range of from 0.5 to 10 Kgf/cm$^2$ and a time for contact is ordinarily in a range of from 1 second to 30 minutes. Also, the light-sensitive element and/or silicone rubber roller may be heated up to a temperature of 150° C. According to this method, it is believed that a part of low molecular weight components contained in silicone rubber is moved from the silicone rubber roller onto the surface of light-sensitive element 11 during the press. The silicone rubber may be swollen with silicone oil. Moreover, the silicone rubber may be a form of sponge and the sponge roller may be impregnated with silicone oil or a solution of silicone surface active agent.

The application method of the compound (S) is not particularly limited, and an appropriate method can be selected depending on a state (i.e., liquid, wax or solid) of the compound (S) used. A flowability of the compound (S) can be controller using a heat medium, if desired.

In accordance with the present invention, the surface of electrophotographic light-sensitive element 11 is provided with the desired releasability by the adsorption or adhesion of the compound (S) thereto, and preferably exhibits the adhesive strength of not more than 100 g·f before the formation of transfer layer 12. The step for the application of compound (S) is not always necessary to conduct in a series of the steps for the formation of a color image according to the present invention. The application may be suitably performed by an appropriate combination of a light-sensitive element 11, an ability of a compound (S) for imparting the releasability and a means for the application.

An amount of the compound (S) adsorbed or adhered to the surface of electrophotographic light-sensitive element 11 is not particularly limited and is adjusted in a range wherein the electrophotographic characteristics of light-sensitive element 11 do not adversely affected in substance. Ordinarily, a thickness of the coating is sufficiently 1 μm or less. By the formation of weak boundary layer as defined in Bikerman, *The Science of Adhesive Joints*, Academic Press (1961), the releasability-imparting effect of the present invention can be obtained.

Furthermore, the third method for obtaining an electrophotographic light-sensitive element 11 having a surface of releasability is a method of conducting the impartation of releasability to the light-sensitive element 11 simultaneously with the formation of transfer layer 12 on the light-sensitive element by incorporating a compound (S) for imparting the releasability into a dispersion for electrodeposition used for the formation of transfer layer 12 on the light-sensitive element 11 according to the electrodeposition coating method.

Specifically, the peelable transfer layer 12 is formed by means of electrodeposition or adhesion of resin grains (AR) by electrophoresis on the surface of electrophotographic light-sensitive element 11 to form a film using a dispersion for electrodeposition comprising resin grains (AR) having a glass transition point of not more than 140° C. or a softening point of not more than 180° C. dispersed in an electrically insulating organic solvent having a dielectric constant of not more than 3.5 and at least one compound (S) which has a fluorine atom and/or a silicon atom and is soluble at least 0.01 g per 1.0 liter of the organic solvent.

The compound (S) for imparting releasability contained in the dispersion for electrodeposition forming the transfer layer tends to adsorb or adhere onto the surface of light-sensitive element 11 before the electrodeposition or adhesion of dispersed resin grains (AR) by electrophoresis on the surface of light-sensitive element 11, the light-sensitive element 11 having the releasability is consequently obtained at the formation of transfer layer 12. The method will be described in more detail hereinafter.

The composition and material for the electrophotographic light-sensitive element 11 which can be used in the present invention are not particularly limited, and any of those conventionally known may be employed.

Suitable examples of electrophotographic light-sensitive element used are described, for example, in R. M. Schaffert, *Electrophotography*, Forcal Press, London (1980), S. W. Ing, M. D. Tabak and W. E. Haas, *Electrophotography Fourth International Conference*, SPSE (1983), Isao Shinohara, Hidetoshi Tsuchida and Hideaki Kusakawa (ed.), *Kirokuzairyo to Kankoseijushi*, Gakkai Shuppan Center (1979), Hiroshi Kokado, *Kagaku to Kogyo*, Vol. 39, No. 3, p. 161 (1986), *Saikin no Kododen Zairyo to Kankotai no Kaihatsu.Jitsuvoka*, Nippon Kagaku Joho Shuppanbu (1986), Denshishashin Gakkai (ed.), *Denshishashin no Kiso to Oyo*, Corona (1986), and Denshishashin Gakkai (ed.), *Denshishashinyo Yukikankotai no Genjo Symposium* (preprint), (1985). Specifically, the photoconductive layer includes a single layer made of a photoconductive compound itself and a photoconductive layer comprising a binder resin having dispersed therein a photoconductive compound. The dispersed type photoconductive layer may have a single layer structure or a laminated structure.

The photoconductive compounds used in the present invention may be inorganic compounds or organic compounds.

Inorganic photoconductive compounds used in the present invention include those conventionally known for example, zinc oxide, titanium oxide, zinc sulfide, cadmium sulfide, selenium, selenium-tellurium, silicon, lead sulfide. These compounds are used together with a binder resin to form a photoconductive layer, or they are used alone to form a photoconductive layer by vacuum deposition or spattering.

Where an inorganic photoconductive compound, e.g., zinc oxide or titanium oxide, is used, a binder resin is usually used in an amount of from 10 to 100 parts by weight, and preferably from 15 to 40 parts by weight, per 100 parts by weight of the inorganic photoconductive compound.

As photoconductive layers using organic compounds, on the other hand, any of those conventionally known may be employed. Suitable photoconductive layers containing an organic photoconductive compound include a photoconductive layer mainly comprising an organic photoconductive compound, a sensitizing dye, and a binder resin as described, e.g., in JP-B-37-17162, JP-B-62-51462, JP-A-52-2437, JP-A-54-19803, JP-A-56-107246, and JP-A-57-161863; a layer mainly comprising a charge generating agent, a charge transporting agent, and a binder resin as described, e.g., in JP-A-56-146145, JP-A-60-17751, JP-A-60-17752, JP-A-60-17760, JP-A-60-254142, and JP-A-62-54266; and a double-layered structure containing a charge generating agent and a charge transporting agent in separate layers as described, e.g., in JP-A-60-230147, JP-A-60-230148, and JP-A-60-238853.

The photoconductive layer of the electrophotographic light-sensitive element according to the present invention may have any of the above-described embodiments.

The organic photoconductive compounds which may be used in the present invention include (a) triazole derivatives described, e.g., in U.S. Pat. No. 3,112,197, (b) oxadiazole derivatives described, e.g., in U.S. Pat. No. 3,189,447, (c) imidazole derivatives described in JP-B-37-16096, (d) polyarylalkane derivatives described, e.g., in U.S. Pat. Nos. 3,615,402, 3,820,989, and 3,542,544, JP-B-45-555, JP-B-51-10983, JP-A-51-93224, JP-A-55-108667, JP-A-55-156953, and JP-A-56-36656, (e) pyrazoline derivatives and pyrazolone derivatives described, e.g., in U.S. Pat. Nos. 3,180,729 and 4,278,746, JP-A-55-88064, JP-A-55-88065, JP-A-49-105537, JP-A-55-51086, JP-A-56-80051, JP-A-56-88141, JP-A-57-45545, JP-A-54-112637, and JP-A-55-74546, (f) phenylenediamine derivatives described, e.g., in U.S. Pat. No. 3,615,404, JP-B-51-10105, JP-B-46-3712, JP-B-47-28336, JP-A-54-83435, JP-A-54-110836, and JP-A-54-119925, (g) arylamine derivatives described, e.g., in U.S. Pat. Nos. 3,567,450, 3,180,703, 3,240,597, 3,658,520, 4,232,103, 4,175,961, and 4,012,376, JP-B-49-35702, West German Patent (DAS) 1,110,518, JP-B-39-27577, JP-A-55-144250, JP-A-56-119132, and JP-A-56-22437, (h) amino-substituted chalcone derivatives described, e.g., in U.S. Pat. No. 3,526,501, (i) N,N-bicarbazyl derivatives described, e.g., in U.S. Pat. No. 3,542,546, (j) oxazole derivatives described, e.g., in U.S. Pat. No. 3,257,203, (k) styrylanthracene derivatives described, e.g., in JP-A-56-9346234, (l) fluorenone derivatives described, e.g., in JP-A-54-110837, (m) hydrazone derivatives described, e.g., in U.S. Pat. No. 3,717,462, JP-A-54-59143 (corresponding to U.S. Pat. No. 4,150,987), JP-A-55-52063, JP-A55-52064, JP-A-55-46760, JP-A-55-85495, JP-A-57-11350, JP-A-57-148749, and JP-A-57-104144, (n) benzidine derivatives described, e.g., in U.S. Pat. Nos. 4,047,948, 4,047,949, 4,265,990, 4,273,846, 4,299,897, and 4,306,008, (o) stilbene derivatives described, e.g., in JP-A-58-190953, JP-A-59-95540, JP-A-59-97148, JP-A-59-195658, and JP-A-62-36674, (p) polyvinylcarbazole and derivatives thereof described in JP-B-34-10966, (q) vinyl polymers, such as polyvinylpyrene, polyvinylanthracene, poly-2-vinyl-4-(4'-dimethylaminophenyl)-5-phenyloxazole, and poly-3-vinyl-N-ethylcarbazole, described in JP-B-43-18674 and JP-B-43-19192, (r) polymers, such as polyacenaphthylene, polyindene, and an acenaphthylene-styrene copolymer, described in JP-B-43-19193, (s) condensed resins, such as pyrene-formaldehyde resin, bromopyrene-formaldehyde resin, and ethylcarbazole-formaldehyde resin, described, e.g., in JP-B-56-13940, and (t) triphenylmethane polymers described in JP-A-56-90833 and JP-A-56-161550.

The organic photoconductive compounds which can be used in the present invention are not limited to the above-described compounds (a) to (t), and any of known organic photoconductive compounds may be employed in the present invention. The organic photoconductive compounds may be used either individually or in combination of two or more thereof.

The sensitizing dyes which can be used in the photoconductive layer include those conventionally known as described, e.g., in *Denshishashin*, Vol. 12, p. 9 (1973) and *Yuki Gosei Kagaku*, Vol. 24, No. 11, p. 1010 (1966). Specific examples of suitable sensitizing dyes include pyrylium dyes described, e.g., in U.S. Pat. Nos. 3,141,770 and 4,283,475, JP-A-48-25658, and JP-A-62-71965; triarylmethane dyes described, e.g., in *Applied Optics Supplement*, Vol. 3, p. 50 (1969) and JP-A-50-39548; cyanine dyes described, e.g., in U.S. Pat. No. 3,597,196; and styryl dyes described, e.g., in JP-A-60-163047, JP-A-59-164588, and JP-A-60-252517.

The charge generating agents which can be used in the photoconductive layer include various conventionally known charge generating agents, either organic or inorganic, for example, selenium, selenium-tellurium, cadmium sulfide, zinc oxide, and organic pigments, for example, (1) azo pigments (including monoazo, bisazo, and trisazo pigments) described, e.g., in U.S. Pat. Nos. 4,436,800 and 4,439,506, JP-A-47-37543, JP-A-58-123541, JP-A-58-192042, JP-A-58-219263, JP-A-59-78356, JP-A-60-179746, JP-A-61-148453, JP-A-61-238063, JP-B-60-5941, and JP-B-60-45664, (2) metal-free or metallized phthalocyanine pigments described, e.g., in U.S. Pat. Nos. 3,397,086 and 4,666,802, JP-A-51-90827, and JP-A-52-55643, (3) perylene pigments described, e.g., in U.S. Pat. No. 3,371,884 and JP-A-47-30330, (4) indigo or thioindigo derivatives described, e.g., in British Patent 2,237,680 and JP-A-47-30331, (5) quinacridone pigments described, e.g., in British Patent 2,237,679 and JP-A-47-30332, (6) polycyclic quinone dyes described, e.g., in British Patent 2,237,678, JP-A-59-184348, JP-A-62-28738, and JP-A-47-18544, (7) bisbenzimidazole pigments described, e.g., in JP-A-47-30331 and JP-A-47-18543, (8) squarylium salt pigments described, e.g., in U.S. Pat. Nos. 4,396,610 and 4,644,082, and (9) azulenium salt pigments described, e.g., in JP-A-59-53850 and JP-A-61-212542. These organic pigments may be used either individually or in combination of two or more thereof.

With respect to a mixing ratio of the organic photoconductive compound and a binder resin, particularly the upper limit of the organic photoconductive compound is determined depending on the compatibility between these materials. The organic photoconductive compound, if added in an amount over the upper limit, may undergo undesirable crystallization. The lower the content of the organic photoconductive compound, the lower the electrophotographic sensitivity. Accordingly, it is desirable to use the organic photoconductive compound in an amount as much as possible within such a range that crystallization does not occur. In general, 5 to 120 parts by weight, and preferably from 10 to 100 parts by weight, of the organic photoconductive compound is used per 100 parts by weight of the total binder resins. The organic photoconductive compounds may be used either individually or in combination of two or more thereof.

The binder resins (B) which can be used in the light-sensitive element 11 according to the present invention include those for conventionally known electrophotographic light-sensitive elements. A weight average molecular weight of the binder resin is preferably from $5\times10^3$ to $1\times10^6$, and more preferably from $2\times10^4$ to $5\times10^5$. A glass transition point of the binder resin is preferably from −40° to +200° C., and more preferably from −10° to +140° C. Binder resins which may be used in the present invention are described, e.g., in Takaharu Shibata and Jiro Ishiwatari, *Kobunshi*, Vol. 17, p. 278 (1968), Harumi Miyamoto and Hidehiko Takei, *Imaging*, Vol. 1973, No. 8, Koichi Nakamura (ed.), *Kiroku Zairyoyo Binder no Jissai Gijutsu*, Ch. 10, C. M. C. (1985), Denshishashin Gakkai (ed.), *Denshishashinyo Yukikankotai no Genjo Symposium* (preprint) (1985), Hiroshi Kokado (ed.), *Saikin no Kododen Zairyo to Kankotai no Kaihatsu.Jitsuyoka*, Nippon Kagaku Joho (1986), Denshishashin Gakkai (ed.), *Denshishashin Gijutsu no Kiso to Oyo*, Ch. 5, Corona (1988), D. Tatt and S. C. Heidecker, *Tappi*, Vol. 49, No. 10, p. 439 (1966), E. S. Baltazzi and R. G. Blanchlotte, et al., *Photo. Sci. Eng.*, Vol. 16, No. 5, p. 354 (1972), and Nguyen Chank Keh, Isamu Shimizu and Eiichi Inoue, *Denshi Shashin Gakkaishi*, Vol. 18, No. 2, p. 22 (1980).

Specific examples of these known binder resins used include olefin polymers or copolymers, vinyl chloride copolymers, vinylidene chloride copolymers, vinyl alkanoate polymers or copolymers, allyl alkanoate polymers or copolymers, polymers or copolymers of styrene or derivatives thereof, butadiene-styrene copolymers, isoprene-styrene copolymers, butadiene-unsaturated carboxylic ester copolymers, acrylonitrile copolymers, methacrylonitrile copolymers, alkyl vinyl ether copolymers, acrylic ester polymers or copolymers, methacrylic ester polymers or copolymers, styrene-acrylic ester copolymers, styrene-methacrylic ester copolymers, itaconic diester polymers or copolymers, maleic anhydride copolymers, acrylamide copolymers, methacrylamide copolymers, hydroxy group-modified silicone resins, polycarbonate resins, ketone resins, polyester resins, silicone resins, amide resins, hydroxy group- or carboxy group-modified polyester resins, butyral resins, polyvinyl acetal resins, cyclized rubber-methacrylic ester copolymers, cyclized rubber-acrylic ester copolymers, copolymers containing a heterocyclic ring containing no nitrogen atom (the heterocyclic ring including furan, tetrahydrofuran, thiophene, dioxane, dioxofuran, lactone, benzofuran, benzothiophene and 1,3-dioxetane rings), and epoxy resins.

Further, the electrostatic characteristics of the photoconductive layer are improved by using, as a binder resin (B) for a photoconductive substance, a resin having a relatively low molecular weight (e.g., a weight average molecular weight of from $10^3$ to $10^4$) and containing an acidic group such as a carboxy group, a sulfo group or a phosphono group. For instance, JP-A-63-217354 discloses a resin having polymer components containing an acidic group at random in the polymer main chain, JP-A-64-70761 discloses a resin having an acidic group bonded at one terminal of the polymer main chain, JP-A-2-67563, JP-A-2-236561, JP-A-2-238458, JP-A-2-236562 and JP-A-2-247656 disclose a resin of graft type copolymer having an acidic group bonded at one terminal of the polymer main chain or a resin of graft type copolymer containing acidic groups in the graft portion, and JP-A-3-181948 discloses an AB block copolymer containing acidic groups as a block.

Moreover, in order to obtain a satisfactorily high mechanical strength of the photoconductive layer which may be insufficient by only using the low molecular weight resin, a medium to high molecular weight resin is preferably used together with the low molecular weight resin. For instance, JP-A-2-68561 discloses a thermosetting resin capable of forming crosslinked structures between polymers, JP-A-2-68562 discloses a resin partially having crosslinked structures, and JP-A-2-69759 discloses a resin of graft type copolymer having an acidic group bonded at one terminal of the polymer main chain. Also, in order to maintain the relatively stable performance even when ambient conditions are widely fluctuated, a specific medium to high molecular weight resin is employed in combination. For instance, JP-A-3-29954, JP-A-3-77954, JP-A-3-92861 and JP-A-3-53257 disclose a resin of graft type copolymer having an acidic group bonded at the terminal of the graft portion or a resin of graft type copolymer containing acidic groups in the graft portion. Moreover, JP-A-3-206464 and JP-A-3-223762 discloses a graft type copolymer having a graft portion formed from an AB block copolymer comprising an A block containing acidic groups and a B block containing no acidic group.

In a case of using these resins, the photoconductive substance is uniformly dispersed to form a photoconductive layer having good smoothness. Also, excellent electrostatic characteristics can be maintained even when ambient conditions are fluctuated or when a scanning exposure system using a semiconductor laser beam is utilized for the image exposure.

The photoconductive layer usually has a thickness of from 1 to 100 μm, and preferably from 10 to 50 μm.

Where a photoconductive layer functions as a charge generating layer of a laminated type light-sensitive element composed of a charge generating layer and a charge transporting layer, the charge generating layer has a thickness of from 0.01 to 5 μm, and preferably from 0.05 to 2 μm.

Depending on the kind of a light source for exposure, for example, visible light or semiconductor laser beam, various dyes may be used as spectral sensitizers. The sensitizing dyes used include carbonium dyes, diphenylmethane dyes, triphenylmethane dyes, xanthene dyes, phthalein dyes, polymethine dyes (including oxonol dyes, merocyanine dyes, cyanine dyes, rhodacyanine dyes, and styryl dyes), and phthalocyanine dyes (including metallized dyes), as described e.g., in Harumi Miyamoto and Hidehiko Takei, *Imaging*, Vol. 1973, No. 8, p. 12, C. J. Young et al., *RCA Review*, Vol. 15, p. 469 (1954), Kohei Kiyota et al., *Denkitsushin Gakkai Ronbunshi*, Vol. J 63-C, No. 2, p. 97 (1980), Yuji Harasaki et al., *Kogyo Kagaku Zasshi*, Vol. 66, p. 78 and 188 (1963), and Tadaaki Tani, *Nihon Shashin Gakkaishi*, Vol. 35, p. 208 (1972).

Specific examples of carbonium dyes, triphenylmethane dyes, xanthene dyes, and phthalein dyes are described, e.g., in JP-B-51-452, JP-A-50-90334, JP-A-50-114227, JP-A-53-39130, JP-A-53-82353, U.S. Pat. Nos. 3,052,540 and 4,054,450, and JP-A-57-16456.

Usable polymethine dyes, such as oxonol dyes, merocyanine dyes, cyanine dyes, and rhodacyanine dyes, are described in F. M. Hamer, *The Cyanine Dyes and Related Compounds*. Specific examples of these dyes are described, e.g., in U.S. Pat. Nos. 3,047,384, 3,110,591, 3,121,008, 3,125,447, 3,128,179, 3,132,942, and 3,622,317, British Patents 1,226,892, 1,309,274, and 1,405,898, JP-B-48-7814, and JP-B-55-18892.

Further, polymethine dyes capable of performing spectral sensitization in the near infrared to infrared region of 700 nm or more include those described, e.g., in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, No. 216, pp. 117–118 (1982).

The light-sensitive element of the present invention is excellent in that the characteristics thereof hardly vary with the combined use of various sensitizing dyes.

If desired, the light-sensitive element may further contain various additives conventionally known for electrophotographic light-sensitive elements. The additives include chemical sensitizers for increasing electrophotographic sensitivity and plasticizers or surface active agents for improving film properties.

Suitable examples of the chemical sensitizers include electron attracting compounds such as a halogen, benzoquinone, chloranil, fluoranil, bromanil, dinitrobenzene, anthraquinone, 2,5-dichlorobenzoquinone, nitrophenol, tetrachlorophthalic anhydride, phthalic anhydride, maleic anhydride, N-hydroxymaleimide, N-hydroxyphthalimide, 2,3-dichloro-5,6-dicyanobenzoquinone, dinitrofluorenone, trinitrofluorenone, tetracyanoethylene, nitrobenzoic acid, and dinitrobenzoic acid; and polyarylalkane compounds, hindered phenol compounds and p-phenylenediamine compounds as describes in the literature references cited in Hiroshi Kokado, et al., *Saikin no Kododen Zairyo to Kankotai no Kaihatsu.Jitsuyoka*, Chs. 4 to 6, Nippon Kagaku Joho (1986). In addition, the compounds as described in JP-A-

58-65439, JP-A-58-102239, JP-A-58-129439, and JP-A-62-71965 may also be used.

Suitable examples of the plasticizers, which may be added for improving flexibility of a photoconductive layer, include dimethyl phthalate, dibutyl phthalate, dioctyl phthalate, triphenyl phthalate, triphenyl phosphate, diisobutyl adipate, dimethyl sebacate, dibutyl sebacate, butyl laurate, methyl phthalyl glycolate, and dimethyl glycol phthalate. The plasticizer can be added in an amount that does not impair electrostatic characteristics of the photoconductive layer. The amount of the additive to be added is not particularly limited, but ordinarily ranges from 0.001 to 2.0 parts by weight per 100 parts by weight of the photoconductive substance.

The photoconductive layer 2 of the present invention can be provided on a conventionally known support 1. In general, a support 1 for an electrophotographic light-sensitive layer is preferably electrically conductive. The electrically conductive support which can be used includes a substrate (e.g., a metal plate, paper, or a plastic sheet) having been rendered conductive by impregnation with a low-resistant substance, a substrate whose back side (opposite to the light-sensitive layer side) is rendered conductive and further having coated thereon at least one layer for, for example, curling prevention, the above-described substrate having formed on the surface thereof a water-resistant adhesive layer, the above-described substrate having on the surface thereof at least one precoat layer, and a paper substrate laminated with a plastic film on which aluminum, etc. has been vacuum deposited.

Specific examples of the conductive substrate and materials for rendering non-conductive substrates electrically conductive are described, for example, in Yukio Sakamoto, *Denshishashin*, Vol. 14, No. 1, pp. 2–11 (1975), Hiroyuki Moriga, *Nyumon Tokushushi no Kagaku*, Kobunshi Kankokai (1975), and M. F. Hoover, *J. Macromol. Sci. Chem.*, Vol. A-4, No. 6, pp. 1327–1417 (1970).

Now, the method of forming a color image according to the present invention will be described below.

First, a transfer layer 12 is formed on an electrophotographic light-sensitive element 11 having the surface of releasability.

According to the present invention, the formation of transfer layer 12 on a light-sensitive element 11 can be performed in connection with the steps of electrophotographic process and transfer or independently therefrom. Also, the transfer layer may be previously formed or may be formed each time on demand. When the transfer layer is previously formed independently from these steps, a conventional layer-forming method can be employed. For instance, a solution or dispersion containing the composition for the transfer layer is applied onto the surface of light-sensitive element 11 in a known manner.

The formation of transfer layer 12 is preferably performed each time in an apparatus in which the steps of electrophotographic process and transfer are carried out. By such a method, the light-sensitive element 11 can be repeatedly used in the same apparatus without throwing it away after using it only once. As a result, an advantage to reduce a cost of duplicate can be obtained. For such a purpose, a hot-melt coating method, transfer method or electrodeposition coating method is preferably employed.

The hot-melt coating method will be described as one method for forming the transfer layer in detail below.

The hot-melt coating method comprises hot-melt coating of the composition for the transfer layer by a known method. For such a purpose, a mechanism of a non-solvent type coating machine, for example, a hot-melt coating apparatus for a hot-melt adhesive (hot-melt coater) as described in the above-mentioned *Hot-melt Secchaku no Jissai*, pp. 197 to 215 can be utilized with modification to suit with coating onto the light-sensitive element drum. Suitable examples of coating machines include a direct roll coater, an offset gravure roll coater, a rod coater, an extrusion coater, a slot orifice coater, and a curtain coater.

A melting temperature of the thermoplastic resin at coating is usually in a range of from 50° to 180° C., while the optimum temperature is determined depending on the composition of the thermoplastic resin to be used. It is preferred that the resin is first molten using a closed pre-heating device having an automatic temperature controlling means and then heated in a short time to the desired temperature in a position to be coated on the light-sensitive element. To do so can prevent from degradation of the thermoplastic resin upon thermal oxidation and unevenness in coating.

A coating speed may be varied depending on flowability of the thermoplastic resin at the time of being molten by heating, a kind of coater, and a coating amount, etc., but is suitably in a range of from 1 to 100 mm/sec, preferably from 5 to 40 mm/sec.

The tansfer method will be described as one method for forming the transfer layer in detail below.

The transfer method comprises previously forming a transfer layer on release paper by hot-melt coating, solvent coating or electrodeposition of latex, etc. and heat-transferring the transfer layer onto the surface of electrophotographic light-sensitive element.

The release paper having the transfer layer thereon is simply supplied to an electrophotographic device in the form of a roll or sheet.

The release paper which can be employed in the present invention include those conventionally known as described, for example, in *Nenchaku (Nensecchaku) no Shin Gilutsu to Sono Yoto.Kakushu Oyoseihin no Kaihatsu Siryo*, published by Keiei Kaihatsu Center Shuppan-bu (May 20, 1978), and *All Paper Guide Shi no Shohin Jiten, Jo Kan, Bunka Sangyo Hen*, published by Shigyo Times Sha (Dec. 1, 1983). Specifically, the release paper comprises a substrate such as nature Clupak paper laminated with a polyethylene resin, high quality paper pre-coated with a solvent-resistant resin, kraft paper, a PET film having an under-coating or glassine having coated thereon a release agent mainly composed of silicone.

A solvent type of silicone is usually employed and a solution thereof having a concentration of from 3 to 7% by weight is coated on the substrate, for example, by a gravure roll or a wire bar, dried and then subjected to heat treatment at not less than 150° C. to be cured. The coating amount is usually about 1 g/m$^2$.

Release paper for tapes, labels, formation industry use and cast coat industry use each manufactured by a paper making company and put on sale are also generally employed. Specific examples thereof include Separate Shi (manufactured by Oji Paper Co., Ltd.), King Rease (manufactured by Shikoku Seishi K. K.), San Release (manufactured by Sanyo Kokusaku Pulp K. K.) and NK High Release (manufactured by Nippon Kako Seishi K. K.).

In order to form the transfer layer on release paper, a composition for the transfer layer mainly composed of resin is applied to releasing paper in a conventional manner, for example, by bar coating, spin coating or spray coating to form a film.

For a purpose of heat transfer of the transfer layer on release paper to an electrophotographic light-sensitive element, conventional heat transfer methods are utilized. Specifically, release paper having the transfer layer thereon is pressed on the electrophotographic light-sensitive element to heat transfer the transfer layer.

The conditions for transfer of the transfer layer from release paper to the surface of light-sensitive element are preferably as follows. A nip pressure of the roller is from 0.1 to 10 Kgf/cm$^2$ and more preferably from 0.2 to 8 Kgf/cm$^2$. A temperature at the transfer is from 25° to 100° C. and more preferably from 40° to 80° C. A speed of the transportation is from 0.5 to 100 mm/sec and more preferably from 3 to 50 mm/sec. The speed of transportation may differ from that of the electrophotographic step or that of the heat transfer step of the transfer layer to a primary receptor or to a receiving material.

Now, the electrodeposition coating method will be described as one method for forming the transfer layer in detail below.

According to the electrodeposition coating method, the thermoplastic resin as described above is electrodeposited or adhered on the surface of light-sensitive element 11 in the form of resin grains (AR) and then transformed into a uniform thin film, for example, by heating, thereby the transfer layer 12 being formed.

The thermoplastic resin grains (AR) must have either a positive charge or a negative charge. The electroscopicity of the resin grains is appropriately determined depending on a charging property of the electrophotographic light-sensitive element 11 to be used in combination.

An average grain diameter of the resin grains (AR) having the physical property described above is generally in a range of from 0.01 to 15 μm, preferably from 0.05 to 5 μm and more preferably from 0.1 to 1 μm. The resin grains may be employed as powder grains (in case of dry type electrodeposition) or grains dispersed in a non-aqueous system (in case of wet type electrodeposition). The resin grains dispersed in a non-aqueous system are preferred since they can easily prepare the peelable transfer layer having a uniform and small thickness.

In particular, the transferability of transfer layer formed is further improved in case of using resin grains (ARW) containing in each grain at least two kind of resins having a glass transition point different from each other, prefrably at least one of the resins (AH) having a high glass transition point described above and at least one of the resins (AL) having a low glass transition point described above.

The resin grains having a fine grain size used in the present invention can be produced by a conventionally known mechanical powdering method or polymerization granulation method. These methods can be applied to the production of resin grains for both of dry type electrodeposition and wet type electrodeposition.

The mechanical powdering method for producing powder grains used in the dry type electrodeposition method includes a method wherein the resin is directly powdered by a conventionally known pulverizer to form fine grains (for example, a method using a ball mill, a paint shaker or a jet mill). If desired, mixing, melting and kneading of the materials for resin grains before the powdering and classification for a purpose of controlling a grain diameter and after-treatment for treating the surface of grain after the powdering may be performed in an appropriate combination. A spray dry method is also employed.

Specifically, the powder grains can be easily produced by appropriately using a method as described in detail, for example, in Shadanhojin Nippon Funtai Kogyo Gijutsu Kyokai (ed.), *Zoryu Handbook*, II ed., Ohm Sha (1991), Kanagawa Keiei Kaihatsu Center, *Saishin Zoryu Gijutsu no Jissai*, Kanagawa Keiei Kaihatsu Center Shuppan-bu (1984), and Masafumi Arakawa et al (ed.), *Saishin Funtai no Sekkei Gijutsu*, Techno System (1988).

The polymerization granulation methods include conventionally known methods using an emulsion polymerization reaction, a seed polymerization reaction or a suspension polymerization reaction each conducted in an aqueous system, or using a dispersion polymerization reaction conducted in a non-aqueous solvent system.

More specifically, grains are formed according to the methods as described, for example, in Soichi Muroi, *Kobunshi Latex no Kagaku*, Kobunshi Kankokai (1970), Taira Okuda and Hiroshi Inagaki, *Gosei Jushi Emulsion*, Kobunshi Kankokai (1978), soichi Muroi, *Kobunshi Latex Nyumon*, Kobunsha (1983), I. Pürma and P. C. Wang, *Emulsion Polymerization*, I. Pürma and J. L. Gaudon, *ACS Symp. Sev.*, 24, p. 34 (1974), Fumio Kitahara et al, *Bunsan-Nyukakei no Kagaku*, Kogaku Tosho (1979), and Soichi Muroi (supervised), *Chobiryushi Polymer no Saisentan Gijutsu*, C. M. C. (1991), and then collected and pulyerized in such a manner as described in the reference literatures cited with respect to the mechanical method above, thereby the resin grains being obtained.

In order to conduct dry type electrodeposition of the fine powder grains thus-obtained, a conventionally known method, for example, a coating method of electrostatic powder and a developing method with a dry type electrostatic developing agent can be employed. More specifically, a method for electrodeposition of fine grains charged by a method utilizing, for example, corona charge, triboelectrification, induction charge, ion flow charge, and inverse ionization phenomenon, as described, for example, in J. F. Hughes, *Seiden Funtai Toso*, translated by Hideo Nagasaka and Machiko Midorikawa, or a developing method, for example, a cascade method, a magnetic brush method, a fur brush method, an electrostatic method, an induction method, a touchdown method and a powder cloud method, as described, for example, in Koich Nakamura (ed.), *Saikin no Denshishashin Genzo System to Toner Zairvo no Kaihatsu.Jitsuyoka*, Ch. 1, Nippon Kogaku Joho (1985) is appropriately employed.

The production of a latex in a non-aqueous system which are used in the wet type electrodeposition method can also be performed by any of the mechanical powdering method and polymerization granulation method as described above.

The mechanical powdering method includes a method wherein the resin is dispersed together with a dispersion polymer in a wet type dispersion machine (for example, a ball mill, a paint shaker, Keddy mill, and Dyno-mill), and a method wherein the materials for resin grains and a dispersion assistant polymer (or a covering polymer) have been previously kneaded, the resulting mixture is pulyerized and then is dispersed together with a dispersion polymer. Specifically, a method of producing paints or electrostatic developing agents can be utilized as described, for example, in Kenji Ueki (translated), *Toryo no Ryudo to Ganryo Bunsan*, Kyoritsu Shuppan (1971), D. H. Solomon, *The Chemistry of Organic Film Formers*, John Wiley & Sons (1967), *Paint and Surface Coating Theory and Practice*, Yuji Harasaki, *Coating Kogaku*, Asakura Shoten (1971), and Yuji Harasaki, *Coating no Kiso Kagaku*, Maki Shoten (1977).

The polymerization granulation method includes a dispersion polymerization method in a non-aqueous system conventionally known and is specifically described, for example, in *Chobiryushi Polymer no Saisentan Gijutsu*, Ch.

2, mentioned above, *Saikin no Denshishashin Genzo System to Toner Zairyo no Kaihatsu.Jitsuyoka*, Ch. 3, mentioned above, and K. E. J. Barrett, *Dispersion Polymerization in Organic Media*, John Wiley & Sons (1975).

The resin grains (ARW) containing in each grain at least two kind of resins having a glass transition point different from each other described above can be easily prepared using a seed polymerization method. Specifically, fine grains of the resin (AL) or resin (AH) are first prepared by a conventionally known dispersion polymerization method in a non-aqueous system and then using these fine grains as seeds, a monomer corresponding to the resin (AH) or resin (AL) is supplied to conduct polymerization in the same manner as above, whereby the resin grains (ARW) are preferably obtained.

The resin grains composed of a random copolymer containing the polymer component (F) to increase the peelability of the resin (A) can be easily obtained by performing a polymerization reaction using one or more monomers forming the resin (A) which are soluble in an organic solvent but becomes insoluble therein by being polymerized together with a monomer corresponding to the polymer component (F) according to the polymerization granulation method described above.

The resin grains containing the polymer component (F) as a block can be prepared by conducting a polymerization reaction using, as a dispersion stabilizing resins, a block copolymer containing the polymer component (F) as a block, or conducting polymerization reaction using a monofunctional macromonomer having a weight average molecular weight of from $1\times10^3$ to $2\times10^4$, preferably from $3\times10^3$ to $1.5\times10^4$ and containing the polymer component (F) as the main repeating unit together with one or more monomers forming the resin (A). Alternatively, the resin grains composed of block copolymer can be obtained by conducting a polymerization reaction using a polymer initiator (for example, azobis polymer initiator or peroxide polymer initiator) containing the polymer component (F) as the main repeating unit.

As the non-aqueous solvent used in the dispersion polymerization method in a non-aqueous system, there can be used any of organic solvents having a boiling point of at most 200° C., individually or in a combination of two or more thereof.

Specific examples of the organic solvent include alcohols such as methanol, ethanol, propanol, butanol, fluorinated alcohols and benzyl alcohol, ketones such as acetone, methyl ethyl ketone, cyclohexanone and diethyl ketone, ethers such as diethyl ether, tetrahydrofuran and dioxane, carboxylic acid esters such as methyl acetate, ethyl acetate, butyl acetate and methyl propionate, aliphatic hydrocarbons containing from 6 to 14 carbon atoms such as hexane, octane, decane, dodecane, tridecane, cyclohexane and cyclooctane, aromatic hydrocarbons such as benzene, toluene, xylene and chlorobenzene, and halogenated hydrocarbons such as methylene chloride, dichloroethane, tetrachloroethane, chloroform, methylchloroform, dichloropropane and trichloroethane. However, the present invention should not be construed as being limited thereto.

When the dispersed resin grains are synthesized by the dispersion polymerization method in a non-aqueous solvent system, the average grain diameter of the dispersed resin grains can readily be adjusted to at most 1 μm while simultaneously obtaining grains of monodisperse system with a very narrow distribution of grain diameters.

A dispersive medium used for the resin grains dispersed in a non-aqueous system at the electrodeposition is usually a non-aqueous solvent having an electric resistance of not less than $10^8$ Ω·cm and a dielectric constant of not more than 3.5, since the dispersion is employed in a method wherein the resin grains are electrodeposited utilizing a wet type electrostatic photographic developing process or electrophoresis in electric fields.

The insulating solvents which can be used include straight chain or branched chain aliphatic hydrocarbons, alicyclic hydrocarbons, aromatic hydrocarbons, and halogen-substituted derivatives thereof. Specific examples of the solvent include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 Solvent (Amsco: trade name of Americal Mineral Spirits Co.). They may be used singly or as a combination thereof.

The insulating organic solvent described above is preferably employed as a non-aqueous solvent from the beginning of polymerization granulation of resin grains dispersed in the non-aqueous system. However, it is also possible that the granulation is performed in a solvent other than the above-described insulating solvent and then the dispersive medium is substituted with the insulating solvent to prepare the desired dispersion.

Another method for the preparation of a latex in non-aqueous system is that a block copolymer comprising a polymer portion which is soluble in the above-described non-aqueous solvent having an electric resistance of not less than $10^8$ Ω·cm and a dielectric constant of not more than 3.5 and a polymer portion which is insoluble in the non-aqueous solvent, is dispersed in the non-aqueous solvent by a wet type dispersion method. Specifically, the block copolymer comprising a soluble polymer component and an insoluble polymer component is first synthesized in an organic solvent which dissolves the resulting block copolymer according to the synthesis method of block copolymer as described above and then dispersed in the non-aqueous solvent described above.

In order to electrodeposit dispersed grains in a dispersive medium upon electrophoresis, the grains must be electroscopic grains of positive charge or negative charge. The impartation of electroscopicity to the grains can be performed by appropriately utilizing techniques on developing agents for wet type electrostatic photography. More specifically, it can be carried out using electroscopic materials and other additives as described, for example, in *Saikin no Denshishashin Genzo System to Toner Zairyo no Kaihatsu.Jitsuyoka*, pp. 139 to 148, mentioned above, Denshishashin Gakkai (ed.), *Denshishashin Gijutsu no Kiso to Oyo*, pp. 497 to 505, Corona Sha (1988), and Yuji Harasaki, *Denshishashin*, Vol. 16, No. 2, p. 44 (1977).

Further, compounds as described, for example, in British Patents 893,429 and 934,038, U.S. Pat. Nos. 1,122,397, 3,900,412 and 4,606,989, JP-A-60-179751, JP-A-60-185963 and JP-A-2-13965.

The latex in a non-aqueous system which can be employed for electrodeposition usually comprises from 0.1 to 20 g of grains containing the thermoplastic resin, from 0.01 to 50 g of a dispersion stabilizing resin and if desired, from 0.0001 to 10 g of a charge control agent in one liter of an electrically insulating dispersive medium.

Furthermore, if desired, other additives may be added to the dispersion of resin grains in order to maintain dispersion stability and charging stability of grains. Suitable examples of such additives include rosin, petroleum resins, higher alcohols, polyethers, silicone oil, paraffin wax and triazine derivatives. However, the present invention should not be construed as being limited thereto.

The total amount of these additives is restricted by the electric resistance of the dispersion. Specifically, if the electric resistance of the dispersion becomes lower than $10^8$ Ω·cm, a sufficient amount of the thermoplastic resin grains deposited is reluctant to obtain and, hence, it is necessary to control the amounts of these additives in the range of not lowering the electric resistance than $10^8$ Ω·cm.

The thermoplastic resin grains which are prepared, provided with an electrostatic charge and dispersed in an electrically insulting liquid behave in the same manner as an electrophotographic wet type developing agent. For instance, the resin grains can be subjected to electrophoresis on the surface of light-sensitive element using a developing device, for example, a slit development electrode device as described in *Denshishashin Gilutsu no Kiso to Oyo*, pp. 275 to 285, mentioned above. Specifically, the grains comprising the thermoplastic resin are supplied between the electrophotographic light-sensitive element 11 and an electrode placed in face of the light-sensitive element, and migrated by electrophoresis according to a potential gradient applied from an external power source to adhere to or electrodeposit on the electrophotographic light-sensitive element 11, thereby a film being formed.

In general, if the charge of grains is positive, an electric voltage was applied between an electroconductive support of the light-sensitive element and a development electrode of a developing device from an external power source so that the light-sensitive material 11 is negatively charged, thereby the grains being electrostatically electrodeposited on the surface of light-sensitive element 11.

Electrodeposition of grains can also be performed by wet type toner development in a conventional electrophotographic process. Specifically, the light-sensitive element is uniformly charged and then subjected to a conventional wet type toner-development without exposure to light or after conducting a so-called print-off in which only unnecessary regions are exposed to light, as described in *Denshishashin Gijutsu no Kiso to Oyo*, pp. 46 to 79, mentioned above.

The amount of thermoplastic resin grain adhered to the light-sensitive element 11 can be appropriately controlled, for example, by selecting an external bias voltage applied, a potential of the light-sensitive element charged and a developing time.

After the electrodeposition of grains, the developing solution is wiped off upon squeeze using a rubber roller, a gap roller or a reverse roller. Other known methods, for example, corona squeeze and air squeeze can also be employed. Then, the deposit is dried with cool air or warm air or by a infrared lamp preferably to be rendered the thermoplastic resin grains in the form of a film, thereby the transfer layer being formed.

Further, the impartation of releasability and formation of transfer layer 12 onto a light-sensitive element 11 can be performed at the same time using a dispersion for electrodeposition to form the transfer layer containing a compound (S) having at least a fluorine atom and/or a silicon atom at the formation of the transfer layer 12 on the light-sensitive element 11 according to the present invention. Thus, a conventional electrophotographic light-sensitive element can be utilized without employing a specific means for imparting the releasability onto the light-sensitive element.

The compound (S) used for such a purpose includes the same compound as described with respect to the compound (S) for imparting releasability above and is soluble at least 0.01 g per one liter of an electrically insulating organic solvent having a dielectric constant of not more than 3.5 (at a temperature of 25° C.). When the compound (S) having the solubility of less than 0.01 g per liter of the electrically insulating organic solvent is used, unevenness in adsorption of the compound (S) on the surface of light-sensitive element may occur.

Any compound (S) which has the property can be employed in that when a solution containing the compound (S) dissolved at a concentration of 0.01 g per liter in an electrically insulating organic solvent described above is applied to an electrophotographic light-sensitive element to be used and set to touch, and then the resulting light-sensitive element is measured its adhesive strength according to JIS Z 0237-1980 "Testing methods of pressure sensitive adhesive tapes and sheets" described above, the adhesive strength is not more than 100 g·f, preferably not more than 50 g·f, and more preferably not more than 10 g·f. Specific examples thereof are same as those described with respect to the compound (S) above.

The amount of compound (S) added to the electrically insulating organic solvent may be varied depending on the compound (S) and the electrically insulating organic solvent to be used. A suitable amount of the compound (S) is determined taking the effect to be obtained and adverse affects on electrophoresis of resin grains (e.g., decrease in electric resistance or increase in viscosity of the solution) into consideration. A preferred range of the compound (S) added is ordinarily from 0.01 to 20 g per liter of electrically insulating organic solvent.

Then, toner images are formed on the transfer layer 12 provided on the electrophotographic light-sensitive element 11 via a conventional electrophotographic process according to the present invention. Specifically, each step of charging, light exposure, development and fixing is performed in a conventionally known manner.

The developers which can be used in the present invention include conventionally known developers for electrostatic photography, either dry type or liquid type developers for electrostatic photography.

For example, specific examples of the developer are described in *Denshishashin Gilutsu no Kiso to Oyo*, supra, pp. 497–505, Koichi Nakamura (ed.), *Toner Zairyo no Kaihatsu.Jitsuyoka*, Ch. 3, Nippon Kagaku Joho (1985), Gen Machida, *Kirokuyo Zairyo to Kankosei Jushi*, pp. 107–127 (1983), and Denshishasin Gakkai (ed.), *Imaging*, Nos. 2–5, "Denshishashin no Genzo.Teichaku.Taiden.Tensha", Gakkai Shuppan Center.

Dry developers practically used include one-component magnetic toners, two-component toners, one-component non-magnetic toners, and capsule toners. Any of these dry developers may be employed in the present invention.

Particularly, a combination of a scanning exposure system using a laser beam based on digital information and a development system using a liquid developer is an advantageous process since the process is particularly suitable to form highly accurate images. One specific example of the formation of toner image is illustrated below.

An electrophotographic light-sensitive material 11 is positioned on a flat bed by a register pin system and fixed on the flat bed by air suction from the backside. Then it is charged by means of a charging device, for example, the device as described in Denshishashin Gakkai (ed.), *Denshishashin Gijutsu no Kiso to Oyo*, p. 212 et seq., Corona Sha (Jun. 15, 1988). A corotron or scotron system is usually used for the charging process. In a preferred charging process, the charging conditions may be controlled by a feedback system of the information on charged potential from a detector connected to the light-sensitive material thereby to control the surface potential within a predetermined range. Thereafter, the charged light-sensitive material is exposed to light by scanning with a laser beam in accordance with the system described, for example, in ibidem, p. 254 et seq.

Toner development is then conducted using a liquid developer. The light-sensitive material charged and exposed is removed from the flat bed and developed according to a wet type developing method as described, for example, in ibidem, p. 275 et seq. The exposure mode is determined in accord with the toner image development mode. Specifically, in case of reversal development, a negative image is irradiated with a laser beam, and a toner having the same charge polarity as that of the charged light-sensitive material is electrodeposited on the exposed area with a bias voltage applied. For the details, reference can be made to ibidem, p. 157 et seq.

After the toner development, the light-sensitive material is squeezed to remove the excess developer as described in ibidem, p. 283 and dried. Preferably, the light-sensitive material may be rinsed with the carrier liquid used in the liquid developer alone before squeezing.

The typical liquid developer is basically composed of an electrically insulating organic solvent, for example, an isoparaffinic aliphatic hydrocarbon (e.g., Isopar H or Isopar G (manufactured by Esso Chemical Co.), Shellsol 70 or Shellsol 71 (manufactured by Shell Oil Co.) or IP-Solvent 1620 (manufactured by Idemitsu Petro-Chemical Co., Ltd.)) as a dispersion medium, having dispersed therein a colorant (e.g., an inorganic or organic dye or pigment) and a resin for imparting dispersion stability, fixability, and chargeability to the developer (e.g., an alkyd resin, an acrylic resin, a polyester resin, a styrene-butadiene resin, and rosin). If desired, the liquid developer can contain various additives for enhancing charging characteristics or improving image characteristics.

The colorant is appropriately selected from known dyes and pigments, for example, benzidine type, azo type, azomethine type, xanthene type, anthraquinone type, phthalocyanine type (including metallized type), titanium white, nigrosine, aniline black, and carbon black.

Other additives include, for example, those described in Yuji Harasaki, *Denshishashin*, Vol. 16, No. 2, p. 44, such as di-2-ethylhexylsufosuccinic acid metal salts, naphthenic acid metal salts, higher fatty acid metal salts, alkylbenzenesulfonic acid metal salts, alkylphosphoric acid metal salts, lecithin, polyvinylpyrrolidone, copolymers containing a maleic acid monoamido component, coumarone-indene resins, higher alcohols, polyethers, polysiloxanes, and waxes. However, the present invention should not be construed as being limited thereto.

With respect to the content of each of the main components of the liquid developer, toner particles mainly comprising a resin (and, if desired, a colorant) are preferably present in an amount of from 0.5 to 50 parts by weight per 1000 parts by weight of a carrier liquid. If the toner content is less than 0.5 part by weight, the image density is insufficient, and if it exceeds 50 parts by weight, the occurrence of fog in the non-image areas may be tended to. If desired, the above-described resin for dispersion stabilization which is soluble in the carrier liquid is added in an amount of from about 0.5 to about 100 parts by weight per 1000 parts by weight of the carrier liquid. The above-described charge control agent can be preferably added in an amount of from 0.001 to 1.0 part by weight per 1000 parts by weight of the carrier liquid. Other additives may be added to the liquid developer, if desired. The upper limit of the total amount of other additives is determined, depending on electrical resistance of the liquid developer. Specifically, the amount of each additive should be controlled so that the liquid developer exclusive of toner particles has an electrical resistivity of not less than $10^9$ Ωcm. If the resistivity is less than $10^9$ Ωcm, a continuous gradation image of good quality can hardly be obtained.

The liquid developer can be prepared, for example, by mechanically dispersing a colorant and a resin in a dispersing machine, e.g., a sand mill, a ball mill, a jet mill, or an attritor, to produce colored particles, as described, for example, in JP-B-35-5511, JP-B-35-13424, JP-B-50-40017, JP-B-49-98634, JP-B-58-129438, and JP-A-61-180248.

The colored particles may also be obtained by a method comprising preparing dispersed resin grains having a fine grain size and good monodispersity in accordance with a non-aqueous dispersion polymerization method and coloring the resulting resin grains. In such a case, the dispersed grains prepared can be colored by dyeing with an appropriate dye as described, e.g., in JP-A-57-48738, or by chemical bonding of the dispersed grains with a dye as described, e.g., in JP-A-53-54029. It is also effective to polymerize a monomer already containing a dye at the polymerization granulation to obtain a dye-containing copolymer as described, e.g., in JP-B-44-22955.

The toner image 3 formed on the light-sensitive element 11 is heat-transferred together with the transfer layer 12 onto a primary receptor 20.

It is possible that on the toner image 3 formed on the transfer layer 12 is further provided a transfer layer 12', and the toner image 3 is transferred together with the transfer layers 12 and 12' onto the primary receptor 20 as illustrated in route (a) of FIG. 2. Alternatively, it is also possible that a transfer layer 12" is provided on the primary receptor 20 and the toner image 3 on the light-sensitive element 11 is transferred together with the transfer layer 12 onto the transfer layer 12" as illustrated in route (b) of FIG. 2. In case of providing the transfer layer 12" on the primary receptor 20, it is desirable to provide the transfer layer 12" on the primary receptor 20 until the end of the process for forming the toner image 3 on the light-sensitive element 11.

The second peelable transfer layer 12' to be provided on the toner image 3 and transfer layer 12 is ordinarily formed each time on the toner image in an apparatus for conducting the electrophotographic process and the transfer process. While the transfer layer 12" may be previously formed on the primary receptor by a conventional film-forming method independently from the electrophotographic process and transfer process, it is preferred to provide each time on the primary receptor 20 in the same apparatus for conducting these processes. As a result, the primary receptor 20 can be repeatedly employed in the same apparatus without throwing it away.

Further, by the formation of transfer layer 12 on light-sensitive element 11 in the same apparatus as described above, the preparation of color duplicate can be continuously performed.

The second peelable transfer layers 12' and 12" can be provided on the toner image 3 and primary receptor 20 appropriately using one of the hot-melt coating method, transfer method from release paper and electrodeposition coating method same as in the formation of transfer layer 12 described above, respectively.

The transfer layers 12, 12' and 12" may be provided by the same means or different means from each other. While the above-described three methods are preferred for the formation of transfer layers 12, 12' and 12", the electrodeposition coating method is particularly preferred since a simple apparatus can be utilized and a uniform and thin layer can be stably and easily formed.

The primary receptor 20 is an intermediate medium for receiving the toner image 3 formed on the transfer layer 12 on the light-sensitive element 11 by an electrostatic transfer method or upon bringing the light-sensitive element into intimate therewith under applying heat and/or pressure and then releasing and transferring the transfer layer 12 (also transfer layer 12' or 12" in some cases) together with the toner image 3 onto a final receiving material 30 under applying heat and/or pressure to form a final color image.

It is important therefore that releasability of the surface of primary receptor 20 is less than releasability of the surface of light-sensitive element 11 but is sufficient for peeling and transferring onto a receiving material 30. Specifically, the surface of primary receptor has the adhesive strength larger, preferably 10 g·f larger, more preferably 30 g·f larger, than the adhesive strength of the surface of light-sensitive element 11. On the other hand, the adhesive strength of the surface of primary receptor 20 is preferably at most 200 g·f, more preferably at most 180 g·f.

The heat transfer of toner image onto a primary receptor can be performed using known method and devices.

A nip pressure for the transfer is usually in a range of from 0.2 to 20 Kgf/cm$^2$ and preferably from 0.5 to 15 Kgf/cm$^2$. The rollers may be pressed by springs provided on opposite ends of the roller shaft or by an air cylinder using compressed air. A speed of the transportation is usually in a range of from 0.1 to 100 mm/sec, preferably in a range of from 0.5 to 50 mm/sec, and more preferably in a range of from 1 to 30 mm/sec. The speed of transportation may differ between the electrophotographic process and the heat transfer step.

The temperature of roller surface is preferably maintained within a predetermined range by means of known surface temperature detective means and temperature controller. A pre-heating means and a cooling means for the light-sensitive material may be provided in front of and at the rear of the heating roller portion, respectively.

Also, as a means for pressing two rollers, a pair of springs provided at both ends of the shaft of at least one roller or an air cylinder using compressed air may be employed.

The transfer of toner image 3 from the light-sensitive element 11 to the primary receptor 20 and the transfer of toner image 3 together with the transfer layer from the primary receptor 20 to the final receiving material 30 may be simultaneously performed with respect to one sheet of toner image. Alternatively, after the transfer of one sheet of toner image from the light-sensitive element to the primary receptor 20 is completed, the image is transferred to the final receiving material 30. The heat-transfer step is incorporated into a series of the electrophotographic process performed in the apparatus.

Any material can be employed for the primary receptor as far as the conditions described above are fulfilled. For the transfer of toner image 3 from the light-sensitive element 11 to the primary receptor 20, for example, primary receptors of a drum type and an endless belt type which are repeatedly usable are preferred in the present invention. In the primary receptor of drum type or endless belt type, an elastic material layer or a stratified structure of an elastic material layer and a reinforcing layer is preferably provided on the surface thereof stationarily or removably so as to be replaced.

Any of conventionally known natural resins and synthetic reins can be used as the elastic material. These resins may be used either individually or as a combination of two or more thereof in a single or plural layer. Specifically, various resins described, for example, in A. D. Roberts, *Natural Rubber Science and Technology*, Oxford Science Publications (1988), w. Hofmann, *Rubber Technology Handbook*, Hanser Publisher (1989) and *Plastic Zairyo Koza*, Vols. 1 to 18, Nikkan Kogyo Shinbunsha can be employed.

Specific examples of the elastic material include styrene-butadiene rubber, butadiene rubber, acrylonitrile-butadiene rubber, cyclized rubber, chloroprene rubber, ethylene-propylene rubber, butyl rubber, chloro-sulfonated polyethylene rubber, silicone rubber fluoro-rubber, polysulfide rubber, natural rubber, isoprene rubber and urethane rubber. The desired elastic material can be appropriately selected by taking releasability from the transfer layer, durability, etc. into consideration.

The adhesive strength of the surface of primary receptor 20 can be easily adjusted by applying the method as described with respect to the releasability of the surface of light-sensitive element hereinbefore.

Examples of materials used in the reinforcing layer for the elastic material layer include cloth, glass fiber, resin-impregnated specialty paper, aluminum and stainless steel. A spongy rubber layer may be provided between the surface elastic material layer and the reinforcing layer. The surface of primary receptor 20 has preferably an average roughness of 0.01 mm or below. The thickness of surface elastic material layer is preferably from 0.01 to 10 mm.

Conventionally known materials can be used as materials for the primary receptor of endless belt type. For example, those described in U.S. Pat. Nos. 3,893,761, 4,684,238 and 4,690,539 are employed. Further, a layer serving as a heating medium may be provided in the belt as described in JP-W-4-503265 (the term "JP-W" as used herein means an "unexamined published international patent application").

The final receiving material 30 used in the present invention is not particularly limited and various paper, polymer sheets (films) and metals can be employed therefor. For example, paper such as coated paper conventionally used as printing paper, high quality paper, normal paper, copying paper for PPC (including recycled paper for copying), adhesive sheets having provided an adhesive on the surface thereof (e.g., Copy Label manufactured by Plus Co., Ltd., Tuck Form Label TF Sheet manufactured by Lion Co., Ltd., and Tie Series Sheet manufactured by Kokuyo Co., Ltd. (an adhesive film for word-processor)), and film sheets such as PET film sheets, polyethylene sheets, and polypropylene sheets) are utilized.

On the surface of final receiving material 30 (i.e., a side to be in contact with the toner image and transfer layer), a thermoplastic resin layer may be provided. A thickness of the resin layer is preferably in a range of from 1 to 20 μm, more preferably in a range of from 2 to 10 μm. The resins used include those described as the resins (A) for the transfer layer of the present invention and resins known as adhesive or stick.

By providing the resin layer on the final receiving material 30, adhesion between the final receiving material and the toner image 30 and/or transfer layers 12, 12' and 12" on the primary receptor 20 increases and thus transferability is further improved. As a result, the decrease in transfer temperature and/or transfer pressure becomes possible and transfer speed is remarkably increased in some cases. In a case wherein the receiving material has a rough surface or is hard itself and less cushiony, the resin layer is particularly effective.

The heat-transfer of toner image 3 together with transfer layer 12 (and transfer layer 12' or 12", if desired) onto a receiving material 30 can be performed using known methods and devices in the present invention. The heat-transfer step can be performed independently from the step of electrophotographic process, step of forming a transfer layer and/or step of transferring the transfer layer onto a primary receptor, or in the apparatus conducting these steps.

An example of a device generally employed for heat-transferring the transfer layer 12 (including transfer layer 12' or 12" in some cases) to a receiving material independently from an apparatus conducting other steps is illustrated in FIG. 3.

The device is composed of a pair of rollers covered with rubber 4 each containing therein a heating means 5 which are driven with a predetermined nip pressure applied. The surface temperature of rollers 4 is preferably in a range of from 40° to 150° C., and more preferably from 50° to 120° C., the nip pressure between rollers is preferably in a range of from 0.2 to 20 $Kgf/cm^2$, and more preferably from 0.5 to 10 $Kgf/cm^2$, and the transportation speed is preferably in a range of from 0.1 to 500 mm/sec, and more preferably from 1 to 300 mm/sec.

The temperature of roller surface is preferably maintained within a predetermined range by means of known surface temperature detective means 6 and temperature controller 7. A pre-heating means and a cooling means for the light-sensitive material may be provided in front of and at the rear of the heating roller portion, respectively.

Although not shown in FIG. 3, as a means for pressing two rollers, a pair of springs provided at both ends of the shaft of at least one roller or an air cylinder using compressed air may be employed.

When a device for transferring the transfer layer 12 onto a final receiving material 30 is installed in the apparatus, it is preferred that ranges of heating temperature, nip pressure between a primary receptor 20 and a receiving material 30, and transportation speed for the heat-transfer of transfer layer onto the receiving material are same as those described for the heat transfer step of toner image from a light-sensitive element to the primary receptor respectively. Further, the conditions of transfer onto the receiving material 30 may be the same as or different from those of transfer of toner image to the primary receptor 20.

The heat-transfer behavior of transfer layer onto the final receiving material 30 is considered as follows. Specifically, when the transfer layer 12 (including the transfer layer 12' or 12" in some cases) softened to a certain extent is heated, the tackiness of the transfer layer increases and the transfer layer is closely adhered to the final receiving material 30. After the transfer layer is passed under a roller for release, the temperature of the transfer layer is decreased to reduce the flowability and the tackiness and thus, the transfer layer 12 (including 12' or 12") is peeled as a film from the surface of the primary receptor 20 together with the toner 3 thereon while adhering to the final receiving material 30. Accordingly, the transfer conditions should be set so as to realize such a situation.

When the second transfer layer 12' or 12" is provided in addition to the transfer layer 12, the toner image 3 on the final receiving material 30 is consequently covered with the second transfer layer 12' or 12", and hence the toner image 3 is protected from being damaged or stained.

Now, preferred embodiments of the method of forming a color image using an electrophotographic process according to the present invention will be described with reference to the accompanying drawings hereinbelow.

FIG. 4 is a schematic view of an apparatus for forming a color image suitable for conducting the method according to the present invention wherein a transfer layer 12 is formed by the hot-melt coating method and a primary receptor 20 of a drum type is employed. FIG. 5 is a schematic view of an apparatus for forming a color image according to the present invention wherein a transfer layer 12 is formed by the electrodeposition coating method and a primary receptor 20 of an endless belt type is employed. It should be noted, however, that the present invention is not to be limited thereto.

As described above, when an electrophotographic light-sensitive element 11 whose surface has been modified to have releasability, a transfer layer 12 is formed on the light-sensitive element 11. On the other hand, when releasability of the surface of light-sensitive element 11 is insufficient, a device is provided to cause the compound (S) to adsorb or adhere to the surface of light-sensitive element 11 before the formation of transfer layer 12, thereby the desired releasability being imparted to the surface of light-sensitive element 11. Specifically, the compound (S) is supplied from an applying device for compound (S) 10 which utilizes any one of the embodiments as described above onto the surface of light-sensitive element 11. The applying device for compound (S) 10 may be stationary or movable.

In case of using the hot-melt coating method in order to form the transfer layer 12 on the light-sensitive element 11 (as shown in FIG. 4), thermoplastic resin **12*a* is coated on the surface of a light-sensitive element 11 provided on the peripheral surface of a drum by a hot-melt coater 13 and is caused to pass under a suction/exhaust unit 15 to be cooled to a predetermined temperature. After the hot-melt coater 13 is moved to the stand-by position indicated as 13*a*, a liquid developing unit set 14 is moved to the position where the hot-melt coater 13** was. Then, an electrophotographic process is conducted.

In case of using the electrodeposition coating method in order to form the transfer layer 12 on the light-sensitive element 11 (as shown in FIG. 5), an electrodeposition.developing unit set 14' containing a dispersion of resin grains is brought near the light-sensitive element 11 and is kept stationary with a gap of 1 mm between the surface thereof and a development electrode of the electrodeposition.developing unit set 14'. The light-sensitive element is rotated while supplying the dispersion of resin grains into the gap and applying an electric voltage across the gap from an external power source, whereby the grains are deposited over the entire areas of the surface of light-sensitive element 11.

The dispersion of resin grains adhered to the surface of light-sensitive element 11 is removed by a squeezing unit 14R built in the electrodeposition.developing unit set 14'. Then, the resin grains are fused by a heating means and thus a transfer layer 12 in the form of resin film is obtained.

Thereafter, the light-sensitive element 11 is cooled to a predetermined temperature by a cooling device similar to the suction/exhaust unit from the outside of the light-sensitive element 11 or from the inside of the drum of light-sensitive element 11, if desired. After the squeezing unit 14R is removed, the electrodeposition-developing unit set 14' is moved to the stand-by position. Then, an electrophotographic process is conducted.

A device for simply forming a transfer layer 12 utilizing release paper on the light-sensitive element 11 is schematically illustrated in FIG. 6.

In FIG. 6, release paper 24 having provided thereon a transfer layer 12 is heat-pressed on the light-sensitive element 11 by a heating roller **25*b*, thereby the transfer layer 12** being transferred on the surface of light-sensitive element 11. The release paper 24 is cooled by a cooling roller 25c and recovered. The light-sensitive element 11 is heated by a pre-heating means 25a to improve transferability of the transfer layer 12 upon heat-press, if desired. The device as shown in FIG. 6 may be installed in place of the device for the hot-melt coating method in FIG. 4.

The light-sensitive element 11 having the transfer layer 12 composed of thermoplastic resin provided thereon is then subjected to the electrophotographic process. A specific embodiment using a liquid developer for toner development will be described with reference to the apparatus shown in FIG. 4 hereinafter.

The light-sensitive element 11 is uniformly charged to, for instance, a positive polarity by a corona charger 18 and then is exposed imagewise by an exposure device (e.g., a semiconductor laser) 19 on the basis of yellow image information, whereby the potential is lowered in the exposed regions and thus, a contrast in potential is formed between the exposed regions and the unexposed regions. A yellow liquid developing unit 14y containing a liquid developer comprising yellow pigment particles having a positive electrostatic charge dispersed in an electrically insulating dispersion medium is brought near the surface of a light-sensitive element 11 from a developing unit 14 and is kept stationary with a gap of 1 mm therebetween.

The light-sensitive element 11 is first prebathed by a pre-bathing means provided in the developing unit, and then the yellow liquid developer is supplied on the surface of the light-sensitive element 11 while applying a developing bias voltage between the light-sensitive element 11 and a development electrode by a bias voltage source and wiring (not shown). The bias voltage is applied so that it is slightly lower than the surface potential of the unexposed regions, while the development electrode is charged to positive and the light-sensitive element is charged to negative. When the bias voltage applied is too low, a sufficient density of the toner image cannot be obtained.

The liquid developer adhered to the surface of light-sensitive element 11 is subsequently washed off by a rinsing means provided in the developing unit set 14 and the rinse solution adhered to the surface of the light-sensitive element 11 is removed by a squeeze means. Then, the light-sensitive element is dried by passing under the suction/exhaust unit 15.

The above described electrophotographic process is repeated with respect to each image information of magenta, cyan and black using each of magenta, cyan and black liquid developing units 14m, 14c and 14k. Meanwhile, a device for forming the transfer layer and a primary receptor 20 is kept away from the surface of the light-sensitive element 11.

The formation of second transfer layer 12' on the first transfer layer 12 bearing the toner image 3 can be performed in the same manner as the formation of transfer layer 12 described above. Methods for the formation of transfer layer 12 and transfer layer 12' may be the same or different from each other.

On the other hand, in case of providing the second transfer layer 12" on a primary receptor 20, transfer layer 12" is formed on the primary receptor 20 by a transfer layer-forming device 21 before the completion of the formation of toner image on the light-sensitive element 11 by the electrophotographic process. The transfer layer 12" can also be provided on the primary receptor 20 appropriately employing the method for the formation of transfer layer 12 described above. The primary receptor 20 may be a drum type as shown in FIG. 4 or an endless belt type as shown in FIG. 5.

In a case wherein the transfer layer 12" is provided on the primary receptor 20 by the electrodeposition coating method, in order to conduct the exhaustion of in the dispersion, the suction/exhaust unit 15 provided for the electrophotographic light-sensitive element 11 may also be used by arranging it in an appropriate position usable for the primary receptor 20. Alternatively, a suction/exhaust unit similar to the unit 15 is independently provided for the primary receptor 20. As the pre-bathing solution and the rinse solution, a carrier liquid for the liquid developer is ordinarily used.

When the formation of transfer layer 12 and formation of transfer layer 12' or 12" are conducted in the apparatus wherein an electrophotographic process is carried out and the light-sensitive element 11 and the primary receptor 20 are repeatedly employed, the transfer layer 12 and transfer layer 12' or 12" which may have the same composition or different compositions from each other are provided by appropriately moving the same device for forming transfer layer. When transfer layers having different compositions are provided, two devices for forming transfer layer may be utilized. In such a case, the same process for forming transfer layer or a combination of different processes for forming transfer layer may be used. Specifically, the device (s) are appropriately designed so as to be positioned at the formation of transfer layer in place of other process unit in the apparatus for electrophotographic process.

Further, by stopping the apparatus in the state where the transfer layer 12 has been formed on the light-sensitive element 11 and/or the state wherein the transfer layer 12" has been formed on the primary receptor 20, the next operation can start with the electrophotographic process.

After the formation of four color toner image 3 on the transfer layer 12 and, if desired, the formation of transfer layer 12' thereon, the toner image is heat-transferred together with the transfer layer onto a primary receptor 20. In FIG. 7, a partial view of the heat-transfer step is schematically illustrated wherein only the transfer layer 12 is employed for an example.

The light-sensitive element is pre-heated in the desired range of temperature by a pre-heating means 16 and/or 17 for the drum of light-sensitive element, the transfer layer 12" on primary receptor 20 is also pre-heated in the desired range of temperature by a pre-heating means 16 and/or 17 if desired, and then the toner image 3 on the transfer layer 12 is brought into close contact with the primary receptor 20, whereby the toner image 3 is heat-transferred onto the primary receptor.

As the pre-heating means 16, a non-contact type heater such as an infrared line heater, a flash heater or the like is preferably employed. The surface temperature of light-sensitive element heated at the time of heat transfer is preferably in a range of from 40° to 150° C., and more preferably from 50° to 120° C.

Although not shown in the figure, as a means for pressing roller, a pair of springs provided at both ends of the shaft of the roller or an air cylinder using compressed air may be employed.

The toner image 3 completely transferred on the primary receptor 20 is then pressed and heat-transferred onto a final receiving material 30, for example, coated paper together with the transfer layer 12 (and the transfer layer 12' or 12", if desired). In FIG. 8, a partial view of the final transfer step is schematically illustrated wherein as the primary receptor, a drum type and an endless belt type are employed in FIGS. 8a and 8b respectively, and only the transfer layer 12 is employed for an example.

The primary receptor 20 is pre-heated in the desired range of temperature by a pre-heating means 16 and/or 17, the receiving material 30 is also pre-heated in the desired range of temperature by a back-up roller for transfer 31, the transfer layer 12 bearing the toner image 3 on the primary receptor 20 is brought into close contact with the receiving material 30 and then the receiving material is cooled by a back-up roller for release 32, thereby heat-transferring the toner image 3 to the receiving material 30 together with the transfer layer 12. Thus a cycle of steps is terminated.

In case of using the primary receptor of an endless belt type, each transfer step can be conducted in the same procedure and condition as in the case using the primary receptor of a drum type.

It is needless to say that in the method of forming a color image according to the present invention, the above-described conditions on transfer steps for the toner image 3 and the transfer layer 12, 12' or 12" should be optimized depending on the physical properties of the light-sensitive element 11 (i.e., the light-sensitive layer and support), the surface of primary receptor 20, the transfer layers 12, 12' and 12", and the receiving material 30 employed. Especially it is important to determine the conditions of heat transfer steps taking into account the factors such as glass transition point, softening temperature, flowability, tackiness, film properties and film thickness of the transfer layer. Specifically, the conditions should be set so that the tackiness of the transfer layer increases and the transfer layer is closely adhered to the receiving material when the transfer layer softened to a certain extent by the pre-heating means is passed under the heating roller, and so that the temperature of the transfer layer is decreased to reduce the flowability and the tackiness after the transfer layer is subsequently passed under the cooling roller and thus the transfer layer together with the toner is peeled as a film from.

The cooling roller comprises a metal roller which has a good thermal conductivity such as aluminum, copper or the like and is covered with silicone rubber. It is preferred that the cooling roller is provided with a cooling means therein or on a portion of the outer surface which is not brought into contact with the receiving material in order to radiate heat. The cooling means includes a cooling fan, a coolant circulation or a thermoelectric cooling element, and it is preferred that the cooling means is coupled with a temperature controller so that the temperature of the cooling roller is maintained within a predetermined range.

As described in detail above, color images of high accuracy and high quality free from color shear can be obtained in a simple and stable manner by providing a transfer layer 12 on a light-sensitive element 11 in an electrophotographic color image forming method using an intermediate medium (primary receptor) 20 according to the present invention. A color duplicate obtained is excellent in storage stability.

By further providing a peelable transfer layer 12' or 12" on a toner image 3 formed on the transfer layer 12 or on the primary receptor 20, as a second transfer layer, various conditions requested for the transfer layer can be dividedly fulfilled by each layer depending on its function, and storage stability of toner image 3 is further improved.

Since the transfer layer 12, 12' or 12" can be formed each time on the light-sensitive element 11 or primary receptor 20 in an electrophotographic apparatus for forming toner image in the present invention, the light-sensitive element 11 and primary receptor 20 are repeatedly employed, thereby reducing a running cost. Also, such a system can be practically performed by a color image forming apparatus of a simple construction.

Further, by appropriately selecting a resin for constituting the transfer layer 12, 12' or 12", the transferability is further improved, a latitude of condition at the transfer is increased and a good color image can be reproduced irrespective of the kind of final receiving material 30. It is also possible to provide a retouching property and sealing property similar to those of normal paper to a color duplicate obtained.

Moreover, the releasability of transfer layer can be further improved to provide a better image taking the surface releasability of light-sensitive element 11 and primary receptor 20 and the composition of the transfer layer 12, 12' or 12" into consideration.

Furthermore, a light-sensitive element having the surface of releasability can be easily obtained by causing the specific compound (S) for imparting the releasability to adsorb or adhere to the light-sensitive element 11 before the formation of toner image.

Also, the impartation of releasability to the surface of light-sensitive element and the formation of transfer layer are simultaneously performed by electrodeposition or adhesion of resin grains on the light-sensitive element 11 using a dispersion for electrodeposition containing the compound (S). By conducting such methods, a conventional electrophotographic light-sensitive element can be employed, thereby further reducing a running cost.

Further, by providing a layer of thermoplastic resin on the surface of final receiving material used, adhesion of the final receiving material 30 to the toner image 3 and transfer layer 12, 12' or 12" on the primary receptor 20 is increased and thus the transferability is further improved.

Preferred embodiments of the present invention include the following.

(1) A method of forming a color image comprising forming at least one color toner image on a peelable transfer layer provided on the surface of an electrophotographic light-sensitive element whose surface has releasability by an electrophotographic process, transferring the toner image together with the transfer layer onto a primary receptor, and transferring the toner image together with the transfer layer from the primary receptor onto a final receiving material.

(2) The method of forming a color image as described (1) above, wherein a peelable transfer layer is further provided on the toner image formed on the transfer layer.

(3) The method of forming a color image as described (1) above, wherein the primary receptor has a peelable transfer layer provided on the surface thereof.

(4) The method of forming a color image as described in (1) above, wherein the surface of electrophotographic light-sensitive element has an adhesive strength measured according to JIS Z 0237-1980 "Testing methods of pressure sensitive adhesive tapes and sheets" of not more than 100 gram-force, and the surface of primary receptor has the adhesive strength larger than that of the surface of electrophotographic light-sensitive element.

(5) The method of forming a color image as described in any of (1) to (3) above, wherein the peelable transfer layer(s) mainly contain a thermoplastic resin having a glass transition point of not more than 140° C. or a softening point of not more than 180° C.

(6) The method of forming a color image as described in (5) above, wherein the peelable transfer layer(s) mainly contains a resin (AH) having a glass transition point of from 30° C. to 140° C. or a softening point of from 35° C. to 180° C. and a resin (AL) having a glass transition point of not more than 40° C. or a softening point of not more than 45° C. and having the glass transition point or softening point at least 2° C. lower than that of the resin (AH).

(7) The method of forming a color image as described in any of (1) to (3) above, wherein the peelable transfer layer(s) are formed by at least one of a hot-melt coating method, a transfer method from release paper and an electrodeposition coating method.

(8) The method of forming a color image as described in (1) above, wherein the peelable transfer layer is formed by electrodepositing or electrostatically adhering grains mainly contain a thermoplastic resin grain (ARW) having a glass transition point of not more than 140° C. or a softening point of not more than 180° C. and containing at least one thermoplastic resin having a glass transition point of from 10° C. to 140° C. or a softening point of from 35° C. to 180° C. and at least one thermoplastic resin having a glass transition point of not more than 45° C. or a softening point of not more than 60° C.

(9) The method of forming a color image as described-in (1) above, wherein the electrophotographic light-sensitive element whose surface has releasability is caused by adsorption or adherence of a compound (S) containing at least a fluorine atom and/or a silicon atom onto its surface.

(10) The method of forming a color image as described in (1) above, wherein the peelable transfer layer is formed by means of electrodeposition or adhesion of resin grains (AR) by electrophoresis on the surface of electrophotographic light-sensitive element to form a film using a dispersion for electrodeposition comprising resin grains (AR) having a glass transition point of not more than 140° C. or a softening point of not more than 180° C. dispersed in an electrically insulating organic solvent having a dielectric constant of not more than 3.5 and at least one compound (S) which has a fluorine atom and/or a silicon atom and is soluble at least 0.01 g per 1.0 liter of the organic solvent.

(11) The method of forming a color image as described in (10) above, wherein the resin grains (AR) are supplied between the electrophotographic light-sensitive element and an electrode placed in face of the light-sensitive element and migrated by electrophoresis according to a potential gradient applied from an external power source to adhere to or electrodeposit on the electrophotographic light-sensitive element, to thereby form a film.

(12) The method of forming a color image as described in (1) above, wherein the final receiving material has a thermoplastic resin layer on its side to come into contact with the transfer layer.

(13) A method of forming a color image comprising performing the following steps (i) to (iv) in the same apparatus:

(i) a step of forming a peelable transfer layer on an electrophotographic light-sensitive element, (ii) a step of forming at least one color toner image on the transfer layer by an electrophotographic process, (iii) a step of transferring the toner image together with the transfer layer from the electrophotographic light-sensitive element onto a primary receptor, and (iv) a step of transferring the toner image together with the transfer layer onto a receiving material.

(14) The method of forming a color image as described in (13) above, wherein the following step (a) is performed between the step (ii) and the step (iii) in the same apparatus.

(a) a step of forming a second peelable transfer layer on the toner image.

(15) The method of forming a color image as described in (13) above, wherein the following step (b) is performed before the step (iii) in the same apparatus.

(b) a step of forming a second peelable transfer layer on the primary receptor.

(16) An apparatus for forming a color image comprising a means for forming a peelable transfer layer on the surface of an electrophotographic light-sensitive element, a means for forming at least one color toner image on the transfer layer by an electrophotographic process, a means for transferring the toner image together with the transfer layer onto a primary receptor and a means for transferring the toner image together with the transfer layer from the primary receptor onto a final receiving material.

(17) The apparatus for forming a color image as described in (16) above, which further comprises a means for forming a peelable second transfer layer on the toner image formed on the transfer layer.

(18) The apparatus for forming a color image as described in (16) above, which further comprises a means for forming a peelable second transfer layer on the primary receptor.

BRIEF DESCRIPTION OF THE DRAWINGS

FIG. 7 is a schematically partial view of a transfer step of transferring a toner image together with a transfer layer onto a primary receptor.

EXPLANATION OF THE SYMBOLS

Figure 1:
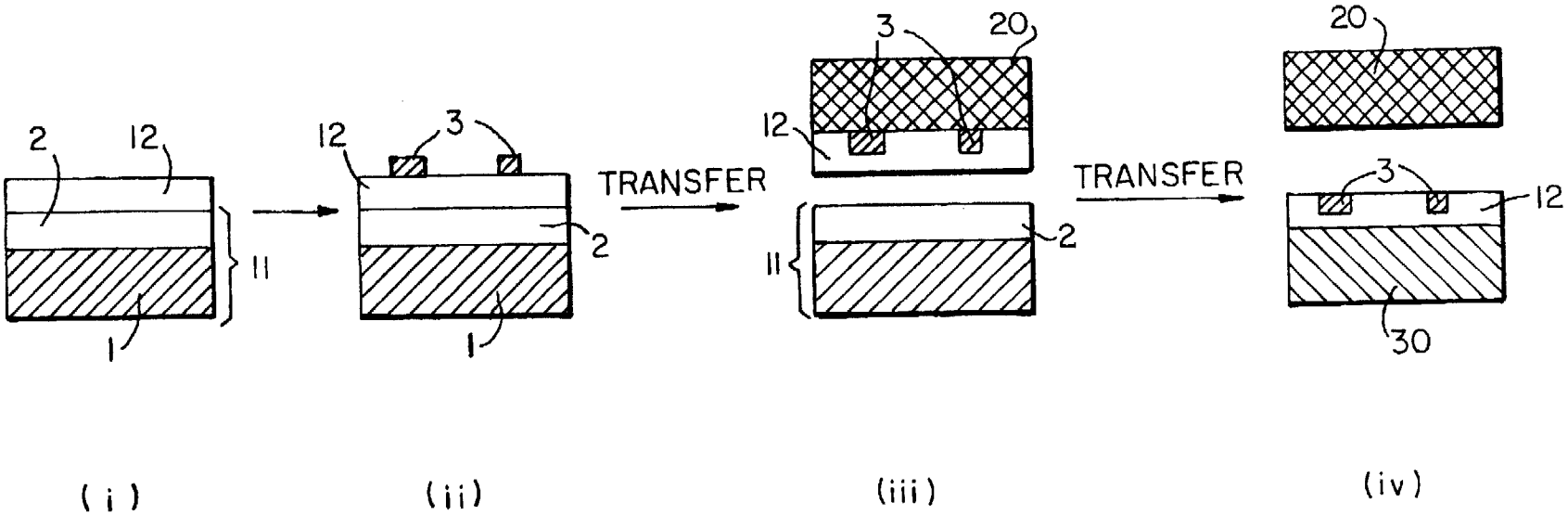
FIG. 1 is a schematic view for explanation of one example of the method according to the present invention.
Figure 2:
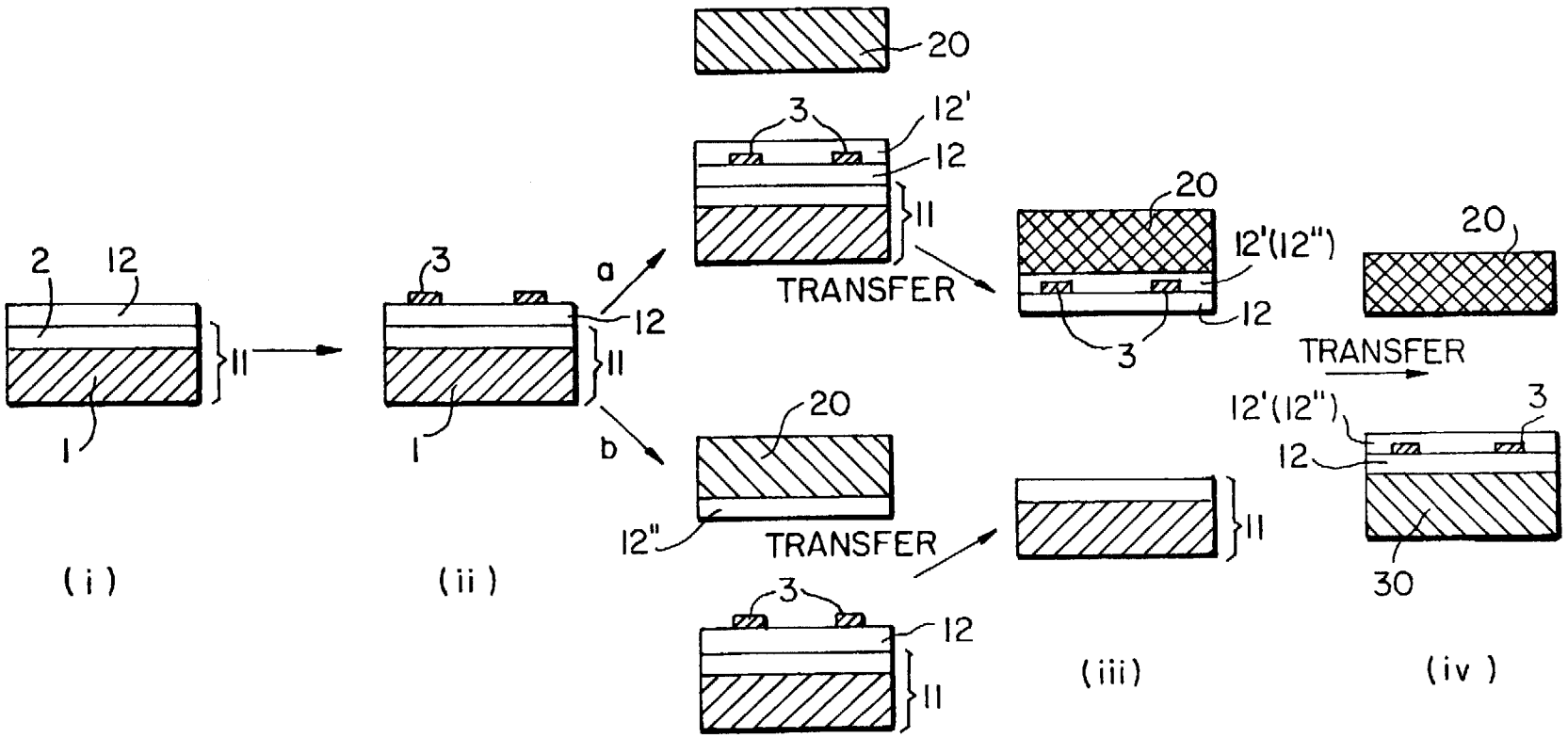
FIG. 2 is a schematic view for explanation of one example of the method according to the present invention.
Figure 3:
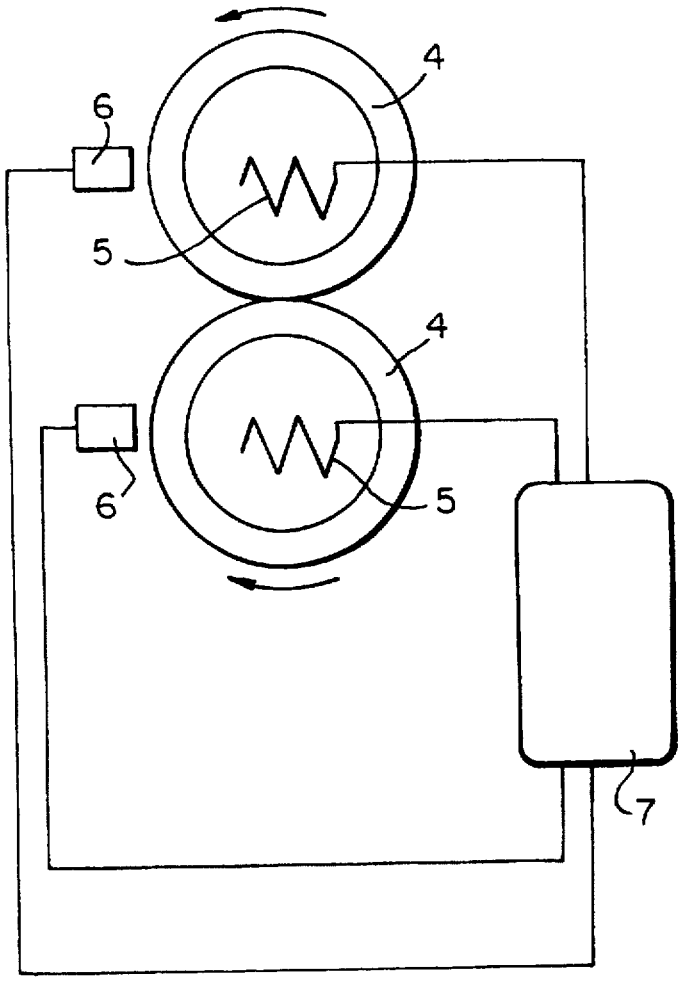
FIG. 3 is a schematic view of one example of a device for heat-transfer of transfer layer to a receiving material.

1 Support
2 Light-sensitive layer
3 Toner image
4 Roller covered with rubber
5 Heating means
6 Surface temperature detective means
7 Temperature controller
10 Applying device for compound (S)
11 Light-sensitive element
12 Transfer layer (layer of thermoplastic resin)
12' Transfer layer (layer of thermoplastic resin)
12" Transfer layer (layer of thermoplastic resin)
**12*a*** Thermoplastic resin
13 Hot-melt coater
**13*a*** Stand-by position of hot-melt coater
14 Liquid developing unit set
14' Electrodeposition.developing unit set
**14*y*** Yellow liquid developing unit 14*m* Magenta liquid developing unit
14*c* Cyan liquid developing unit
14*k* Black liquid developing unit
14R Squeezing unit
14T Electrodeposition unit
15 Suction/exhaust unit
15*a* Suction part
15*b* Exhaust part
16 Pre-heating means
17 Temperature controlling means
18 Corona charger
19 Drawing device with semiconductor laser
20 Primary receptor
21 Transfer layer-forming device
24 Release paper
25*a* Pre-heating means
25*b* Heating roller
25*c* Cooling roller
30 Final receiving material
31 Back-up roller for transfer
32 Back-up roller for release
110 Part for applying compound (S)
120 Part for formation of transfer layer on primary receptor
130 Part for transfer onto final receiving material

BEST MODE FOR CONDUCTING THE INVENTION

The present invention is illustrated in greater detail with reference to the following examples, but the present invention is not to be construed as being limited thereto.

Synthesis Examples of Resin Grain (AR) for Transfer Layer

SYNTHESIS EXAMPLE 1 OF THERMOPLASTIC RESIN GRAIN (AR): (AR-1)

A mixed solution of 15 g of Dispersion Stabilizing Resin (Q-1) having the structure shown below, 100 g of vinyl acetate, and 384 g of Isopar was heated to a temperature of 70° C. under nitrogen gas stream while stirring.

Dispersion Stabilizing Resin (Q-1)

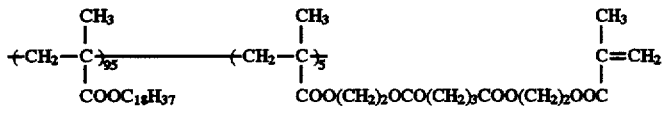

Mw $4\times10^4$

To the solution was added 0.8 g of 2,2'-azobis (isovaleronitrile) (abbreviated as AIVN) as a polymerization initiator, followed by reacting for 3 hours. Twenty minutes after the addition of the polymerization initiator, the reaction mixture became white turbid, and the reaction temperature rose to 88° C. Then, 0.5 g of the above-described initiator was addec to the reaction mixture, the reaction were carried out for 2 hours. The temperature was raised to 100° C. and stirred for 2 hours to remove the unreacted vinyl acetate by distillation. After cooling, the reaction mixture was passed through a nylon cloth of 200 mesh to obtain a white dispersion which was a latex of good monodispersity with a polymerization ratio of 90% and an average grain diameter of 0.17 μm. The grain diameter was measured by CAPA-500 manufactured by Horiba Ltd.

A part of the above-described white dispersion was centrifuged at a rotation of $1\times10^4$ r.p.m. for 60 minutes and the resin grains precipitated were collected and dried. A weight average molecular weight (Mw) and a glass transition point (Tg) of the resin grain were measured (Mw and Tg of resin grain being measured in the same manner hereinafter).

Mw: $2\times10^5$ (measured by a GPC method and calculated in terms of polystyrene)

Tg: 38° C.

SYNTHESIS EXAMPLE 2 OF RESIN GRAIN (AR): (AR-2)

A mixed solution of 18 g of Dispersion Stabilizing Resin (Q-2) having the structure shown below and 553 g of Isopar H was heated to a temperature of 55° C. under nitrogen gas stream while stirring.

Dispersion Stabilizing Resin (Q-2)

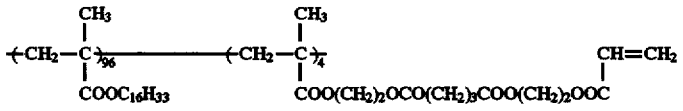

Mw $4\times10^4$

To the solution was added dropwise a mixture of 60 g of methyl methacrylate, 40 g of methyl acrylate, 1.3 g of methyl 3-mercaptopropionate and 1.0 g of 2,2'-azobis(2-cycropropionitrile) (abbreviated as ACPP) over a period of 30 minutes, followed by reacting for 1.5 hours. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of ACPP, followed by reacting for 2 hours.

After cooling, the reaction mixture was passed through a nylon cloth of 200 mesh to obtain a white dispersion which was a latex of good monodispersity with a polymerization ratio of 99% and an average grain diameter of 0.15 μm. An Mw of the resin grain was $1.5\times10^4$ and a Tg thereof was 45° C.

SYNTHESIS EXAMPLE 3 OF RESIN GRAIN (AR): (AR-3)

A mixed solution of 14 g of Dispersion Stabilizing Resin (Q-3) having the structure shown below, 10 g of a monofunctional macromonomer (FM-0725 manufactured of Chisso Corp.) (Macromonomer (M-1)) and 553 g of Isopar H was heated to a temperature of 50° C. under nitrogen gas stream while stirring. To the solution was added dropwise a mixture of 70 g of methyl methacrylate, 20 g of ethyl acrylate, 1.3 g of methyl 3-mercaptopropionate and 1.0 g of ACPP over a period of 30 minutes, followed by reacting for 1.5 hours. To the reaction mixture was further added 0.8 g of ACPP, followed by reacting for 2 hours. Then, 0.8 g of AIVN was added thereto and the temperature was adjusted to 80° C., and the reaction was continued for 2 hours. To the reaction mixture was further added 0.5 g of ACPP, followed by reacting for 2 hours. After cooling, the reaction mixture was passed through a nylon cloth of 200 mesh to obtain a white dispersion which was a latex of good monodispersity with a polymerization ratio of 99% and an average grain diameter of 0.18 μm. An Mw of the resin grain was $2\times10^4$ and a Tg thereof was 50° C.

Dispersion Stabilizing Resin (Q-3)

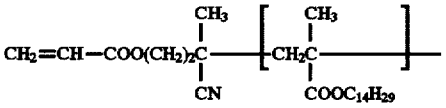

Mw $3.5\times10^4$

SYNTHESIS EXAMPLES 4 TO 17 OF RESIN GRAIN (AR): (AR-4) TO (AR-17)

Each of the resin grains (AR) was synthesized in the same manner as in Synthesis Example 2 of Resin Grain (AR) except for using each of the monomers shown in Table A below in place of 80 g of methyl methacrylate and 20 g of ethyl acrylate employed in Synthesis Example 2 of Resin Grain (AR).

An average grain diameter of each of the resin grains obtained was in a range of from 0.15 μm to 0.25 μm and each of the resin grains exhibited good monodispersity. An Mw of each of the resin grains was in a range of $9\times10^3$ to $2\times10^4$ and a Tg thereof was in a range of from 35° C. to 65° C.

TABLE A

| Synthesis Example | Resin Grain (AR) | Monomer | Weight Ratio |
|---|---|---|---|
| 4 | AR-4 | Methyl methacrylate | 85 |
| | | Butyl acrylate | 15 |
| 5 | AR-5 | Methyl methacrylate | 50 |
| | | Butyl methacrylate | 50 |
| 6 | AR-6 | Benzyl methacrylate | 60 |
| | | Benzyl acrylate | 40 |
| 7 | AR-7 | Methyl methacrylate | 70 |
| | | 2,3-Diacetoxypropyl methacrylate | 30 |
| 8 | AR-8 | Benzyl methacrylate | 70 |
| | | 2-Hexyloxyethyl methacrylate | 30 |
| 9 | AR-9 | Vinyl acetate | 80 |
| | | Vinyl benzoate | 20 |
| 10 | AR-10 | Methyl methacrylate | 75 |
| | | Methyl acrylate | 25 |
| 11 | AR-11 | Styrene | 75 |
| | | Vinyl toluene | 25 |
| 12 | AR-12 | Vinyl acetate | 98 |
| | | Crotonic acid | 2 |
| 13 | AR-13 | Methyl methacrylate | 65 |
| | | Ethyl methacrylate | 30 |
| | | Acrylonitrile | 5 |
| 14 | AR-14 | Ethyl methacrylate | 77.5 |
| | | Methyl acrylate | 20 |
| | | N-Vinylpyrrolidone | 2.5 |
| 15 | AR-15 | Methyl methacrylate | 65 |
| | | 2-Ethoxycarbonylethyl methacrylate | 35 |
| 16 | AR-16 | Methyl methacrylate | 67 |
| | | Methyl acrylate | 30 |
| | | Acrylic acid | 3 |
| 17 | AR-17 | 3-Phenylpropyl methacrylate | 50 |
| | | Butyl methacrylate | 50 |

SYNTHESIS EXAMPLES 18 TO 23 OF THERMOPLASTIC RESIN GRAIN (AR): (AR-18) TO (AR-23)

Each of the resin grains (AR-18) to (AR-23) was synthesized in the same manner as in Synthesis Example 3 of Resin Grain (AR) except for using each of the macromonomers shown in Table B below in place of 10 g of Macromonomer (M-1) employed in Synthesis Example 3 of Resin Grain (AR). A polymerization ratio of each of the resin grains was in a range of from 98 to 99% and an average grain diameter thereof was in a range of from 0.15 to 0.25 μm with good monodispersity of a narrow size distribution. An Mw of each of the resin grains was in a range of from $2.5\times10^4$ to $4\times10^4$ and a Tg thereof was in a range of from 35° C. to 70° C.

TABLE B

| Synthesis Example | Resin Grain (ARH) | Macromonomer (M) |
|---|---|---|
| 18 | AR-18 | (M-2) 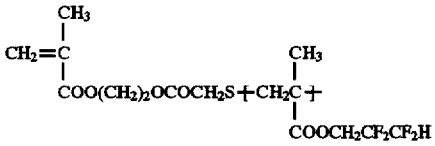 |
| 19 | AR-19 | (M-3) 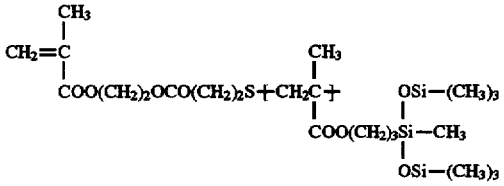 |
| 20 | AR-20 | (M-4) 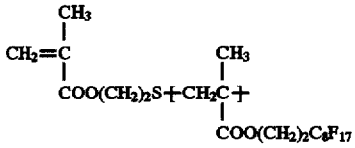 |
| 21 | AR-21 | (M-5) 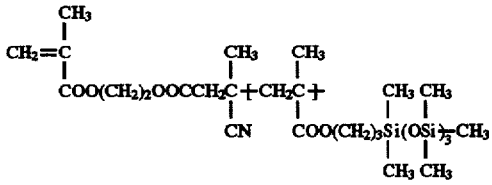 |
| 22 | AR-22 | (M-6) 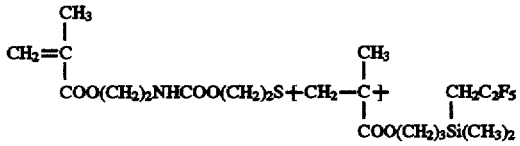 |
| 23 | AR-23 | (M-7) 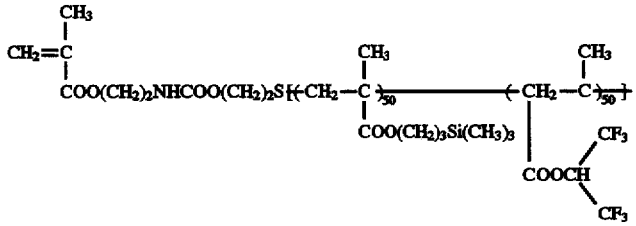 |

SYNTHESIS EXAMPLE 24 OF RESIN GRAIN (AR): (AR-24)

A mixture of 12 g of Dispersion Stabilizing Resin (Q-1) described above, 70 g of vinyl acetate, 30 g of vinyl butyrate and 388 g of Isopar H was heated to a temperature of 80° C. under nitrogen gas stream while stirring. To the solution was added 1.5 g of 2,2'-azobis(isobutyronitrile) (abbreviated as AIBN) as a polymerization initiator, followed by reacting for 2 hours. To the reaction mixture was added 0.8 g of AIBN, followed by reacting for 2 hours. Further, 0.8 g of AIBN, followed by reacting for 2 hours. After cooling the reaction mixture was passed through a nylon cloth of 200 mesh to obtain a white dispersion which was a latex of good monodispersity with a polymerization ratio of 93% and an average grain diameter of 0.18 μm. An Mw of the resin grain was $8\times10^4$ and a Tg thereof was 18° C.

SYNTHESIS EXAMPLES 25 TO 38 OF RESIN GRAIN (AR): (AR-25) to (AR-38)

Each of the resin grains (AR) was synthesized in the same manner as in Synthesis Example 2 of Resin Grain (AR) except for using each of the monomers shown in Table C below in place of 60 g of methyl methacrylate and 40 g methyl acrylate employed in Synthesis Example 2 of Resin Grain (AR). A polymerization ratio of each of the white dispersions which were latexes obtained was in a range of from 90 to 99% and an average grain diameter thereof was in a range of from 0.13 to 0.20 μm with good monodispersity. A Tg of each of the resin grains was in a range of from 10° C. to 25° C.

TABLE C

| Synthesis Example | Resin Grain (AR) | Monomer | Weight Ratio |
|---|---|---|---|
| 25 | AR-25 | Vinyl acetate | 75 |
| | | Vinyl propionate | 25 |
| 26 | AR-26 | Vinyl acetate | 80 |
| | | Vinyl laurate | 20 |
| 27 | AR-27 | Methyl methacrylate | 40 |
| | | Methyl acrylate | 60 |
| 28 | AR-28 | Methyl methacrylate | 60 |
| | | 2-Ethylhexyl methacrylate | 40 |
| 29 | AR-29 | Methyl methacrylate | 60 |
| | | 2,3-Dibutoxycarbonylpropyl acrylate | 40 |
| 30 | AR-30 | Methyl methacrylate | 50 |
| | | 2-Pentaoxyethyl methacrylate | 50 |
| 31 | AR-31 | Strene | 60 |
| | | Vinyl toluene | 40 |
| 32 | AR-32 | Phenethyl methacrylate | 60 |
| | | Ethyl acrylate | 40 |
| 33 | AR-33 | Phenyl methacrylate | 60 |
| | | 3-Butoxycarbonylpropyl methacrylate | 40 |
| 34 | AR-34 | Methyl methacrylate | 45 |
| | | Methyl acrylate | 50 |
| | | Macromonomer (M-5) | 5 |
| 35 | AR-35 | Methyl methacrylate | 40 |
| | | Propyl methacrylate | 30 |
| | | Methyl acrylate | 30 |
| 36 | AR-36 | Vinyl acetate | 70 |
| | | Methyl vinyl ether | 5 |
| | | Vinyl butyrate | 25 |
| 37 | AR-37 | Methyl methacrylate | 60 |
| | | Diethyleneglycol monomethylether monomethacrylate | 40 |
| 38 | AR-38 | Methyl methacrylate | 55 |
| | | 3-Methoxycarbonylpropyl acrylate | 45 |

SYNTHESIS EXAMPLE 1 OF RESIN GRAIN (ARW) FOR TRANSFER LAYER: (ARW-1)

Resin Grain (AR-24) was synthesized according to Synthesis Example 24 of Resin Grain (AR) for Transfer Layer.

A mixed solution of the whole amount of the above-described resin grain dispersion (as seed) and 10 g of Dispersion Stabilizing Resin (Q-2) described above was heated to a temperature of 60° C. under nitrogen gas stream with stirring. To the mixture was added dropwise a mixture of 60 g of methyl methacrylate, 40 g of methyl acrylate, 2.0 g of methyl 3-mercaptopropionate, 0.8 g of AIVN and 400 g of Isopar G over a period of 2 hours, followed by further reacting for 2 hours. Then 0.8 g of AIVN was added to the reaction mixture, the temperature thereof was raised to 70° C., and the reaction was conducted for 2 hours. Further, 0.6 g of AIVN was added thereto, followed by reacting for 3 hours. After cooling, the reaction mixture was passed through a nylon cloth of 200 mesh to obtain a white dispersion which was a latex of good monodispersity having a polymerization ratio of 98% and an average grain diameter of 0.25 μm.

In order to investigate that the resin grain thus-obtained was composed of the two kinds of resins, the state of resin grain was observed using a scanning electron microscope (SEM).

Specifically, the dispersion of Resin Grain (ARW-1) was applied to a polyethylene terephthalate film so that the resin grains were present in a dispersive state on the film, followed by heating at a temperature of 50° C. or 80° C. for 5 minutes to prepare a sample. Each sample was observed using a scanning electron microscope (JSL-T330 Type manufactured by JEOL Co., Ltd.) of 20,000 magnifications. As a result, the resin grains were observed with the sample heated at 50° C. On the contrary, with the sample heated at 80° C. the resin grains had been melted by heating and were not observed.

The state of resin grain was observed in the same manner as described above with respect to resin grains formed from respective two kinds of resins (copolymers) constituting Resin Grain (ARW-1), i.e., Resin Grain (AR-2) having a Tg of 45° C. and Resin Grain (AR-24) having a Tg of 18° C., and a mixture of these resin grains in a weight ratio of 1:1. As a result, it was found that with Resin Grain (AR-24), the resin grains were not observed in the sample heated at 50° C., although the resin grains were observed in the sample before heating. On the other hand, with Resin Grain (AR-2), the resin grains were not observed in the sample heated at 80° C. Further, with the mixture of two kinds of resin grains, disappearance of the resin grains was observed in the sample heated at 50° C. in comparison with the sample before heating.

From these results it was confirmed that Resin Grain (ARW-1) described above was not a mixture of two kinds of resin grains but contained two kinds of resins therein, and had a core/shell structure wherein the resin having a relatively high Tg formed shell portion and the resin having a relatively low Tg formed core portion.

The structure of resin grains is not particularly limited and includes a core/shell structure composed of the resin (AH) having a relatively high Tg and the resin (AL) having a relatively low Tg as described above, a core/shell structure composed of a combination of an inverse order of the resins or a structure composed of a mixture of the resins without localization.

SYNTHESIS EXAMPLES 2 TO 8 OF RESIN GRAIN (ARW): (ARW-2) TO (ARW-8)

Each of Resin Grains (ARW-2) to (ARW-8) was synthesized in the same manner as in Synthesis Example 1 of Resin Grain (ARW) except for using each of the monomers shown in Table D below in place of the monomers employed in Synthesis Example 1 of Resin Grain (ARW). A polymerization ratio of each of the resin grains obtained in latexes was in a range of from 95 to 99% and an average grain diameter thereof was in a range of from 0.20 to 0.30 μm with good monodispersity.

TABLE D

| Synthesis Example | Resin Grain (ARW) | Monomer for Seed Grain | Weight Ratio | Monomer for Feeding | Weight Ratio |
|---|---|---|---|---|---|
| 2 | ARW-2 | Methyl methacrylate | 60 | Methyl methacrylate | 70 |
| | | Butyl acrylate | 40 | 2-Propoxyethyl methacrylate | 30 |
| 3 | ARW-3 | Methyl methacrylate | 30 | Vinyl acetate | 100 |
| | | Methyl acrylate | 70 | | |

TABLE D-continued

| Synthesis Example | Resin Grain (ARW) | Monomer for Seed Grain | Weight Ratio | Monomer for Feeding | Weight Ratio |
|---|---|---|---|---|---|
| 4 | ARW-4 | Phenethyl methacrylate | 70 | Methyl methacrylate | 60 |
| | | 2-Butoxyethyl methacrylate | 30 | 2-(2-Butoxyethyloxy)ethyl methacrylate | 40 |
| 5 | ARW-5 | Vinyl acetate | 80 | Methyl methacrylate | 65 |
| | | Vinyl valerate | 20 | Methyl acrylate | 35 |
| 6 | ARW-6 | Methyl methacrylate | 60 | 3-Phenylpropyl methacrylate | 70 |
| | | 2,3-Dibutyroyloxypropyl methacrylate | 40 | 3-Propoxypropyl methacrylate | 30 |
| 7 | ARW-7 | Methyl methacrylate | 40 | 2-Phenoxyethyl methacrylate | 60 |
| | | 2-Butoxycarbonylethyl methacrylate | 60 | Methyl methacrylate | 40 |
| 8 | ARW-8 | Ethyl methacrylate | 50 | Methyl methacrylate | 70 |
| | | Methyl methacrylate | 50 | 2-Methoxyethyl acrylate | 25 |
| | | | | Macromonomer (M-4) | 5 |

SYNTHESIS EXAMPLE 9 OF RESIN GRAIN (ARW): (ARW-9)

A mixture of resins (A) comprising a vinyl acetate/ethylene (46/54 by weight ratio) copolymer (Evaflex 45× manufactured by Du Pont-Mitsui Polychemicals Co., Ltd.) having a Tg of −25° C. and polyvinyl acetate having a Tg of 38° C. in a weight ratio of 11 was melted and kneaded by a three-roll mill at a temperature of 120° C. and then pulyerized by a trio-blender. A mixture of 5 g of the resulting coarse powder, 4 g of a dispersion stabilizing resin (Sorprene 1205 manufactured by Asahi Kasei Kogyo Kabushiki Kaisha) and 51 g of Isopar H was dispersed in a paint shaker (manufactured by Toyo Seiki Seisakusho Co.) with glass beads having a diameter of about 4 mm for 20 minutes. The resulting pre-dispersion was subjected to a wet type dispersion process using Dyno-mill KDL (manufactured by Sinmaru Enterprises Co., Ltd.) with glass beads having a diameter of from 0.75 to 1 mm at a rotation of 4500 r.p.m. for 6 hours, and then passed through a nylon cloth of 200 mesh to obtain a white dispersion which was a latex having an average grain diameter of 0.4 μm.

SYNTHESIS EXAMPLES 10 TO 14 OF RESIN GRAIN (ARW): (ARW-10) TO (ARW-14)

Each dispersion was prepared according to a wet type dispersion process in the same manner as in Synthesis Example 9 of Resin Grain (ARW) except for using each of the compounds shown in Table E below in place of two kinds of the resins (A) employed in Synthesis Example 9 of Resin Grain (ARW). An average grain diameter of each of the white dispersion obtained was in a range of from 0.3 to 0.6 μm.

TABLE E

| Synthesis Example | Resin Grain (ARW) | Resin for Transfer Layer |
|---|---|---|
| 10 | ARW-10 | Mixture of cellulose acetate butyrate (Cellidor Bsp manufactured by Bayer AG) and vinyl acetate/crotonic a (99/1 by weight ratio) copolymer in a weight ratio of 60:40 |
| 11 | ARW-11 | Mixture of styrene/butadiene copolymer (Sorprene 1204 manufactured by Asahi Kasei Kogyo Kabushiki Kaisha) and styrene/vinyl acetate (20/80 by weight ratio) copolymer in a weight ratio of 50:50 |
| 12 | ARW-12 | Mixture of polyvinyl butyral resin (S-Lec manufactured by Sekisui Chemical Co., Ltd.) and cellulose propionate (Cellidoria manufactured by Daicel Co., Ltd. in a weight ratio of 70:30 |
| 13 | ARW-13 | Mixture of polyester resin (Chemit R-185 manufactured by Toray Co., Ltd.) and methyl methacrylate/butyl acrylate (60/40 by weight ratio) AB block copolymer in a weight ratio of 50:50 |
| 14 | ARW-14 | Mixture of polydecamethylene terephthalate and polypentamethylene carbonate in a weight ratio of 30:70 |

Synthesis Examples of Resin (P)

SYNTHESIS EXAMPLE 1 OF RESIN (P): (P-1)

A mixed solution of 80 g of methyl methacrylate, 20 g of a dimethylsiloxane macromonomer (FM-0725 manufactured by Chisso Corp.; Mw: $1\times10^4$), and 200 g of toluene was heated to a temperature of 75° C. under nitrogen gas stream. To the solution was added 1.0 g of AIBN, followed by reacting for 4 hours. To the mixture was further added 0.7 g of AIBN, and the reaction was continued for 4 hours. An Mw of the copolymer thus-obtained was $5.8\times10^4$ (measured by a GPC method).

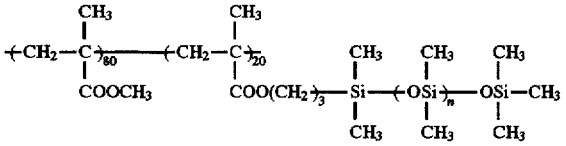
SYNTHESIS EXAMPLES 2 TO 9 OF RESIN (P): (P-2) TO (P-9)
Each of copolymers was synthesized in the same manner as in Synthesis Example 1 of Resin (P), except for replacing methyl methacrylate and the macromonomer (FM-0725) with each monomer corresponding to the polymer component shown in Table F below. An Mw of each of the resulting polymers was in a range of from $4.5\times10^4$ to $6\times10^4$.

TABLE F
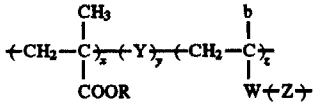
| Synthesis Example of Resin (P) | Resin (P) | −R | −Y− | -b | −W− | −Z− | x/y/z (weight ratio) |
|---|---|---|---|---|---|---|---|
| 2 | P-2 | $-C_2H_5$ | 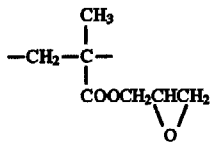 | $-CH_3$ | $-COO(CH_2)_2S-$ | 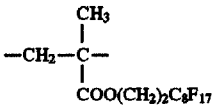 | 65/15/20 |
| 3 | P-3 | $-CH_3$ | 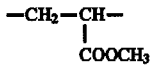 | $-H$ | 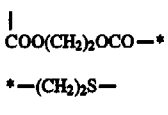 | 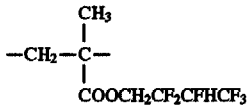 | 60/10/30 |
| 4 | P-4 | $-CH_3$ | 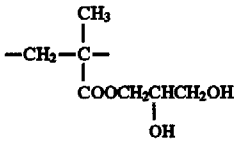 | $-CH_3$ | 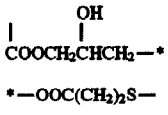 | 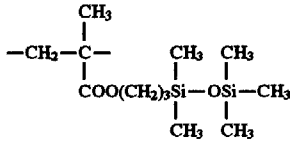 | 65/10/25 |
| 5 | P-5 | $-C_3H_7$ | 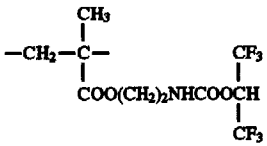 | $-CH_3$ | 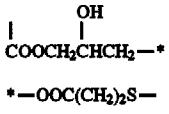 | 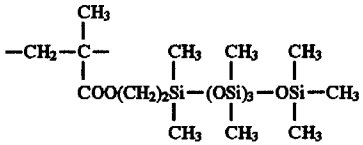 | 65/15/20 |
| 6 | P-6 | $-CH_3$ | 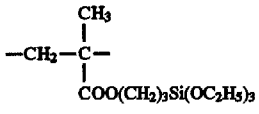 | $-CH_3$ | 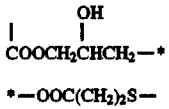 | 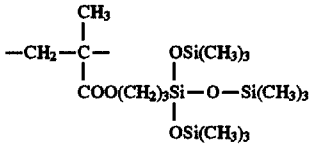 | 50/20/30 |
| 7 | P-7 | $-C_2H_5$ | 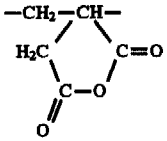 | $-H$ | $-CONH(CH_2)_2S-$ | 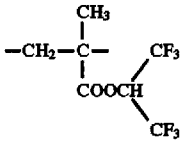 | 57/8/35 |

TABLE F-continued $$\left(CH_2-\underset{\underset{COOR}{|}}{\overset{\overset{CH_3}{|}}{C}}\right)_x\left(Y\right)_y\left(CH_2-\underset{\underset{W(Z)}{|}}{\overset{\overset{b}{|}}{C}}\right)_z$$

| Synthesis Example of Resin (P) | Resin (P) | −R | −Y− | -b | −W− | −Z− | x/y/z (weight ratio) |
|---|---|---|---|---|---|---|---|
| 8 | P-8 | $-CH_3$ | $-CH_2-\underset{\underset{CONH(CH_2)_6OH}{\vert}}{CH}-$ | $-H$ | $\underset{\underset{*-(CH_2)_2S-}{\vert}}{COO(CH_2)_2OCO-*}$ | $-CH_2-\underset{\underset{CONHC_{17}F_{35}}{\vert}}{CH}-$ | 70/15/15 |
| 9 | P-9 | $-C_2H_5$ | $-CH_2-\underset{\underset{COO(CH_2)_2NHCO\overset{\overset{COCH_3}{\vert}}{\underset{\underset{COCH_3}{\vert}}{CH}}}{\vert}}{\overset{\overset{CH_3}{\vert}}{C}}-$ | $-CH_3$ | $\underset{\underset{*-(CH_2)_2S-}{\vert}}{COO(CH_2)_2OCO-*}$ | $-CH_2-\underset{\underset{COO(CH_2)_3SO_2NHC_{12}F_{25}}{\vert}}{\overset{\overset{CH_3}{\vert}}{C}}-$ | 60/20/20 |

SYNTHESIS EXAMPLE 10 OF RESIN (P): (P-10)

A mixed solution of 60 g of 2,2,3,4,4,4-hexafluorobutyl methacrylate, 40 g of a methyl methacrylate macromonomer (AA-6 manufactured by Toagosei Chemical Industry Co., Ltd.; Mw: $1\times10^4$), and 200 g of benzotrifluoride was heated to a temperature of 75° C. under nitrogen gas stream. To the solution was added 1.0 g of AIBN, followed by reacting for 4 hours. To the mixture was further added 0.5 g of AIBN, and the reaction was continued for 4 hours. An Mw of the copolymer thus-obtained was $6.5\times10^4$.

Resin (P-10)

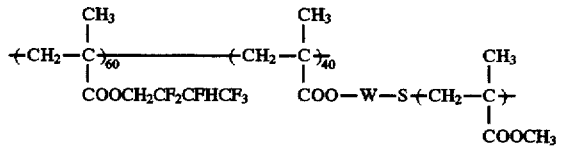

—W—: an organic residue (unknown)

SYNTHESIS EXAMPLES 11 TO 15 OF RESIN (P): (P-11) TO (P-15)

Each of copolymers was synthesized in the same manner as in Synthesis Example 10 of Resin (P), except for replacing the monomer and the macromonomer used in Synthesis Example 10 of Resin (P) with each monomer and each macromonomer both corresponding to the polymer components shown in Table G below. An Mw of each of the resulting copolymers was in a range of from $4.5\times10^4$ to $6.5\times10^4$.

TABLE G

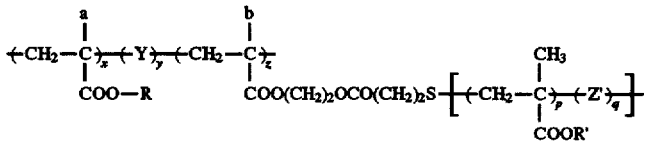

| Synthesis Example of Resin (P) | Resin (P) | -a | —R | —Y— | -b |
|---|---|---|---|---|---|
| 11 | P-11 | $-CH_3$ | $\leftarrow(CH_2)_2C_nF_{2n+1}$ n = 8~10 | — | $-CH_3$ |
| 12 | P-12 | $-CH_3$ | $\leftarrow(CH_2)_2CF_2CFHCF_3$ | — | —H |

| Synthesis Example of Resin (P) | —R' | —Z'— | x/y/z (weight ratio) | p/q (weight ratio) |
|---|---|---|---|---|
| 11 | $-CH_3$ | 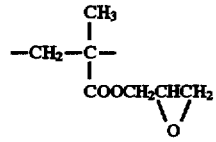 | 70/0/30 | 70/30 |
| 12 | $-CH_3$ | 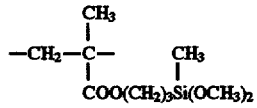 | 60/0/40 | 70/30 |

| Synthesis Example of Resin (P) | Resin (P) | -a | —R | —Y— | -b |
|---|---|---|---|---|---|
| 13 | P-13 | $-CH_3$ | $-CH_2CF_2CF_2H$ | 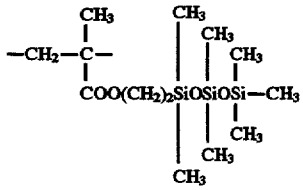 | $-CH_3$ |
| 14 | P-14 | —H | $-CH_2CF_2CFHCF_3$ | 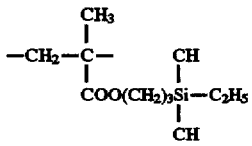 | $-CH_3$ |

TABLE G-continued

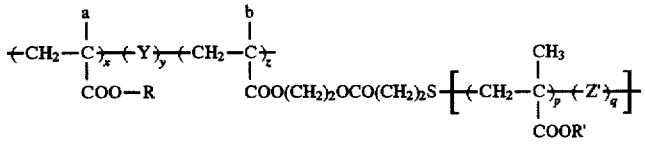

| Synthesis Example of Resin (P) | −R' | −Z'− | x/y/z (weight ratio) | p/q (weight ratio) |
|---|---|---|---|---|
| 13 | — | $-CH_2-C(CH_3)(COOCH_2CH-CH_2)-$ | 40/30/30 | 90/10 |
| 14 | $-C_2H_5$ | $-CH_2-C(CH_3)(COO(CH_2)_2OH)-$ | 30/45/25 | 60/40 |

| Synthesis Example of Resin (P) | Resin (P) | -a | −R | −Y− | -b |
|---|---|---|---|---|---|
| 15 | P-15 | $-CH_3$ | $-(CH_2)_3Si(CH_3)(Si(CH_3)_3)Si(CH_3)_2-CH_3$ | — | $-CH_3$ |

| Synthesis Example of Resin (P) | −R' | −Z'− | x/y/z (weight ratio) | p/q (weight ratio) |
|---|---|---|---|---|
| 15 | $-C_2H_5$ | $-CH_2-CH(COOH)-$ | 80/0/20 | 90/10 |

SYNTHESIS EXAMPLE 16 OF RESIN (P): (P-16)

A mixed solution of 67 g of methyl methacrylate, 22 g of methyl acrylate, 1 g of methacrylic acid, and 200 g of toluene was heated to a temperature of 80° C. under nitrogen gas stream. To the solution was added 10 g of Polymer Azobis Initiator (PI-1) having the structure shown below, followed by reacting for 8 hours. After completion of the reaction, the reaction mixture was poured into 1.5 l of methanol, and the precipitate thus-deposited was collected and dried to obtain 75 g of a copolymer having an Mw of $3\times10^4$.

Polymer Initiator (PI-1)

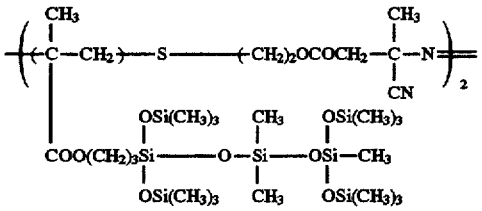

-continued

Polymer (P-16)

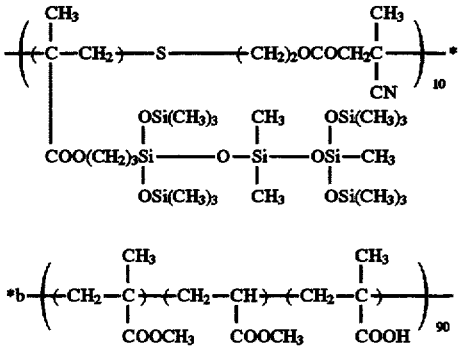

-b-: a bond between blocks

SYNTHESIS EXAMPLE 17 OF RESIN (P): (P-17)

A mixed solution of 70 g of methyl methacrylate and 200 g of tetrahydrofuran was thoroughly degassed under nitrogen gas stream and cooled to −20° C. To the solution was added 0.8 g of 1,1-diphenylbutyl lithium, followed by reacting for 12 hours. To the reaction mixture was then added a mixed solution of 30 g of Monomer (m-1) shown below and 60 g of tetrahydrofuran which had been thoroughly degassed under nitrogen gas stream, followed by reacting for 8 hours.

After rendering the mixture to 0° C., 10 ml of methanol was added thereto to conduct a reaction for 30 minutes to stop the polymerization. The resulting polymer solution was heated to a temperature of 30° C. with stirring, and 3 ml of a 30% ethanol solution of hydrogen chloride was added thereto, followed by stirring for 1 hour. The reaction mixture was distilled under reduced pressure to remove the solvent until the volume was reduced to half and the residue was reprecipitated in 1 l of petroleum ether. The precipitate was collected and dried under reduced pressure to obtain 76 g of a polymer having an Mw of $6.8\times10^4$.

Monomer (m-1)

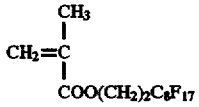

Resin (P-17)

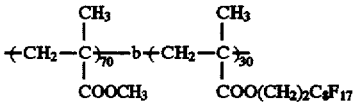

SYNTHESIS EXAMPLE 18 OF RESIN (P): (P-18)

A mixed solution of 52.5 g of methyl methacrylate, 22.5 g of methyl acrylate, 0.5 g of methylaluminum tetraphenylporphynate, and 200 g of methylene chloride was heated to a temperature of 30° C. under nitrogen gas stream. The solution was irradiated with light from a xenon lamp of 300 W at a distance of 25 cm through a glass filter for 20 hours. To the mixture was added 25 g of Monomer (m-2) shown below, and the resulting mixture was further irradiated with light under the same conditions as above for 12 hours. To the reaction mixture was added 3 g of methanol, followed by stirring for 30 minutes to stop the reaction. The reaction mixture was reprecipitated in 1.5 l of methanol, and the precipitate was collected and dried to obtain 78 g of a polymer having an Mw of $7\times10^4$.

Monomer (m-2)

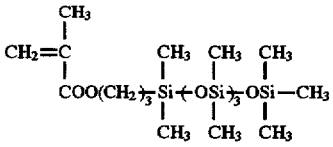

Resin (p-18)

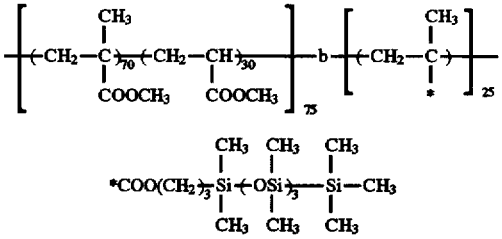

SYNTHESIS EXAMPLE 19 OF RESIN (P): (P-19)

A mixture of 50 g of ethyl methacrylate, 10 g of glycidyl methacrylate, and 4.8 g of benzyl N,N-diethyldithiocarbamate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. The reaction mixture was dissolved in 100 g of tetrahydrofuran, and 40 g of Monomer (m-3) shown below was added thereto. After displacing the atmosphere with nitrogen, the mixture was again irradiated with light for 10 hours. The reaction mixture obtained was reprecipitated in 1 l of methanol, and the precipitate was collected and dried to obtain 73 g of a polymer having an Mw of $4.8\times10^4$.

Monomer (m-3)

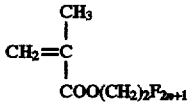

(n: an integer of from 8 to 10)

Resin (P-19)

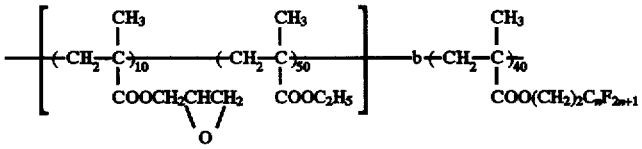

(n: an integer of from 8 to 10)

SYNTHESIS EXAMPLE 20 OF RESIN (P): (P-20)

A mixture of 50 g of methyl methacrylate, 25 g of ethyl methacrylate, and 1.0 g of benzyl isopropylxanthate was sealed into a container under nitrogen gas stream and heated to a temperature of 50° C. The mixture was irradiated with light from a high-pressure mercury lamp of 400 W at a distance of 10 cm through a glass filter for 6 hours to conduct photopolymerization. To the mixture was added 25 g of Monomer (m-1) described above. After displacing the atmosphere with nitrogen, the mixture was again irradiated with light for 10 hours. The reaction mixture obtained was reprecipitated in 2 l of methanol, and the precipitate was collected and dried to obtain 63 g of a polymer having an Mw of $6\times10^4$.

Resin (P-20)

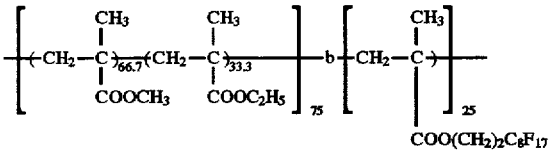

SYNTHESIS EXAMPLES 21 TO 27 OF RESIN (P): (P-21) TO (P-27)

Each of copolymers shown in Table H below was prepared in the same manner as in Synthesis Example 19 of Resin (P). An Mw of each of the resulting polymers was in a range of from $3.5\times10^4$ to $6\times10^4$.

TABLE H

| Synthesis Example of Resin (P) | Resin (P) | A-B Type Block Copolymer (weight ratio) |
|---|---|---|
| 21 | P-21 | 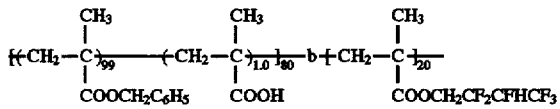 |
| 22 | P-22 | 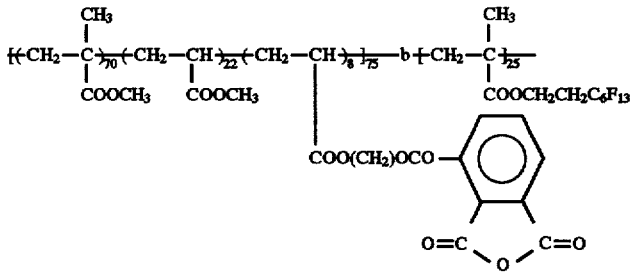 |
| 23 | P-23 | 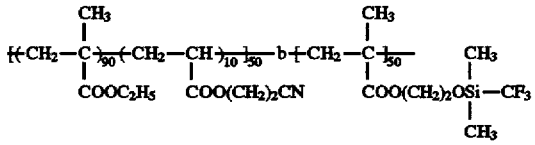 |
| 24 | P-24 | 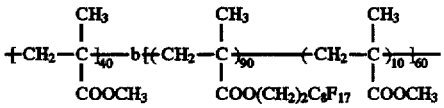 |
| 25 | P-25 | 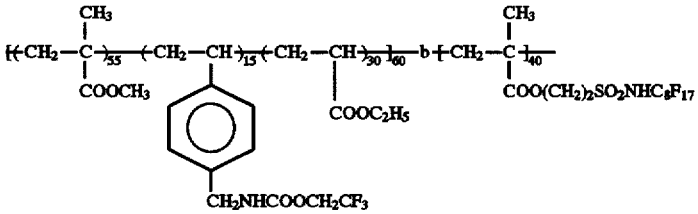 |
| 26 | P-26 | 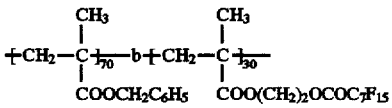 |

TABLE H-continued

| Synthesis Example of Resin (P) | Resin (P) | A-B Type Block Copolymer (weight ratio) |
|---|---|---|
| 27 | P-27 | 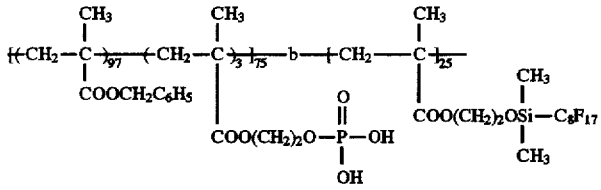 |

SYNTHESIS EXAMPLE 28 OF RESIN (P): (P-28)

A copolymer having an Mw of $4.5\times10^4$ was prepared in the same manner as in Synthesis Example 19 of Resin (P), except for replacing benzyl N,N-diethyldithiocarbamate with 18 g of Initiator (I-1) having the structure shown below.

Initiator (I-1)

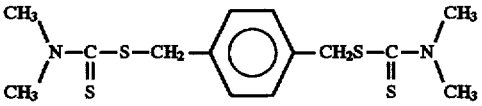

Resin (P-28)

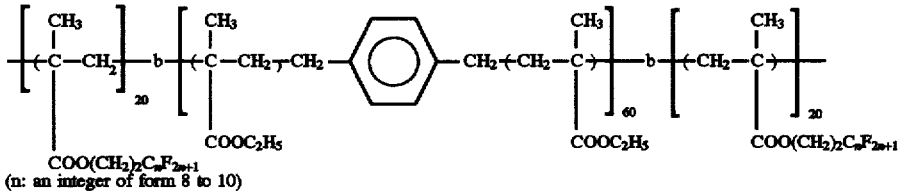

(n: an integer of form 8 to 10)

SYNTHESIS EXAMPLE 29 OF RESIN (P): (P-29)

A copolymer having an Mw of $2.5\times10^4$ was prepared in the same manner as in Synthesis Example 20 of Resin (P), except for replacing benzyl isopropylxanthate with 0.8 g of Initiator (I-2) having the structure shown below.

Initiator (I-2)

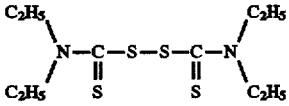

Resin (P-29)

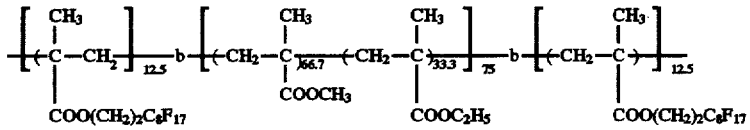

SYNTHESIS EXAMPLE 30 OF RESIN (P): (P-30)

A mixed solution of 68 g of methyl methacrylate, 22 g of methyl acrylate, 10 g of glycidyl methacrylate, 17.5 g of Initiator (I-3) having the structure shown below, and 150 g of tetrahydrofuran was heated to a temperature of 50° C. under nitrogen gas stream. The solution was irradiated with light from a high-pressure mercury lamp of 400 W at a distance of 10 cm through a glass filter for 10 hours to conduct photopolymerization. The reaction mixture obtained was reprecipitated in 1 l of methanol, and the precipitate was collected and dried to obtain 72 g of a polymer having an Mw of $4.0\times10^4$.

A mixed solution of 70 g of the resulting polymer, 30 g of Monomer (m-2) described above, and 100 g of tetrahydrofuran was heated to a temperature of 50° C. under nitrogen gas stream and irradiated with light under the same conditions as above for 13 hours. The reaction mixture was reprecipitated in 1.5 l of methanol, and the precipitate was collected and dried to obtain 78 g of a copolymer having an Mw of $6\times10^4$.

Initiator (I-3)

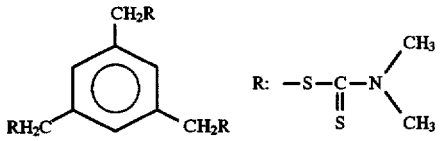

Resin (P-30)

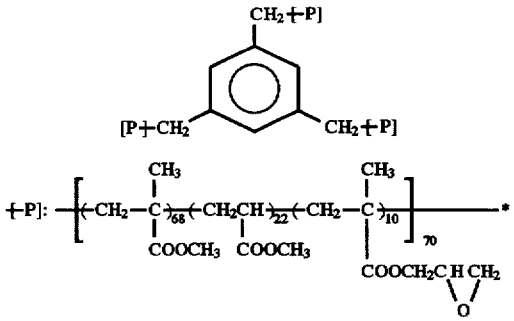

-continued

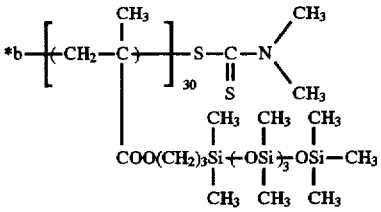

SYNTHESIS EXAMPLES 31 TO 38 OF RESIN (P): (P-31) TO (P-38)

In the same manner as in Synthesis Example 30 of Resin (P), except for replacing 17.5 g of Initiator (I-3) with 0.031 mol of each of the initiators shown in Table I below, each of the copolymers shown in Table I was obtained. A yield thereof was in a range of from 70 to 80 g and an Mw thereof was in a range of from $4\times10^4$ to $6\times10^4$.

TABLE I
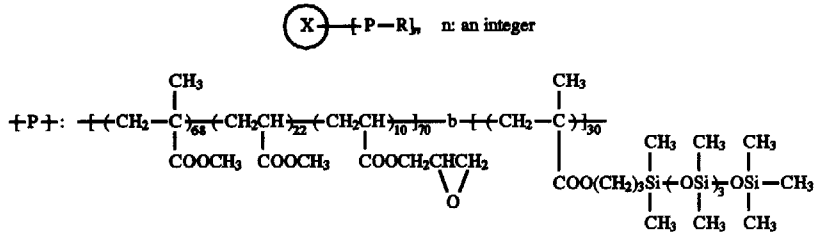
| Synthesis Example of Resin (P) | Resin (P) | Initiator (I) | —R | X |
|---|---|---|---|---|
| 31 | P-31 | 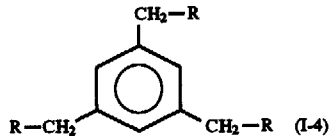 (I-4) | 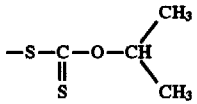 | 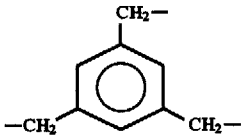 |
| 32 | P-32 | 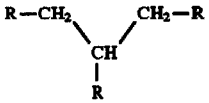 (I-5) | 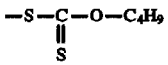 | 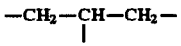 |
| 33 | P-33 | 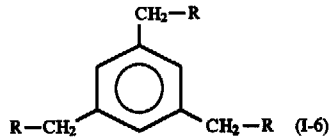 (I-6) | 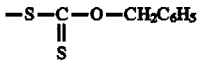 | 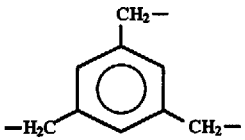 |
| 34 | P-34 | 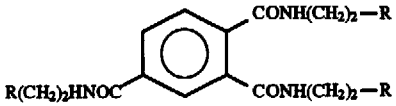 (I-7) | 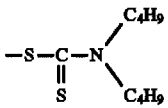 | 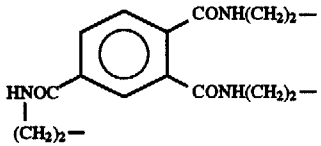 |
| 35 | P-35 | 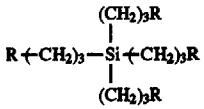 (I-8) | 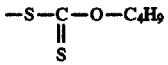 | 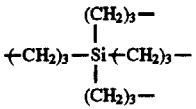 |

TABLE I-continued
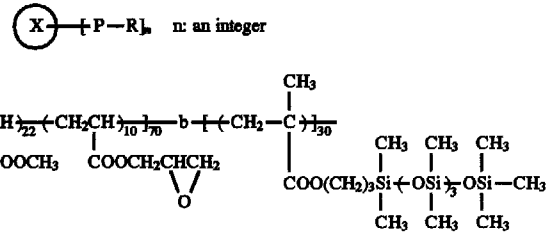
| Synthesis Example of Resin (P) | Resin (P) | Initiator (I) | —R | X |
|---|---|---|---|---|
| 36 | P-36 | 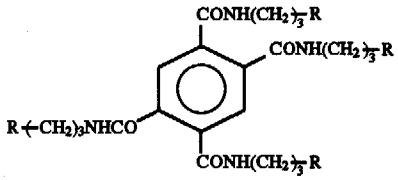 (I-9) | 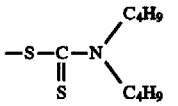 | 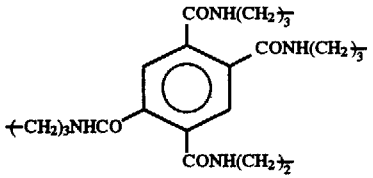 |
| 37 | P-37 | 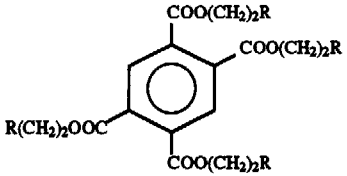 (I-10) | 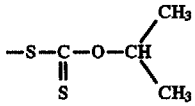 | 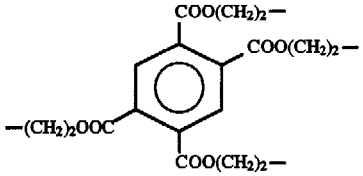 |
| 38 | P-38 | 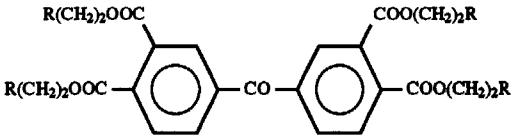 (I-11) | 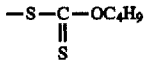 | 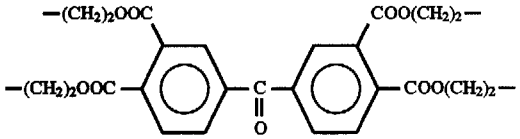 |

Synthesis Examples of Resin Grain (L)

SYNTHESIS EXAMPLE 1 OF RESIN GRAIN (L) : (L-1)

A mixed solution of 40 g of Monomer (LM-1) having the structure shown below, 2 g of ethylene glycol dimethacrylate, 4.0 g of Dispersion Stabilizing Resin (LP-1) having the structure shown below, and 180 g of methyl ethyl ketone was heated to a temperature of 60° C. with stirring under nitrogen gas stream. To the solution was added 0.3 g of AIVN, followed by reacting for 3 hours. To the reaction mixture was further added 0.1 g of AIVN, and the reaction was continued for 4 hours. After cooling, the reaction mixture was passed through a nylon cloth of 200 mesh to obtain a white dispersion. The average grain diameter of the latex was 0.25 μm.

Monomer (LM-1)

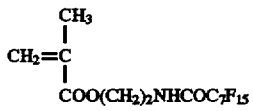

Dispersion Stabilizing Resin (LP-1)

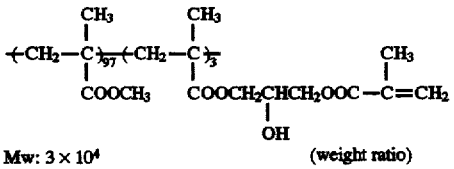

Mw: $3\times10^4$ (weight ratio)

SYNTHESIS EXAMPLE 2 OF RESIN GRAIN (L) : (L-2)

A mixed solution of 5 g of AB-6 (a monofunctional macromonomer comprising a butyl acrylate unit, manufactured by Toagosei Chemical Industry Co., Ltd.) as a dispersion stabilizing resin and 140 g of methyl ethyl ketone was heated to a temperature of 60° C. under nitrogen gas stream while stirring. To the solution was added dropwise a mixed solution of 40 g of Monomer (LM-2) having the structure shown below, 1.5 g of ethylene glycol diacrylate, 0.2 g of AIVN, and 40 g of methyl ethyl ketone over a period of one hour. After the addition, the reaction was continued for 2 hours. To the reaction mixture was further added 0.1 g of AIVN, followed by reacting for 3 hours to obtain a white dispersion. After cooling, the dispersion was passed through a nylon cloth of 200 mesh. The average grain diameter of the dispersed resin grains was 0.35 μm.

Monomer (LM-2)

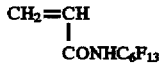

SYNTHESIS EXAMPLES 3 TO 11 OF RESIN GRAIN (L): (L-3) TO (L-11)

Each of resin grains was synthesized in the same manner as in Synthesis Example 1 of Resin Grain (L), except for replacing Monomer (LM-1), ethylene glycol dimethacrylate and methyl ethyl ketone with each of the compounds shown in Table J below, respectively. An average grain diameter of each of the resulting resin grains was in a range of from 0.15 to 0.30 μm.

TABLE J

| Synthesis Example of Resin Grain (L) | Resin Grain (L) | Monomer (LM) | Crosslinking Polyfunctional Monomer | Amount | Reaction Solvent |
|---|---|---|---|---|---|
| 3 | L-3 | (LM-3) 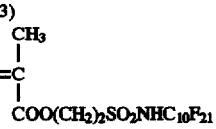 | Ethylene glycol dimethacrylate | 2.5 g | Methyl ethyl ketone |
| 4 | L-4 | (LM-4) 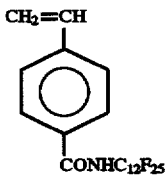 | Divinylbenzene | 3 g | Methyl ethyl ketone |
| 5 | L-5 | (LM-5) 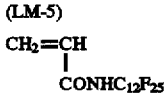 | — | | Methyl ethyl ketone |
| 6 | L-6 | (LM-6) 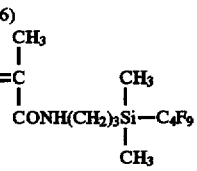 | Diethylene glycol diacrylate | 5 g | n-Hexane |

TABLE J-continued

| Synthesis Example of Resin Grain (L) | Resin Grain (L) | Monomer (LM) | Crosslinking Poly-functional Monomer | Amount | Reaction Solvent |
|---|---|---|---|---|---|
| 7 | L-7 | (LM-7) 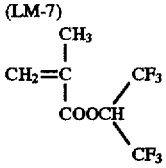 | Ethylene glycol dimethacrylate | 3.5 g | n-Hexane |
| 8 | L-8 | (LM-8) $CH_2{=}CH$ \| $COO(CH_2)_2CONHC_8F_{17}$ | Trimethylolpropane trimethacrylate | 2.5 g | Methyl ethyl ketone |
| 9 | L-9 | (LM-9) $CH_2{=}CH$ \| $CONH(CH_2)_3Si[OSi(CH_3)_3]_3$ | Trivinylbenzene | 3.3 g | Ethyl acetate/ n-Hexane (4/1 by weight) |
| 10 | L-10 | (LM-10) $CH_2{=}C(CH_3)$ \| $COO(CH_2)_2NHCONH(CH_2)_3Si[OSi(CH_3)_3]_3$ | Divinyl glutaconate | 4 g | Ethyl acetate/ n-Hexane (2/1 by weight) |
| 11 | L-11 | (LM-11) $CH_2{=}C(CH_3)$ \| $CONHCOOCH_2CF_2CFHCF_3$ | Propylene glycol diacrylate | 3 g | Methyl ethyl ketone |

SYNTHESIS EXAMPLES 12 TO 17 OF RESIN GRAIN (L): (L-12) TO (L-17)

Each of resin grains was synthesized in the same manner as in Synthesis Example 2 of Resin Grain (L), except for replacing 5 g of AB-6 (dispersion stabilizing resin) with each of Resins (LP) shown in Table K below. An average grain diameter of each of the resulting resin grains was in a range of from 0.10 to 0.25 μm.

TABLE K

| Synthesis Example of Resin Grain (L) | Resin Grain (L) | Dispersion Stabilizing Resin (LP) | Amount |
|---|---|---|---|
| 12 | L-12 | 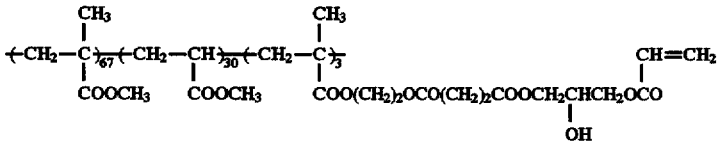 (LP-2) Mw $3.3\times10^4$ | 4 g |
| 13 | L-13 | 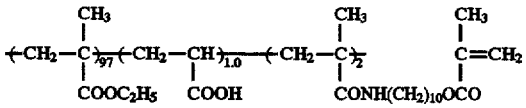 (LP-3) Mx $2.5\times10^4$ | 2 g |

TABLE K-continued

| Synthesis Example of Resin Grain (L) | Resin Grain (L) | Dispersion Stabilizing Resin (LP) | Amount |
|---|---|---|---|
| 14 | L-14 | 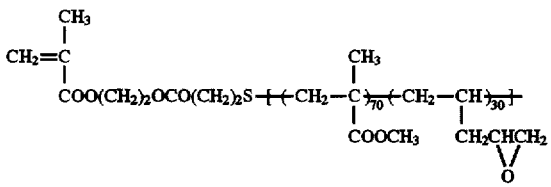 (LP-4) Mw $8\times10^3$ | 6 g |
| 15 | L-15 | 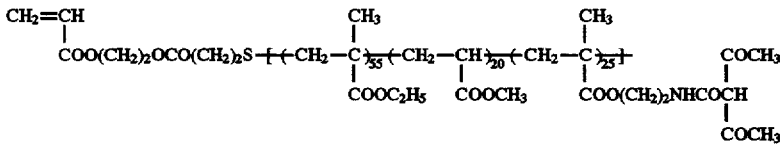 (LP-5) Mw $1\times10^4$ | 6 g |
| 16 | L-16 | 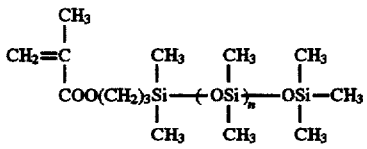 (LP-6) Mw $1\times10^4$ | 4 g |
| 17 | L-17 | 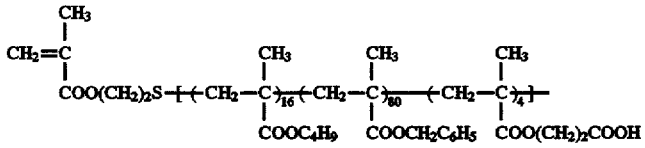 (LP-7) Mw $6\times10^3$ | 5 g |

SYNTHESIS EXAMPLES 18 TO 23 OF RESIN GRAIN (L): (L-18) TO (L-23)

Each of resin grains was synthesized in the same manner as in Synthesis Example 2 of Resin Grain (L), except for replacing 40 g of Monomer (LM-2) with each of the monomers shown in Table L below and replacing 5 g of AB-6 (dispersion stabilizing resin) with 6 g of Dispersion Stabilizing Resin (LP-8) having the structure shown below. An average grain diameter of each of the resulting resin grains was in a range of from 0.05 to 0.20 μm.

Dispersion Stabilizing Resin (LP-8)

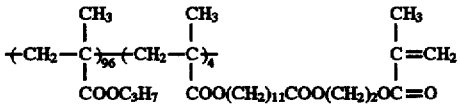

Mw $3\times10^4$

TABLE L

| Synthesis Example of Resin Grain (L) | Resin Grain (L) | Monomer (LM) | Amount | Other Monomer | Amount |
|---|---|---|---|---|---|
| 18 | L-18 | (LM-12) 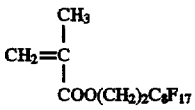 | 30 g | $CH_2=CH$ \| $CONHCH_2OCH_3$ | 10 g |

TABLE L-continued

| Synthesis Example of Resin Grain (L) | Resin Grain (L) | Monomer (LM) | Amount | Other Monomer | Amount |
|---|---|---|---|---|---|
| 19 | L-19 | (LM-13) 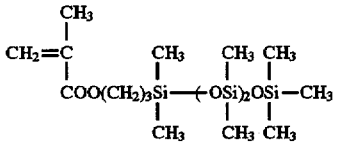 | 25 g | Glycidyl methacrylate | 15 g |
| 20 | L-20 | (LM-14) 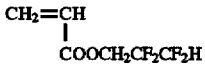 | 20 g | Acrylonitrile | 20 g |
| 21 | L-21 | (LM-15) 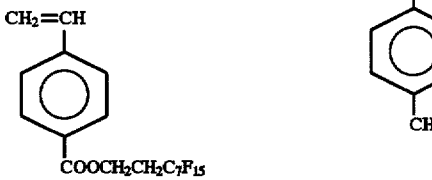 | 25 g | 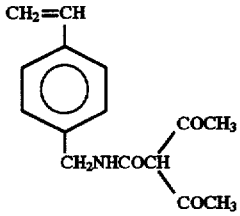 | 15 g |
| 22 | L-22 | (LM-16) 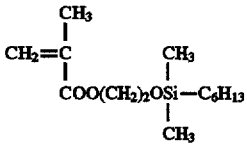 | 20 g | Methyl methacrylate | 20 g |
| 23 | L-23 | (LM-17) 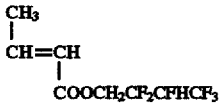 | 20 g | Vinyl acetate | 20 g |

EXAMPLE 1

A mixture of 2 g of X-form metal-free phthalocyanine (manufactured by Dainippon Ink and Chemicals, Inc.), 8 g of Binder Resin (B-1) having the structure shown below, 2 g of Resin (P-1), 0.15 g of Compound (A) having the structure shown below, and 80 g of tetrahydrofuran was put into a 500 ml-volume glass container together with glass beads and dispersed in a paint shaker (manufactured by Toyo Seiki Seisakusho Co.) for 60 minutes. To the dispersion were added 0.1 g of phthalic anhydride and 0.02 g of o-chlorophenol, followed by further dispersing for 5 minutes. The glass beads were separated by filtration to prepare a dispersion for a light-sensitive layer.

Binder Resin (B-1)

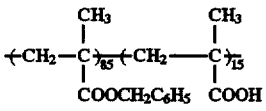

Mw $4\times10^4$

-continued

Compound (A)

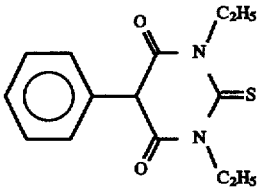

The resulting dispersion was coated on an aluminum plate having a thickness of 0.2 mm, which had been subjected to electrically conductive treatment, by a wire bar, set to touch, and heated in a circulating oven at 110° C. for 20 seconds and they at 120° C. for one hour to form a light-sensitive layer having a thickness of 8 μm. The adhesion strength of the surface of the resulting electrophotographic light-sensitive element measured according to JIS Z 0237-1980 "Testing methods of pressure sensitive adhesive tapes and sheets" was 2 gram-force (g·f).

For comparison, an electrophotographic light-sensitive element was prepared in the same manner as described above except for eliminating 2 g of Resin (P-1) and using 10 g of Resin (B-1). The adhesive strength of the surface thereof was more than 450 g·f and the light-sensitive element did not exhibit releasability at all when a transfer layer was formed thereon.

Figure 5:
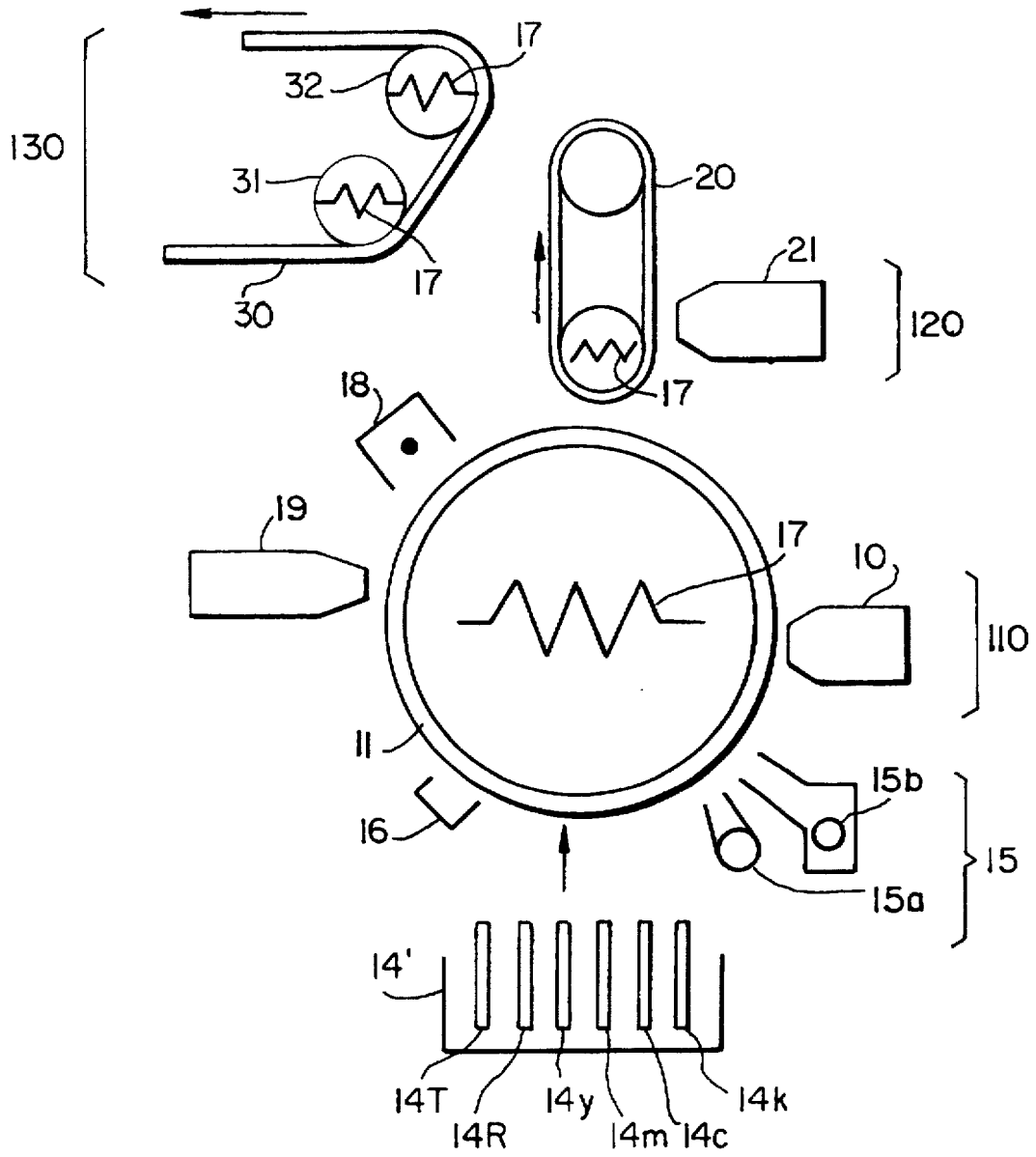
FIG. 5 is a schematic view of one example of an apparatus for practicing the method of the present invention wherein the electrodeposition coating method for the formation of transfer layer on a light-sensitive element and a primary receptor of an endless belt type are employed.

The light-sensitive element having the surface of releasability was installed in an apparatus as shown in FIG. 5 as a light-sensitive element 11. On the other hand, a drum wound with a blanket for offset printing (9600-A manufactured by Meiji Rubber & Co., Ltd.) having the adhesive strength of 80 g·f/10 mm width and a thickness of 1.6 mm was installed as a primary receptor 20.

On the light-sensitive element drum was formed a transfer layer 12 according to the electrodeposition coating method while supplying Dispersion of Resin (A) (L-1) having the composition shown below to an electrodeposition unit 14T as a transfer layer-forming device.

| Dispersion of Resin (A) (L-1) | |
|---|---|
| Resin Grain (AR-4) | 5 g (solid basis) |
| Resin Grain (AR-24) | 5 g (solid basis) |
| Charge Control Agent (D-1) (octadecyl vinyl ether/N-tert-octyl maleic monoamide copolymer | 0.03 g |
| Branched Tetradecyl Alcohol (FOC-1400 manufactured by Nissan Chemical Industries, Ltd.) | 10 g |
| Isopar H | up to make 1 liter |

Specifically, on the surface of light-sensitive element which was rotated at a circumferential speed of 10 mm/sec, Dispersion of Resin (A) (L-1) was supplied using a slit electrodeposition device, while putting the light-sensitive element to earth and applying an electric voltage of −250 V to an electrode of the slit electrodeposition device, whereby the resin grains were electrodeposited. The dispersion medium was removed by air-squeezing using a suction/exhaust unit 15, and the resin grains were fused by an infrared line heater of a pre-heating means 16 to form a film, whereby a transfer layer 12 composed of a thermoplastic resin was prepared on the light-sensitive element. A thickness of the transfer layer was 5 μm.

An electrophotographic process was then performed. Specifically, the light-sensitive element was charged to +450 V by passing under a corona charger 18 in dark and image-exposed to light using a semiconductor laser having an oscillation wavelength of 788 nm as an semiconductor laser drawing device 19 at an irradiation dose on the surface of the light-sensitive element of 30 erg/cm$^2$. The image exposure was in a negative image mode based on digital image data which had been obtained by reading an original by a color scanner, conducting several corrections relating to color reproduction peculiar to color separation system and stored in a hard disc.

Thereafter, the exposed light-sensitive element was subjected to reversal development using a liquid developer prepared by diluting a yellow liquid developer for Signature System (manufactured by Eastman Kodak Co.) with 75-fold Isopar H (manufactured by Esso Standard Oil Co.) while a bias voltage of +350 V was applied to a yellow liquid developing unit 14y to thereby electrodeposit toner particles on the exposed areas. The light-sensitive element was then rinsed in a bath of Isopar H alone to remove any stains in the non-image areas, and dried by passing under a suction/exhaust unit 15 and a pre-heating means 16.

The above procedure was repeated using each of liquid developing units for magenta (**14*m*), cyan (14*c*) and black (14*k*) to form color toner images 3**.

The light-sensitive element 11 was then heated using the pre-heating means 16 and a temperature controlling means 17 so as to maintain the surface temperature of light-sensitive element at 60° C. The drum of light-sensitive element 11 and the drum of primary receptor 20 were brought into contact with each other and subjected to heating and pressing under the condition of a nip pressure of 4.5 Kgf/cm$^2$ and a drum circumferential speed of 10 mm/sec, whereby the color toner images 3 were wholly transferred together with the transfer layer 12 onto the primary receptor 20.

Then, coated paper used for printing was introduced as a receiving material 30 between the drum of primary receptor 20, the surface temperature of which had been adjusted at 60° C. by the temperature controlling means 17 and a back-up roller for transfer 31 adjusted at 100° C. and a back-up roller for release 32 adjusted at 10° C., and subjected to heating and pressing under a nip pressure of 5 Kgf/cm$^2$ and at a drum circumferential speed of 10 mm/sec. The color toner images 3 were wholly transferred onto the coated paper 30 and thus clear color images of good image quality were obtained.

For comparison, the same procedure as above was performed except that the transfer layer 12 was not formed on the light-sensitive element to form color images on coated paper 30. In the resulting color images on coated paper, cuttings of toner image and unevenness in image density were observed. Further, as a result of visual evaluation of the color images using a magnifying glass of 20 magnifications, cuttings of fine image, for example, fine lines and fine letters were recognized. Also, the residue of toner image was found on the surface of light-sensitive element.

These results indicate that cleaning of the surface of light-sensitive element is necessary for removing the residual toner when the light-sensitive element is repeatedly employed. Consequently, a device for the cleaning must be provided and a problem in that the surface of light-sensitive element is damaged due to the cleaning arises. On the contrary, the method according to the present invention has advantages in that the release of toner image from the light-sensitive element is sufficiently performed by utilizing the transfer layer composed of a resin, in that the toner image is easily and sufficiently transferred from the primary receptor to the final receiving material and in that the toner image is protected by the transfer layer.

EXAMPLE 2

An amorphous silicon electrophotographic light-sensitive element (manufactured by KYOSERA Corp.) was installed in an apparatus as shown in FIG. 5 as a light-sensitive element. The adhesive strength of the surface of light-sensitive element was 200 g·f.

Impartation of releasability to the light-sensitive element was conducted by dipping the light-sensitive element in a solution of the compound (S) according to the present invention (dip method) in the apparatus. Specifically, the light-sensitive element rotated at a circumferential speed of 10 mm/sec was brought into contact with a bath containing a solution prepared by dissolving 1.0 g of Compound (S-1) shown below in one liter of Isopar G (manufactured by Esso Standard Oil Co.) for 7 seconds and dried using air-squeezing. The adhesive strength of the surface of light-sensitive element thus-treated was 3 g·f and the light-sensitive element exhibited good releasability.

Compound (S-1)

Silicone surface active agent (SILWet FZ-2171 manufactured by Nippon Unicar Co., Ltd.)

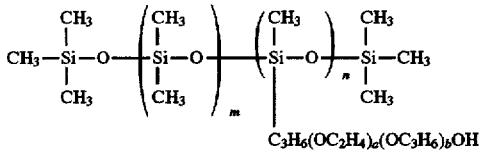

(presumptive structure)

On the surface of light-sensitive element whose surface temperature was adjusted at 50° C. and which was rotated at a circumferential speed of 10 mm/sec, Dispersion of Resin (A) (L-2) containing positively charged resin grains shown below was supplied using a slit electrodeposition device, while putting the light-sensitive element to earth and applying an electric voltage of −130 V to an electrode of the slit electrodeposition device to cause the grains to electrodeposite and fix, whereby a transfer layer having a thickness of 2.0 μm was formed.

| Dispersion of Resin (A) (L-2) | |
|---|---|
| Resin Grain (AR-18) | 4 g (solid basis) |
| Resin Grain (ARW-1) | 6 g (solid basis) |
| Positive-Charge Control Agent (D-1) | 0.020 g |
| Branched Hexadecyl Alcohol (FOC-1600 manufactured by Nissan Chemical Industries, Ltd.) | 10 g |
| Isopar G | up to make 1.0 liter |

The amorphous silicon electrophotographic light-sensitive element 11 having the releasability was charged to +700 V with a corona discharge in a dark place and exposed to light using a semiconductor laser having an oscillation wavelength of 780 nm on the basis of digital image data on an information for yellow color separation among digital image data on informations for yellow, magenta, cyan and black color separations which had been obtained by reading an original by a color scanner, conducting several corrections relating to color reproduction peculiar to color separation system and stored in a hard disc. The potential in the exposed area was +220 V while it was +600 V in the unexposed area.

The exposed light-sensitive element was pre-bathed with Isopar H (manufactured by Esso Standard Oil Co.) by a pre-bathing means installed in a developing unit and then subjected to reversal development by supplying a liquid developer prepared by diluting a positively charged yellow toner for an electrostatic color plotter (Versateck 3000 manufactured by Xerox Corp.) with 50-fold Isopar H from the developing unit to the surface of light-sensitive element while applying a bias voltage of +500 V to the developing unit side to thereby electrodeposite yellow toner particles on the unexposed areas. The light-sensitive element was then rinsed in a bath of Isopar H alone to remove stains in the non-image areas and dried by a suction/exhaust unit.

The above procedure was repeated using each information for magenta, cyan and black in place of the information for yellow.

On the light-sensitive element having the color images thereon was formed a second transfer layer 12' having a thickness of 3 μm by the electrodeposition coating method in the same manner as above using Dispersion of Resin (A) (L-3) which had the same composition as Dispersion of Resin (A) (L-2) except for employing 10 g (solid basis) of Resin Grain (ARW-3) in place of Resin Grain (AR-18) and Resin Grain (ARW-1).

Then, the light-sensitive element was passed under an infrared line heater to adjust a surface temperature thereof measured by a radiation thermometer at about 80° C., a primary receptor 20 was heated at 100° C. and the light-sensitive element 11 was brought into contact with the primary receptor under the condition of a nip pressure of 4 Kgf/cm$^2$ and a drum circumferential speed of 50 mm/sec, whereby the color toner images 3 were wholly transferred together with the transfer layers 12 and 12' on the primary receptor 20.

The primary receptor 20 employed was prepared by applying a mixture comprising 100 g of isoprene rubber, 7 g of Resin (P-2) and 0.001 g of phthalic anhydride to the surface of the blanket (9600-A) and heated at 140° C. for 2 hours to form a cured layer having a thickness of 10 μm. The adhesive strength of the surface thereof was 80 g·f.

Then, coated paper 30 was brought into contact with the primary receptor bearing the color toner image 3 thereon and they were passed under a heating rubber roller 31 which was in contact under a pressure of 4 Kgf/cm$^2$ and whose surface temperature was constantly controlled at 100° C. at a transportation speed of 50 mm/sec.

After cooling by passing under a cooling roller 32, the coated paper 30 was stripped from the primary receptor, whereby the toner image 3 on the primary receptor 20 was wholly heat-transferred together with the transfer layers 12 and 12' onto the coated paper 30. The toner image 3 was completely covered with the thermoplastic resin of transfer layer 12' on the coated paper 30 and thus it did not fall off when it was rubbed.

EXAMPLE 3

Impartation of releasability to the surface of light-sensitive element by the adherence or adsorption of compound (S) in the apparatus conducting an electrophotographic process on the surface of light-sensitive element was performed in the following manner in place of the dip method as in Example 2.

(1) For imparting releasability to the light-sensitive element 11, in a part for applying compound (S) 110 of the apparatus as in Example 2, a metering roll having a silicone rubber layer on the surface thereof was brought into contact with a bath containing an oil of Compound (S-2) having the structure shown below on one side and with the light-sensitive element on the other side and they were rotated at a circumferential speed of 15 mm/sec for 20 seconds. As a result, the adhesive strength of the surface of light-sensitive element 11 was 5 g·f.

Compound (S-2)

Carboxy-modified silicone oil (TSF 4770 manufactured by Toshiba Silicone Co., Ltd.)

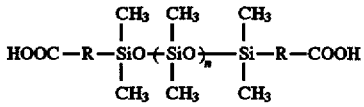

Further, a transfer roll having a styrene-butadiene layer on the surface thereof was placed between the metering roll dipped in the silicone oil bath of Compound (S-2) and the light-sensitive element, and the treatment was conducted in the same manner as above. Good releasability of the surface of light-sensitive element similar to the above was obtained.

Figure 9:
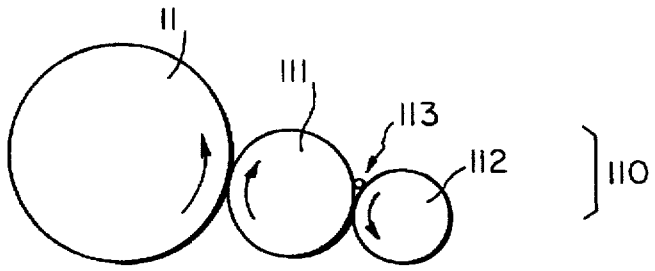
FIG. 9 is a schematically partial view of a device for applying a compound (S).

Moreover, in the above-described method of using the metering roll and transfer roll as the part for applying compound (S) Compound (S-2) 113 was supplied between the metering roll 112 and the transfer roll 111 as shown in FIG. 9 and the treatment was conducted in the same manner as above. Again, good result similar to the above was obtained.

(2) An AW-treated felt (material: wool having a thickness of 15 mm and a width of 20 mm) impregnated uniformly with 2 g of Compound (S-3), i.e., dimethyl silicone oil KF-96L-2.0 (manufactured by Shin-Etsu Silicone Co., Ltd.) was pressed under a pressure of 200 g on the surface of light-sensitive element and the light-sensitive element was rotated at a circumferential speed of 20 mm/sec for 30 seconds. The adhesive strength of the surface of light-sensitive element thus-treated was 5 g·f.

(3) A rubber roller having a heating means integrated therein and covered with cloth impregnated with Compound (S-4), i.e., fluorine-containing surface active agent (Sarflon S-114 manufactured by Asahi Glass Co., Ltd.) was heated to a surface temperature of 60° C., then brought into contact with the light-sensitive element and they were rotated at a circumferential speed of 20 mm/sec for 30 seconds. The adhesive strength of the surface of light-sensitive element thus-treated was 12 g·f.

(4) A silicone rubber roller comprising a metal axis covered with silicone rubber (manufactured by Kinyosha K.K.) was pressed on the light-sensitive element at a nip pressure of 500 gf/cm$^2$ and rotated at a circumferential speed of 15 mm/sec for 10 seconds. The adhesive strength of the surface of light-sensitive element thus-treated was 10 g·f.

Using the light-sensitive elements treated with these methods, color images were formed on coated paper in the same manner as in Example 2. Good results similar to those in Example 2 were obtained.

EXAMPLE 4

A mixture of 2 g of X-form metal-free phthalocyanine, 8 g of Binder Resin (B-2) having the structure shown below, 2 g of Binder Resin (B-3) having the structure shown below, 0.15 g of Compound (B) having the structure shown below, and 80 g of tetrahydrofuran was put into a 500 ml-volume glass container together with glass beads and dispersed in a paint shaker (manufactured by Toyo Seiki Seisakusho Co.) for 60 minutes. The glass beads were separated by filtration to prepare a dispersion for a light-sensitive layer.

Binder Resin (B-2)

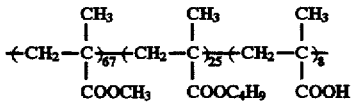

Mw $7\times10^4$

Binder Resin (B-3)

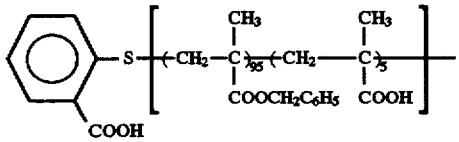

Mw $8\times10^3$

-continued

Compound (B)

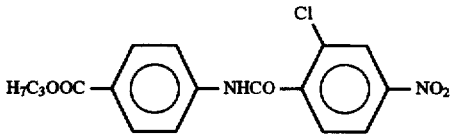

The resulting dispersion was coated on base paper for a paper master having a thickness of 0.2 mm, which had been subjected to electrically conductive treatment and solvent-resistant treatment, by a wire bar, set to touch, and heated in a circulating oven at 110° C. for 20 minutes to form a light-sensitive layer having a thickness of 8 μm.

Then, a surface layer for imparting releasability having a thickness of 1.5 μm was provided on the light-sensitive layer to obtain a light-sensitive element having the surface of releasability.

Formation of Surface Layer for Imparting Releasability

A coating composition comprising 10 g of silicone resin having the structure shown below, 1 g of crosslinking agent having the structure shown below, 0.1 g of platinum as a catalyst for crosslinking and 100 g of n-hexane was coated by a wire round rod, set to touch, and heated at 120° C. for 10 minutes to form the surface layer having a thickness of 1.5 μm. The adhesive strength of the surface of the resulting light-sensitive element was not more than 1 g·f.

Silicone Resin

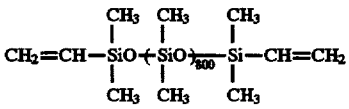

(presumptive structure)

Crosslinking Agent

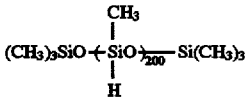

(presumptive structure)

Figure 4:
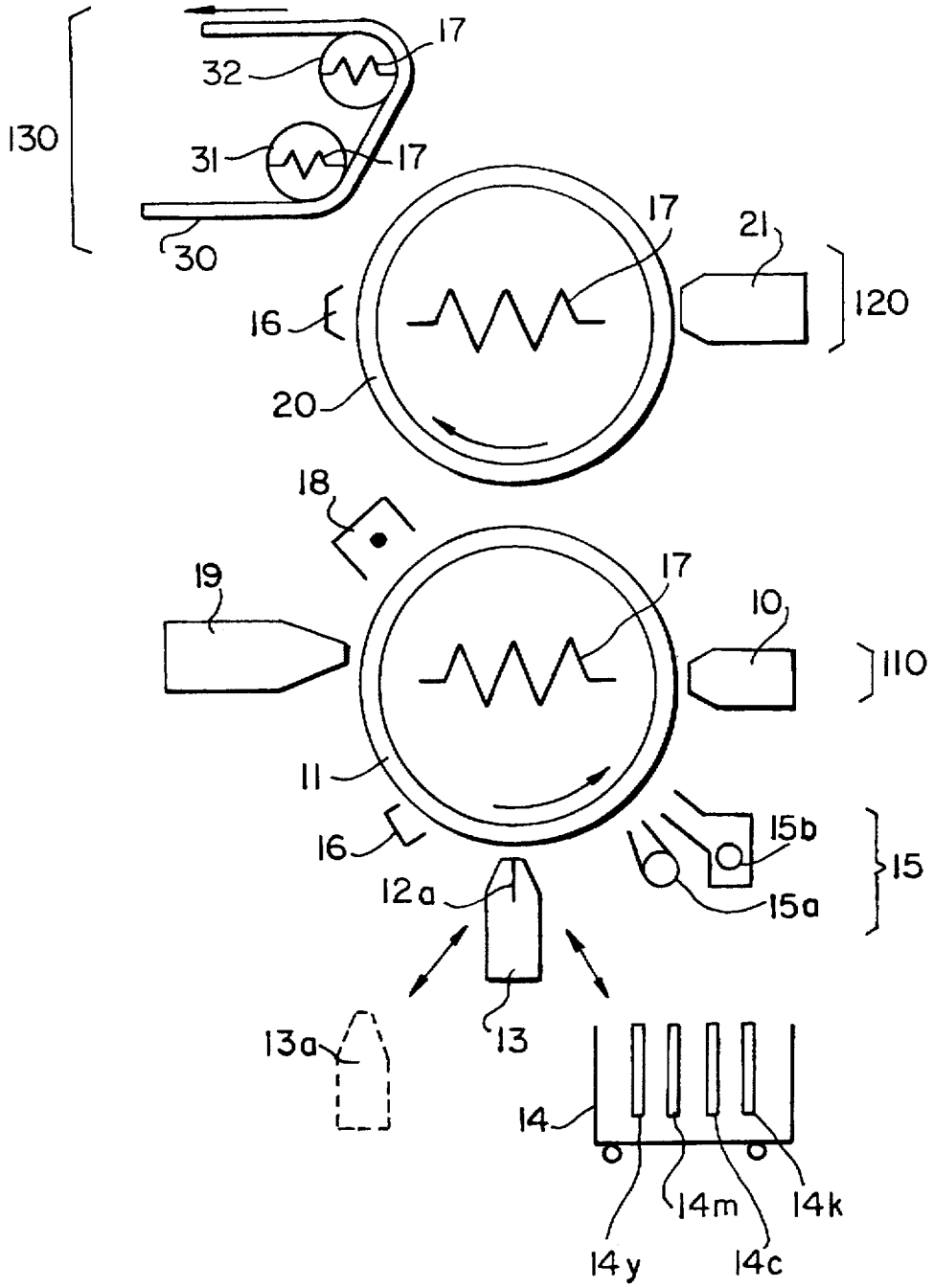
FIG. 4 is a schematic view of one example of an apparatus for practicing the method of the present invention wherein the hot-melt coating method for the formation of transfer layer on a light-sensitive element and a primary receptor of a drum type are employed.

The resulting light-sensitive element was installed as a light-sensitive element 11 in an apparatus as shown in FIG. 4 having a movable liquid developing unit set 14 and a movable hot-melt coater 13.

In order to form a transfer layer 12, an ethylene-vinyl acetate copolymer (content of vinyl acetate: 20% by weight; softening point measured by ring and ball method: 90° C.) was coated as a thermoplastic resin on the surface of light-sensitive element at a rate of 20 mm/sec by a hot melt coater 13 adjusted at 120° C. and cooled by blowing cool air from a suction/exhaust unit 15, followed by maintaining the surface temperature of light-sensitive element at 30° C. A thickness of the transfer layer 12 was 2.5 μm.

On the light-sensitive element having provided thereon the transfer layer 12 was then formed a color image in the same manner as in Example 1.

Figure 6:
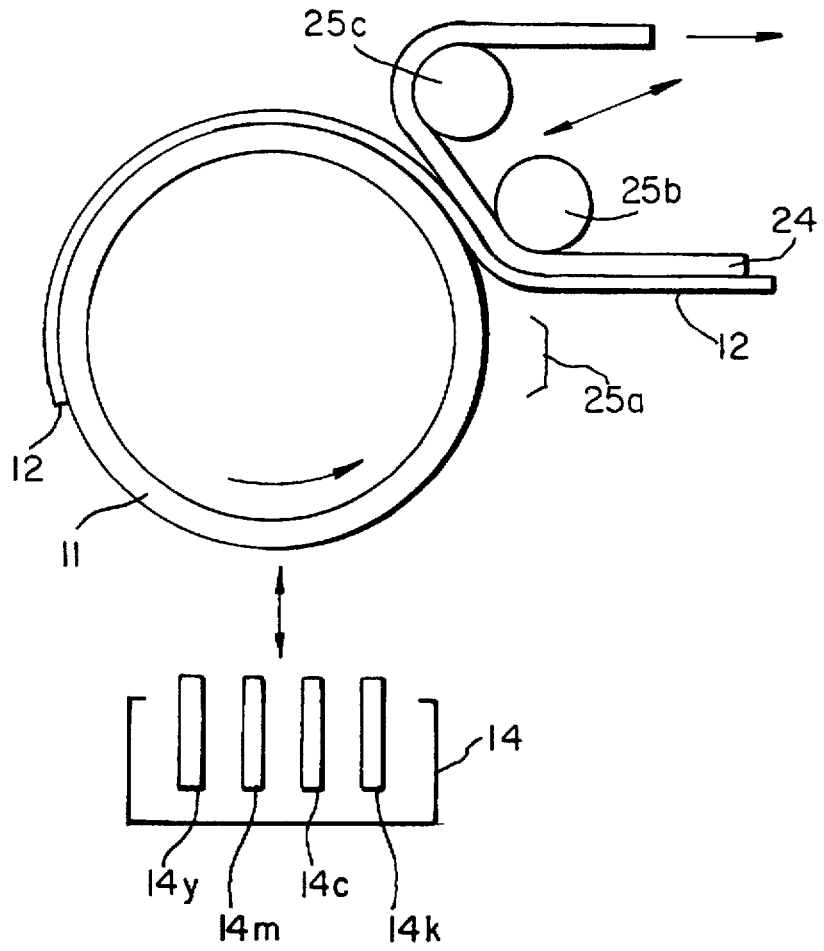
FIG. 6 is a schematic view of a device for the formation of transfer layer on a light-sensitive element utilizing release paper.
Figure 8A:
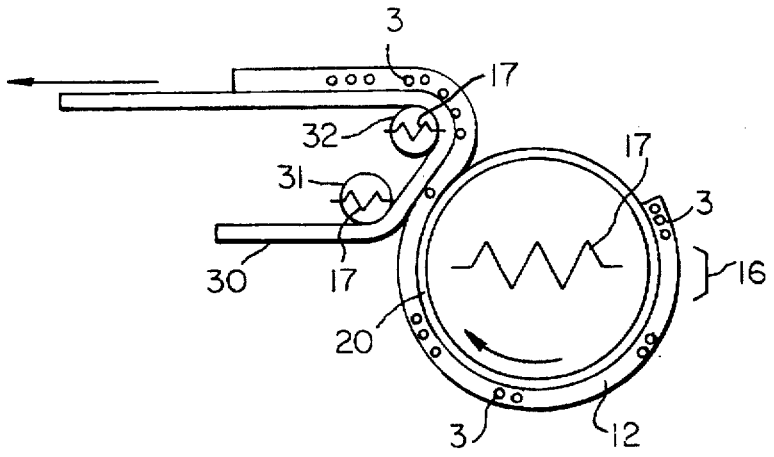
FIG. 8 is a schematically partial view of a transfer step of transferring a toner image together with a transfer layer from a primary receptor onto a receiving material.
Figure 8B:
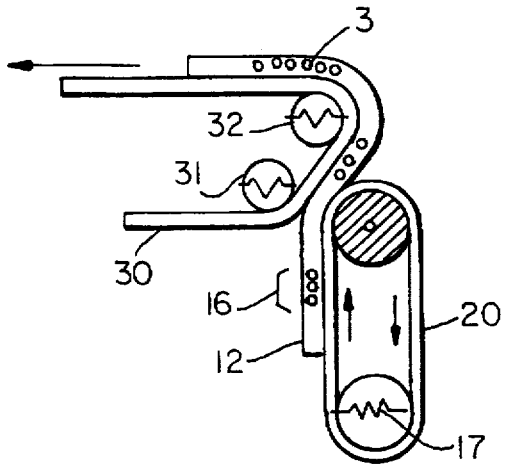

On the other hand, the formation of transfer layer 12" on a primary receptor 20 same as in Example 1 was performed by the transfer method from release paper 24 using a device as shown in FIG. 6 as a transfer layer-forming device 21. Specifically, on Separate Shi (manufactured by Oji Paper Co., Ltd.) as release paper 24 was coated a methyl methacrylate/methyl acrylate (60/40 by weight ratio) copolymer having a Tg of 60° C. as resin (AH) having a high Tg to form a layer having a thickness of 1.5 μm and further coated thereon a vinyl acetate/ethylene (46/54 by weight ratio) copolymer (Evaflex 45× manufactured by Du Pont-Mitsui Polychemicals Co., Ltd.) having a Tg of −25° C. as a resin (AL) having a low Tg to form a layer having a thickness of 5 μm. The resulting paper was brought into contact with the primary receptor 20 same as described in Example 1 under the condition of a pressure between rollers of 3 Kgf/cm$^2$, a surface temperature of 60° C. and a transportation speed of 10 mm/sec, whereby the transfer layer 12' having a thickness of 3 μm was formed on the primary receptor 20.

Using the light-sensitive element 11 having the transfer layer 12 and primary receptor 20 having the transfer layer 12", a color image was formed on coated paper 30 in the same manner as in Example 1. The color duplicate obtained was good and free from stain and had excellent image strength similar to those in Example 1.

EXAMPLE 5

An amorphous silicon electrophotographic light-sensitive element same as used in Example 2 was installed in an apparatus as shown in FIG. 5. Impartation of releasability and formation of transfer layer 12 on the light-sensitive element 11 were simultaneously conducted by the electrodeposition coating method.

Specifically, a transfer layer having a thickness of 2.0 μm was formed on the light-sensitive element in the same manner as in Example 1 using Dispersion of Resin grain (L-4) shown below.

| Dispersion of Resin Grain (L-4) | |
|---|---|
| Resin Grain (AR-4) | 8 g (solid basis) |
| Charge Control Compound (D-2) | 0.02 g |

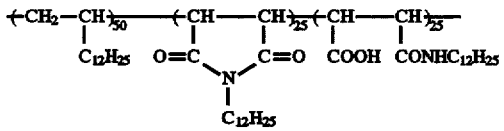

| | |
|---|---|
| Compound (S-5) | 0.8 g |

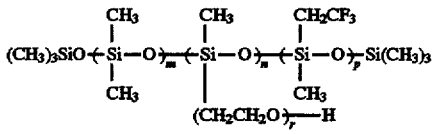

-continued

| Dispersion of Resin Grain (L-4) | |
|---|---|
| Isopar G | up to make 1 liter |

On the light-sensitive element 11 having the transfer layer 12 provided thereon was then formed a color image by the electrophotographic process same as in Example 2.

On the other hand, a heat roller which was a hollow roller having an infrared line heater integrated therein was used as a primary receptor 20. After the surface temperature of primary receptor measured by a radiation thermometer at about 80° C. by the infrared line heater, a mixture of cellulose acetate butyrate (Cellidor Bsp manufactured by Bayer AG) and styrene/vinyl acetate (80/20 by weight ratio) copolymer in a weight ratio of 1:1 as the resin (A) of transfer layer 12" on the surface of primary receptor 20 by a hot-melt coater adjusted at 80° C. at a rate of 20 mm/sec, followed by cooling by flowing cool air from a suction/exhaust unit to form the transfer layer 12". A thickness of the transfer layer 12" thus-obtained was 5 μm.

The color image 3 on the light-sensitive element 11 described above was transferred onto the primary receptor 20 and then onto high quality paper as a final receiving material 30 to obtain a color duplicate. The transfer condition of each transfer step comprised a transfer pressure of 4 Kgf/cm$^2$, transfer temperature of 70° C. and a transfer speed of 150 mm/sec.

The duplicated image formed on high quality paper was visually observed and it was found that no degradation of image occurred and the image was almost the same as that formed on the light-sensitive element before the transfer. Also, the residue of transfer layer was not observed on the surface of light-sensitive element 11 and primary receptor 20 at all after the transfer and transferability was extremely good.

EXAMPLE 6

A mixture of 5 g of a bisazo pigment having the structure shown below, 95 g of tetrahydrofuran and 5 g of a polyester resin (Vylon 200 manufactured by Toyobo Co., Ltd.) was thoroughly pulyerized in a ball mill. The mixture was added to 520 g of tetrahydrofuran with stirring. The resulting dispersion was coated on a conductive substrate used in Example 1 by a wire round rod to prepare a charge generating layer having a thickness of about 0.7 μm.

Bisazo Pigment

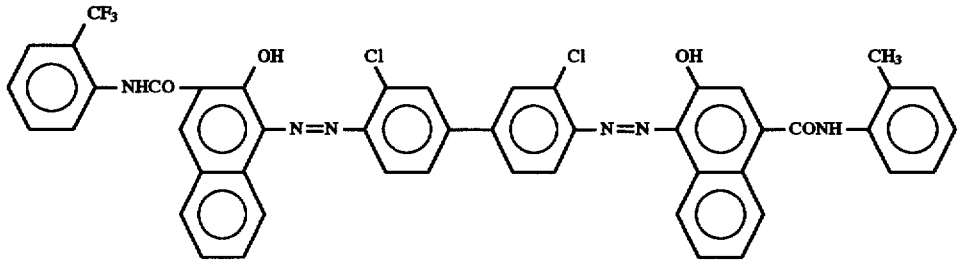

A mixed solution of 20 g of a hydrazone compound having the structure shown below, 20 g of a polycarbonate resin (Lexan 121 manufactured by General Electric Co., Ltd.) and 160 g of tetrahydrofuran was coated on the above-described charge generating layer by a wire round rod, dried at 60° C. for 30 seconds and then heated at 100° C. for 20 seconds to form a charge transporting layer having a thickness of about 18 μm whereby an electrophotographic light-sensitive layer of a double-layered structure was prepared.

Hydrazone Compound

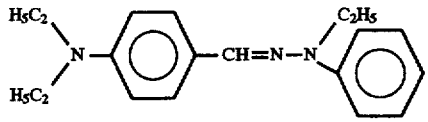

A mixed solution of 13 g of Resin (P-39) having the structure shown below, 0.2 g of phthalic anhydride, 0.002 g of o-chlorophenol and 100 g of toluene was coated on the light-sensitive layer by a wire round rod, set to touch and heated at 120° C. for one hour to prepare a surface layer for imparting releasability having a thickness of 1 μm. The adhesive strength of the surface of the resulting light-sensitive element was 5 g·f.

Resin (P-39)

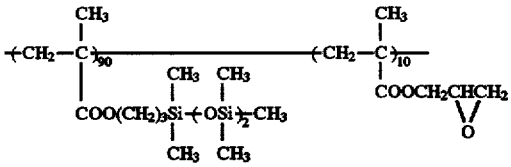

The resulting light-sensitive element was installed as a light-sensitive 11 in an apparatus as shown in FIG. 4 having a transfer layer-forming device as shown in FIG. 6, and a transfer layer 12 was formed on the light-sensitive element 11 in the following manner.

On Sanrelease (manufactured by Sanyo-Kokusaku Pulp Co., Ltd.) as release paper 24 was provided a transfer layer having a thickness of 3 μm composed of a mixture of polyvinyl acetate and polyphenethyl methacrylate in a weight ratio of 5:5. The resulting paper was brought into contact with the above-described light-sensitive element 11 under condition of a nip pressure of the rollers of 3 Kgf/cm$^2$, surface temperature of 60° C. and a transportation speed of 10 mm/sec as shown in FIG. 6 whereby the transfer layer 12 having a thickness of 3 μm was transferred on the light-sensitive element.

The resulting light-sensitive element was charged to a surface potential of +500 V in dark and exposed imagewise using a helium-neon laser of 633 nm at an irradiation dose on the surface of the light-sensitive element of 30 erg/cm$^2$, followed by conducting the same procedure as in Example 1 to form color toner image on the light-sensitive element.

On the other hand, as a primary receptor 20, an endless belt type as shown in FIG. 5 was employed in place of a drum type as shown in FIG. 4. On a drum wound with a blanket for offset printing (9600-A manufactured by Meiji Rubber & Co., Ltd.) having the adhesive strength of 80 g·f/10 mm width and a thickness of 1.6 mm as the primary receptor 20 was supplied each of Dispersions of Resin (A) (L-5) and (L-6) having the composition shown below from an electrodeposition unit as a transfer layer-forming device 21 to form a transfer layer 12" having a double-layered structure according to the electrodeposition coating method.

Formation of Transfer Layer 12"

A first transfer layer having a thickness of 2.5 μm was formed on the primary receptor 20 using Dispersion of Resin (A) (L-5) shown below, while charging the primary receptor to −150 V to electrodeposite resin grains.

| Dispersion of Resin (A) (L-5) | |
|---|---|
| Resin Grain (AR-3) | 10 g (solid basis) |
| Charge Control Agent (D-3) | 0.02 g |
| 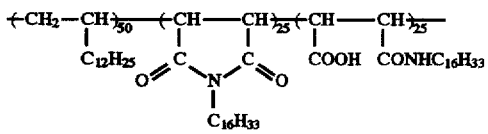 | |
| Branched Tetradecyl Alcohol (FOC-1400 manufactured by Nissan Chemical Industries, Ltd.) | 8 g |
| Isopar G | up to make 1.0 liter |

On the first transfer layer was formed a second transfer layer having a thickness of 2 μm using Dispersion of Resin (A) (L-6) prepared in the same manner as in Dispersion of Resin (A) (L-5) above except for using 10 g of Resin Grain (ARL-3) in place of 10 g of Resin Grain (ARH-3) employed in Dispersion of Resin (A) (L-5), while charging the printing receptor to −150 V to electrodeposite resin grains.

As described above, the second transfer layer 12" on the primary receptor 20 to come into contact with a toner image was composed of the resin having a low Tg.

The light-sensitive element 11 was then heated using the pre-heating means 16 and a temperature controlling means 17 so as to maintain the surface temperature of light-sensitive element at 60° C. The drum of light-sensitive element 11 and the drum of primary receptor 20 were brought into contact with each other and subjected to heating and pressing under the condition of a nip pressure of 3 Kgf/cm$^2$ and a drum circumferential speed of 100 mm/sec, whereby the color toner image 3 was wholly transferred together with the transfer layer 12 onto the transfer layer 12" on the primary receptor 20.

Then, coated paper used for printing was introduced as a receiving material 30 between the drum of primary receptor 20, the surface temperature of which had been adjusted at 60° C. by the temperature controlling means 17 and a back-up roller for transfer 31 adjusted at 130° C. and a back-up roller for release 32 adjusted at 10° C., and subjected to heating and pressing under a nip pressure of 4 Kgf/cm$^2$ and at a drum circumferential speed of 100 mm/sec. The toner image 3 was wholly transferred together with the transfer layer 12 and the transfer layer 12" on the coated paper 30 and thus clear color image of good image quality was obtained.

Moreover, the formation of color image was conducted in the same procedure as above using commercially available copying paper instead of coated paper used for printing as a final receiving material 30. The color image obtained was almost the same as that on coated paper. Specifically, excellent color duplicates were obtained irrespective of quality of paper used as receiving material 30.

EXAMPLE 7

The X-form metal-free phthalocyanine light-sensitive element having the surface of releasability and primary receptor each employed in Example 1 were installed in the apparatus same as in Example 1. On the light-sensitive element was formed a transfer layer 12 having a double-layered structure composed of a first layer adjacent to the light-sensitive element comprising a resin (AH) having a high Tg and a second layer provided thereon comprising a resin (AL) having a low Tg by the electrodeposition coating method in the same manner as in Example 1 as follows.

Formation of Transfer Layer 12

A first transfer layer having a thickness of 2 μm was formed on the light-sensitive element using Dispersion of Resin (A) (L-7) shown below, while charging the light-sensitive element to −130 V to electrodeposite resin grains.

| Dispersion of Resin (A) (L-7) | |
|---|---|
| Resin Grain (AR-9) | 10 g (solid basis) |
| Charge Control Agent (D-3) | 0.02 g |
| Branched Tetradecyl Alcohol (FOC-1400 manufactured by Nissan Chemical Industries, Ltd.) | 8 g |
| Isopar G | up to make 1.0 liter |

On the first transfer layer was formed a second transfer layer having a thickness of 2.5 μm using Dispersion of Resin (A) (L-8) prepared in the same manner as in Dispersion of Resin (A) (L-7) above except for using 10 g of Resin Grain (AR-29) in place of 10 g of Resin Grain (AR-9) employed in Dispersion of Resin (A) (L-7), while charging the light-sensitive element to −200 V to electrodeposite resin grains.

On the resulting light-sensitive element 11 was then formed a color image 3 by the electrophotographic process same as in Example 1.

On the other hand, on the primary receptor 20 was formed a transfer layer 12" having a thickness of 2 μm by supplying Dispersion of Resin (A) (L-9) having the composition shown below from a transfer layer-forming device 21 in FIG. 4 according to the electrodeposition coating method.

| Dispersion of Resin (A) (L-9) | |
|---|---|
| Resin Grain (AR-22) | 8 g (solid basis) |
| Charge Control Agent (D-1) | 0.022 g |
| Isopar H | up to make 1 liter |

Then, the light-sensitive element was passed under an infrared line heater to adjust a surface temperature thereof measured by a radiation thermometer at about 80° C., the drum of primary receptor 20 having provided thereon the transfer layer 12" was heated at 100° C. and the drum of light-sensitive element 11 was brought into contact with the drum of primary receptor 20 under the condition of a nip pressure of 4 Kgf/cm$^2$ and a drum circumferential speed of 100 mm/sec, whereby the color toner image 3 was wholly transferred onto the primary receptor 20.

Then, high quality paper 30 was brought into contact with the primary receptor 20 bearing the color toner image 3 thereon and they were passed under a heating rubber roller 31 which was in contact under a pressure of 4 Kgf/cm$^2$ and whose surface temperature was constantly maintained at 120° C. at a transportation speed of 100 mm/sec.

After cooling by passing under a cooling roller 32, the high quality paper was stripped from the primary receptor, whereby the toner image 3 on the primary receptor 20 was wholly transferred together with the transfer layers 12 and 12" onto the high quality paper. The toner image 3 was completely covered with the thermoplastic resin of transfer layer 12" on the high quality paper 30 and thus it did not fall off when it was rubbed, and exhibited a sufficient image strength. Further, on the duplicate, retouching and sealing can be made same as on normal paper.

EXAMPLES 8 TO 27

The formation of color image was performed in the same manner as in Example 1 except for using each of the resins (P) and/or resin grains (L) shown in Table M below in place of 2.0 g of Resin (P-1) employed in Example 1.

TABLE M

| Example | Resin (P) and/or Resin Grain (L) | Amount |
|---|---|---|
| 8 | P-2 | 2 g |
| 9 | L-14 | 1.8 g |
| 10 | P-6 | 1.0 g |
| 11 | P-11 | 1.5 g |
| 12 | L-19 | 2.1 g |
| 13 | P-19 | 1.5 g |
| | L-23 | 0.5 g |
| 14 | P-13 | 1.2 g |
| 15 | P-16 | 2.0 g |
| 16 | P-32 | 2.0 g |
| 17 | P-17 | 1.4 g |
| 18 | P-22 | 1.0 g |
| | L-9 | 1.0 g |
| 19 | P-28 | 2.5 g |
| 20 | P-30 | 1.8 g |
| 21 | L-2 | 2.5 g |
| 22 | P-34 | 2.0 g |
| 23 | P-36 | 2.0 g |
| 24 | P-31 | 1.2 g |
| | L-15 | 1.0 g |
| 25 | P-35 | 2.0 g |
| 26 | L-24 | 2.5 g |
| 27 | P-38 | 1.8 g |

Each of the color duplicates obtained had clear images free from background stain and good image strength.

EXAMPLES 28 TO 38

The formation of color image was performed in the same manner as in Example 1 except for using each of the compounds shown in Table N below in place of Resin (P-1) and phthalic anhydride and o-chlorophenol employed in Example 1.

TABLE N

| Example | Resin (P) or Resin Grain (L) | Amount | Compound for Crosslinking | Amount |
|---|---|---|---|---|
| 28 | P-30 | 1.8 g | Phthalic anhydride | 0.2 g |
| | | | Zirconium acetylacetone | 0.01 g |
| 29 | P-22 | 2.5 g | Gluconic acid | 0.008 g |
| 30 | P-25 | 3 g | N-Methylaminopropanol | 0.25 g |
| | | | Dibutyltin dilaurate | 0.001 g |
| 31 | P-9 | 2 g | N,N'-Dimethylpropanediamine | 0.3 g |
| 32 | P-7 | 3 g | Propylene glycol | 0.2 g |
| | | | Tetrakis(2-ethylhexane-diolato)titanium | 0.008 g |
| 33 | L-18 | 2 g | — | |
| 34 | L-15 | 1.8 g | N,N-Dimethylpropanediamine | 0.25 g |
| 35 | P-13 | 3 g | Divinyl adipate | 0.3 g |
| | | | 2,2'-Azobis(isobutyronitrile) | 0.001 g |
| 36 | P-14 | 2 g | Propyltriethoxysilane | 0.03 g |
| 37 | L-21 | 1.5 g | N,N-Diethylbutanediamine | 0.3 g |

TABLE N-continued

| Example | Resin (P) or Resin Grain (L) | Amount | Compound for Crosslinking | Amount |
|---|---|---|---|---|
| 38 | P-5 | 0.8 g | Ethylene diglycidyl ether<br>o-Chlorophenol | 0.2 g<br>0.001 g |

Each of the color images obtained was clear and free from background stain and had good image strength similar to that in Example 1.

EXAMPLES 39 TO 46

Each of the color duplicates was formed in the same manner as in Example 2 except for using each of Resin Grains (AR) and/or (ARW) shown in Table O below in place of Resin Grains (AR-18) and (ARW-1) employed for the transfer layer 12 formed on the electrophotographic light-sensitive element and Resin Grain (ARW-3) employed for the transfer layer 12' formed on the toner image in Example 2.

TABLE O

| Example | Tansfer Layer 12 on Electro-photographic Light-Sensitive Element | Weight Ratio | Tansfer Layer 12' on Toner Image | Weight Ratio |
|---|---|---|---|---|
| 39 | ARW-1 | (100) | ARW-10 | (100) |
| 40 | AR-19<br>AR-32 | (50/50) | ARW-3 | (100) |
| 41 | AR-5<br>AR-26 | (60/40) | ARW-9 | (100) |
| 42 | AR-8 | (70/30) | ARH-2 | (80/20) |

TABLE O-continued

| Example | Tansfer Layer 12 on Electro-photographic Light-Sensitive Element | Weight Ratio | Tansfer Layer 12' on Toner Image | Weight Ratio |
|---|---|---|---|---|
| | AR-36 | | ARL-4 | |
| 43 | AR-9<br>AR-36 | (40/60) | AR-14<br>AR-27 | (70/30) |
| 44 | ARH-11<br>AR-38 | (55/45) | AR-4<br>AR-37 | (50/50) |
| 45 | AR-12<br>ARW-5 | (50/50) | AR-10<br>AR-29 | (20/80) |
| 46 | AR-17<br>ARW-8 | (70/30) | ARW-13 | (100) |

Each color duplicate obtained exhibited good characteristics similar to those in Example 2. Further, retouching property, sealing property and filing property of each color duplicate were good similar to normal paper.

EXAMPLES 47 TO 52

Each of the color duplicates was obtained in the same manner as in Example 5 except for using each of the compound (S) and 8 g (in total) of Resin Grain (AR) or (ARW) shown in Table P below in place of 0.8 g/l of Compound (S-5) and 8 g of Resin Grain (AR-4) employed in Example 5.

Each color duplicate obtained exhibited good characteristics similar to those in Example 5. Specifically, the releasability was easily imparted on the surface of light-sensitive element using the compound (S), and the transfer layer composed of Resin Grain (AR) or (ARW) did not adversely affect the electrophotographic characteristics and was able to be easily and completely transferred.

TABLE P

| Example | Compound (S) containing Fluorine and/or Silicon Atom | Amount (g/l) | Resin Grain for Transfer layer | Weight Ratio |
|---|---|---|---|---|
| 47 | (S-6) Higher fatty acid-modified silicone (TSF 411 manufactured by Toshiba Silicone Co., Ltd.)<br> 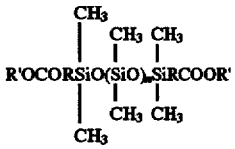 <br>(presumptive structure) | 1.0 | AR-12<br>AR-25 | (70/30) |
| 48 | (S-7) Carboxy-modified silicone (X-22-3701E manufactured by Shin-Etsu Silicone Co., Ltd.)<br> 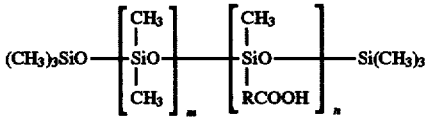 <br>(presumptive structure) | 0.5 | AR-22<br>AR-33 | (20/80) |
| 49 | (S-8) Carbinol-modified silicone (X-22-176B manufactured by Shin-Etsu Silicone Co., Ltd.) | 1.0 | AR-20<br>AR-31 | (25/75) |

TABLE P-continued

| Example | Compound (S) containing Fluorine and/or Silicon Atom | Amount (g/l) | Resin Grain for Transfer layer | Weight Ratio |
|---|---|---|---|---|
| | 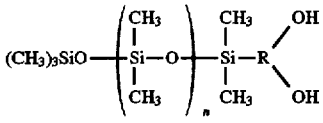 (presumptive structure) | | | |
| 50 | (S-9) Mercapto-modified silicone (X-22-167B manufactured by Shin-Etsu Silicone Co., Ltd.) | 2 | ARW-9 | (100) |
| | 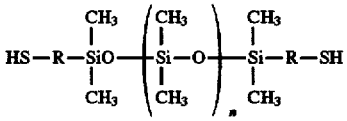 (presumptive structure) | | | |
| 51 | (S-10) 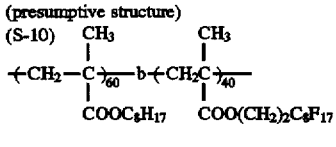 Mw $6\times10^3$ | 1.5 | ARW-6 | (100) |
| 52 | (S-11) 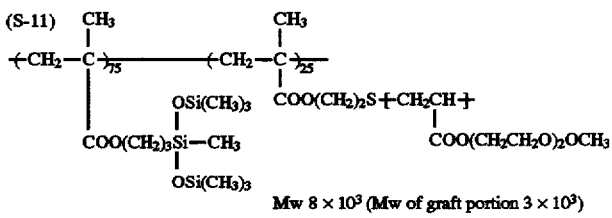 Mw $8\times10^3$ (Mw of graft portion $3\times10^3$) | 2 | ARW-8 | (100) |

EXAMPLES 53 TO 61

The procedure for the formation of transfer image same as in Example 5 was repeated except that each of the resins shown in Table Q below was used in place of the resin (A) employed in the transfer layer 12" on the primary receptor of Example 5. Good results similar to those in Example 5 were obtained.

TABLE Q

| Example | Thermoplastic Resin |
|---|---|
| 53 | Cellulose acetate butyrate (Cellidor Bsp manufactured by Bayer AG) |
| 54 | Polyvinyl butyral resin (S-Lec manufactured by Sekisui Chemical Co., Ltd.) |
| 55 | Cellulose propionate (Cellidoria manufactured by Daicel Co., Ltd.) |
| 56 | Mixture of vinyl acetate/crotonic acid (99/1 by weight) copolymer and Cellidor Bsp in a weight ratio of 8:2 |
| 57 | Methyl methacrylate/methyl acrylate (60/40 by weight) copolymer |
| 58 | Mixture of polyvinyl methyl ether and polyvinyl acetate in a weight ratio of 5:5 |
| 59 | Styrene/butadiene copolymer (Sorprene 1204 manufactured by Asahi Kasei Kogyo kabushiki Kaisha) |
| 60 | Mixture of polydecamethylene terephthalate and polydecamethylene isophthalate in a weight ratio of 5:5 |
| 61 | Poly-4-methylpentene-1 |

EXAMPLES 62 TO 65

Color images were formed in the same manner as in Example 6 except for using paper prepared by providing a transfer layer having a thickness of 3.0 μm composed of each of the resins (A) shown in Table R below on release paper (Sanrelease manufactured by Sanyo-Kokusaku Pulp Co., Ltd.) in place of the transfer paper used in Example 6.

Each of the color images obtained was clear and free from background stain, and degradation of image quality was not substantially observed when compared with the original.

TABLE R

| Example | Resin (A) |
|---|---|
| 62 | Mixture of vinyl acetate/vinyl butyrate (8/2 by weight) copolymer and benzyl methacrylate/methyl methacrylate (8/2 by weight) copolymer in a weight ratio of 60:40 |
| 63 | Mixture of 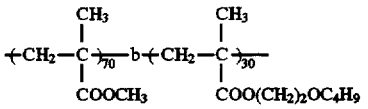 and Evaflex 420 in a weight ratio of 70:30 Mw $4 \times 10^4$ (-b-: bond connecting blocks) |
| 64 | 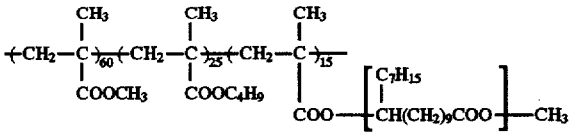 Mw $4 \times 10^4$ (Mw of graft portion $4 \times 10^3$) |
| 65 | Mixture of 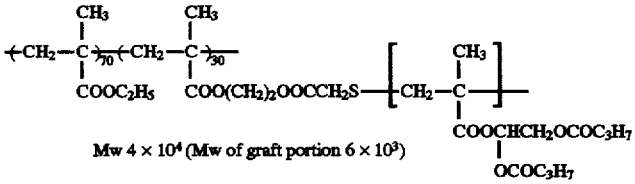 Mw $4 \times 10^4$ (Mw of graft portion $6 \times 10^3$) and polyvinyl acetate in a weight ratio of 50:50 |

EXAMPLE 66

The formation of color duplicate was conducted in the same manner as in Example 1 except for using a receiving material described below in place of the coated paper employed as the final receiving material 30. Specifically, a color image was formed under the same condition as in Example 1 using a receiving material 30 prepared by applying a resin (Evaflex 45×) on coated paper at a thickness of 5 μm. The good color image similar to that of Example 1 was obtained on the receiving material.

Then, the transfer step from the primary receptor 20 onto the receiving material 30 was performed in the same manner as above except that the transfer condition was changed as follows:

| | Transfer Condition II |
|---|---|
| Transfer temperature | 100° C. → 80° C. |
| Transfer nip pressure | 5 Kgf/cm$^2$ → 3 Kgf/cm$^2$ |
| Transfer speed (drum circumferential speed) | 10 mm/sec → 150 mm/sec |

The toner image 3 was wholly transferred together with the transfer layer 12 onto the coated paper having provided thereon the resin layer and defects such as cuttings of toner image were not observed at all under Transfer Condition II.

On the other hand, the same procedure as above was repeated using coated paper having no resin layer as the receiving material. Under Transfer Condition II of a low transfer pressure and a high transfer speed, the transfer was not conducted sufficiently and cuttings of image occurred on the color duplicate formed on coated paper. Also, the residue of toner image was observed on the primary receptor.

From these results, it can be seen that the provision of appropriate resin layer on the surface of receiving material to come into contact with the toner image and transfer layer in the method of the present invention makes it possible to realize the mild transfer condition and increased transfer speed. The similar results were obtained on other receiving materials than coated paper, for example, high quality paper, normal paper, copying paper and various resin films.

It is believed that the transfer latitude is greatly enlarged owing to a cushion effect at the transfer and an effect of increasing adhesion to the toner image and transfer layer. Thus, color duplicates of a good performance similar to the above were obtained when commercially available adhesive sheets, for example, Copy Label CK-200 manufactured by Plus Co., Ltd., Tuck Form Lable TF Sheet manufactured by Lion Co., Ltd. and an adhesive film for word-processor (Tie Series Sheet manufactured by Kokuyo Co., Ltd.) were employed as final receiving materials.

EXAMPLES 67 TO 71

The formation of color duplicate was conducted in the same manner as in Example 66 under Transfer Condition II except for using each of the receiving materials described in Table S below in place of the coated paper having provided thereon Evaflex 45× employed in Example 66.

TABLE S

| Example | Substrate | Resin Layer on Substrate |
|---|---|---|
| 67 | High quality | Resin layer of double structure comprising a layer (4 μm) of Evaflex |

TABLE S-continued

| Example | Substrate | Resin Layer on Substrate |
|---|---|---|
| | paper | 150X and a layer (1 μm) of methoxymethyl-modified nylon copolymer (Diamide MX-100 manufactured by Daicel Co., Ltd.) thereon |
| 68 | Copying paper for PPC | Resin layer (6 mμ) of copolymer: 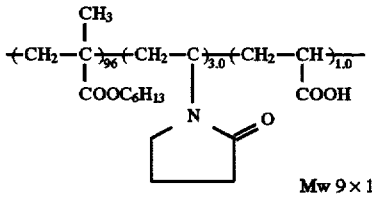 Mw $9\times10^4$ |
| 69 | Normal paper | Resin layer of double structure comprising a layer (6 μm) of styrene-butadiene rubber (Toughden manufactured by Asahi Kasei Kogyo Kabushiki Kaisha) and a layer (1 μm) of Evaflex 45X thereon |
| 70 | PET film | Resin layer of double structure comprising a layer (5 μm) of Chemit R-185 and a layer (1 μm) of Evaflex 45X thereon |
| 71 | Coated paper | Resin layer (4 μm) of Evaflex 45X |

Good results similar to those of Example 66 were obtained.

POSSIBILITY OF UTILIZATION IN INDUSTRY

The method and apparatus according to the present invention can be effectively employed for the formation of color images in electrophotographic color duplicators, color printers, color proofers or color checkers, etc.

What is claimed is:

1. A method of forming a color image comprising forming at least one color toner image on a peelable transfer layer provided on the surface of an electrophotographic light-sensitive element whose surface has releasability by an electrophotographic process, transferring the toner image together with the transfer layer onto a primary receptor, and transferring the toner image together with the transfer layer from the primary receptor onto a final receiving material;

wherein the surface of the electrophotographic light-sensitive element has an adhesive strength of not more than 50 g·f;

wherein the transfer layer comprises a thermoplastic resin (A) having a glass transition point of not more than 140° C. or a softening point of not more than 180° C.; and wherein the primary receptor has a surface having an adhesive strength which is at most 180 g·f and is at least 30 g·f larger than the adhesive strength of the surface of the electrophotographic light-sensitive element.

2. A method of forming a color image as claimed in claim 1, wherein a peelable transfer layer is further provided on the toner image formed on the transfer layer.

3. A method of forming a color image as claimed in claim 1, wherein the primary receptor has a peelable transfer layer provided on the surface thereof.

4. A method of forming a color image as claimed in claim 1, wherein the electrophotographic light-sensitive element whose surface has releasability is caused by adsorption or adherence of a compound (S) containing at least a fluorine atom and/or a silicon atom onto its surface.

5. A method of forming a color image as claimed in claim 1, wherein the peelable transfer layer is formed by means of electrodeposition or adhesion of resin grains (AR) by electrophoresis on the surface of electrophotographic light-sensitive element to form a film using a dispersion for electrodeposition comprising resin grains (AR) having a glass transition point of not more than 140° C. or a softening point of not more than 180° C. dispersed in an electrically insulating organic solvent having a dielectric constant of not more than 3.5 and at least one compound (S) which has a fluorine atom and/or a silicon atom and is soluble at least 0.01 g per 1.0 liter of the organic solvent.

6. A method of forming a color image as claimed in claim 1, wherein the method is repeated using said light-sensitive element and said primary receptor.

7. An apparatus for forming a color image comprising a means for forming a peelable transfer layer on the surface of an electrophotographic light-sensitive element, a means for forming at least one color toner image on the transfer layer by an electrophotographic process, a means for transferring the toner image together with the transfer layer onto a primary receptor and a means for transferring the toner image together with the transfer layer from the primary receptor onto a final receiving material;

wherein the surface of the electrophotographic light-sensitive element has an adhesive strength of not more than 50 g·f;

wherein the transfer layer comprises a thermoplastic resin (A) having a glass transition point of not more than 140° C. or a softening point of not more than 180° C.; and wherein the primary receptor has a surface having an adhesive strength which is at most 180 g·f and is at least 30 g·f larger than the adhesive strength of the surface of the electrophotographic light-sensitive element.

8. An apparatus for forming a color image as claimed in claim 7, which further comprises a means for forming a peelable second transfer layer on the toner image formed on the transfer layer.

9. An apparatus for forming a color image as claimed in claim 7, which further comprises a means for forming a peelable second transfer layer on the toner image formed on the primary receptor.

* * * * *